US007647014B2

(12) United States Patent
Kagawa et al.

(10) Patent No.: US 7,647,014 B2
(45) Date of Patent: Jan. 12, 2010

(54) PRETRANSFER CHARGING DEVICE AND IMAGE FORMING APPARATUS INCLUDING SAME

(75) Inventors: Toshiaki Kagawa, Kitakatsuragi-gun (JP); Hideki Ohnishi, Chiba (JP); Hiroshi Kida, Yamatokoriyama (JP); Yoshiaki Masuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 401 days.

(21) Appl. No.: 11/704,388

(22) Filed: Feb. 9, 2007

(65) Prior Publication Data

US 2007/0201910 A1 Aug. 30, 2007

(30) Foreign Application Priority Data

Feb. 13, 2006 (JP) ..... 2006-035786
Feb. 27, 2006 (JP) ..... 2006-051122
Dec. 28, 2006 (JP) ..... 2006-355593
Dec. 28, 2006 (JP) ..... 2006-355594

(51) Int. Cl.
*G03G 15/16* (2006.01)
*G03G 15/02* (2006.01)

(52) U.S. Cl. ..... 399/296; 399/50; 399/170; 399/171

(58) Field of Classification Search ..... 399/48, 399/50, 168–173
See application file for complete search history.

(56) References Cited

U.S. PATENT DOCUMENTS 3,977,848 A 8/1976 Oliphant
4,346,986 A 8/1982 Kuge et al.
4,591,713 A 5/1986 Gundlach et al.
4,672,505 A 6/1987 Tsuchiya et al.
5,025,155 A 6/1991 Hattori
5,367,366 A 11/1994 Kido et al.
5,466,938 A 11/1995 Nakayama et al.

(Continued)

FOREIGN PATENT DOCUMENTS

JP 6-11946 1/1994

(Continued)

OTHER PUBLICATIONS

Furukawa et al, "An Ozone Reduction Method of the Corona Charging Device", Denshi Shashin Gakkaishi (Electrophotography), vol. 35, No. 2, 1996, pp. 116-124.

*Primary Examiner*—Hoang Ngo
(74) *Attorney, Agent, or Firm*—Nixon & Vanderhye P.C.

(57) ABSTRACT

The present invention is made to provide a pretransfer charging device, which allows (i) reduction of generation of discharge products such as ozone and nitroxide, (ii) excellent uniform charging, (iii) continuous stable charging for a long period of time, and (iv) restraint of distortion of a toner image. The pretransfer charging device includes (i) ion generation needles each provided face to face with an image carrier such as a photoconductor drum or an intermediating transfer belt, and (ii) a high-voltage power supply for applying a negative voltage to each of the ion generation needles. The voltage to be applied from the high-voltage power supply is not less than an ion production threshold voltage but is less than a corona discharge threshold voltage. With this, no corona discharge occurs but negative ions can be generated. This makes it possible to solve various problems caused due to the corona discharge.

8 Claims, 14 Drawing Sheets

U.S. PATENT DOCUMENTS

| | | | | |
|---|---|---|---|---|
| 5,539,501 | A * | 7/1996 | Yu et al. | 399/171 |
| 5,552,861 | A | 9/1996 | Mizude et al. | |
| 5,552,865 | A | 9/1996 | Osawa et al. | |
| 5,568,230 | A | 10/1996 | Reddy et al. | |
| 5,666,604 | A * | 9/1997 | Nakagami et al. | 399/171 |
| 6,266,499 | B1 | 7/2001 | Murata et al. | |
| 6,493,529 | B1 | 12/2002 | Umemura et al. | |
| 6,635,106 | B2 | 10/2003 | Katou et al. | |
| 6,826,375 | B2 | 11/2004 | Kitajima | |
| 7,110,701 | B2 | 9/2006 | Facci et al. | |
| 7,149,458 | B2 | 12/2006 | Zona et al. | |
| 7,228,091 | B2 | 6/2007 | Hays et al. | |
| 7,264,752 | B2 | 9/2007 | Drappel | |
| 7,397,032 | B2 | 7/2008 | Zona et al. | |
| 7,398,035 | B2 | 7/2008 | Zona et al. | |
| 2002/0064396 | A1 | 5/2002 | Becker et al. | |
| 2003/0215264 | A1 * | 11/2003 | Yasutomi et al. | 399/159 |
| 2004/0091285 | A1 | 5/2004 | Lewis | |
| 2005/0226644 | A1 | 10/2005 | Ino | |
| 2006/0013617 | A1 | 1/2006 | Facci et al. | |
| 2006/0193657 | A1 | 8/2006 | Zona et al. | |

FOREIGN PATENT DOCUMENTS

| | | |
|---|---|---|
| JP | 6-250491 | 9/1994 |
| JP | 8-160711 | 6/1996 |
| JP | 10-274892 | 10/1998 |
| JP | 2001-134048 | 5/2001 |
| JP | 2001-143849 A | 5/2001 |
| JP | 2001-356568 | 12/2001 |
| JP | 2002-328506 | 11/2002 |
| JP | 2003-140444 | 5/2003 |
| JP | 2004-69860 | 3/2004 |
| JP | 2005-149983 | 6/2005 |
| JP | 2005-316395 | 11/2005 |
| JP | 2008-159431 | 7/2008 |

* cited by examiner

PRETRANSFER CHARGING DEVICE AND IMAGE FORMING APPARATUS INCLUDING SAME

This Nonprovisional application claims priority under ±U.S.C. § 119(a) on Patent Application No. 2006/035786 filed in Japan on Feb. 13, 2006, Patent Application No. 2006/051122 filed in Japan on Feb. 27, 2006, Patent Application No. 2006/355593 filed in Japan on Dec. 28, 2006, and Patent Application No. 2006/355594 filed in Japan on Dec. 28, 2006, the entire contents of which are hereby incorporated by reference.

FIELD OF THE INVENTION

The present invention relates to a pretransfer charging device provided in an image forming apparatus, which employs an electrophotographic method, so as to carry out charging before a toner image formed on an image carrier such as a photoconductor or an intermediating retransfer member is transferred onto a transfer target such as an intermediating retransfer member or recording paper. Moreover, the present invention also relates to an image forming apparatus including the pretransfer charging device.

BACKGROUND OF THE INVENTION

Conventionally, in an image forming apparatus employing an electrophotographic method, a corona discharge type charging device has been frequently used for (i) a charging device for uniformly charging a photoconductor or the like; (ii) a transfer device for electrostatically transferring a toner image, formed on a photoconductor or the like, onto recording paper or the like; or (iii) a removing device for removing recording paper or the like from a photoconductor or the like that is electrostatically in contact with the recording paper.

Generally used as such a corona discharge type charging device is either a corotron or a scorotron. The corotron includes (i) a shield having an aperture section facing a charging subject such as a photoconductor or recording paper, and (ii) a discharging electrode provided in the shield and having a line-like shape or a saw-tooth-like shape. The colotron applies a high voltage to the discharging electrode so as to cause corona discharge, with the result that the charging subject is uniformly charged. The scorotron includes a grid electrode provided between a discharging electrode and a charging subject, and applies a desired voltage to the grid electrode, with the result that the charging subject is uniformly charged. See Citation 1.

FIG. 18 is an explanatory diagram schematically illustrating a charging mechanism in such a conventional corona discharge type charging device. As described above, the corona discharge type charging device includes (i) a charging electrode 101 having a line-like shape, a saw-tooth-like shape, or a needle-like shape, and (ii) a counter electrode (discharging target) such as either an image carrier 102 on which a toner image 104 is to be formed or a grid electrode 103. Examples of the image carrier 102 include a photoconductor and an intermediating retransfer member. By applying a high voltage between (i) the discharging electrode 101 having such a small curvature radius and (ii) the counter electrode (discharging target), a non-uniform electric field is formed between the two electrodes. A strong electric field formed in the vicinity of the discharging electrode 101 causes local ionization activity, with the result that electrons are emitted (electric discharge due to electron avalanche). With this, the charging subject such as the photoconductor, the intermediating member, the toner image, or the like can be discharged. Further, the grid electrode 103 is provided so as to control an amount of electrons heading for the charging subject such as the image carrier 102. Therefore, the grid electrode 103 is also subjected to the discharging of the electrons.

Further, for example, each of Citations 2 and 3 discloses that such a corona discharge type charging device as described above is used for a pretransfer charging device for charging a toner image that is to be transferred to a transfer medium such as an intermediating retransfer member or recording paper. With the technique each described in Citations 2 and 3, a charge amount of the toner image formed on the image carrier can be uniformized before the transfer, even when there is fluctuation in the charge amount of the toner image. This makes it possible to restrain decrease of a degree of margin in transferring the toner image, so that the toner image is stably transferred onto the transfer medium.

However, each of the aforementioned conventional charging devices suffers from a plurality of problems.

A first problem is as follows. That is, the conventional corona discharge type charging device generates a large quantity of discharge products such as ozone ($O_3$) and nitroxide ($NO_x$). Specifically, a nitrogen molecule ($N_2$) is separated into nitrogen atoms (N), and each of the nitrogen atoms is combined with an oxygen molecule ($O_2$), with the result that nitroxide (nitrogen dioxide: $NO_2$) is generated. Likewise, an oxygen molecule ($O_2$) is separated into oxygen atoms (O), and each of the oxygen atoms is combined with an oxygen molecule ($O_2$), with the result that a large quantity of ozone ($O_3$) is generated.

The large quantity of ozone thus generated causes problems such as (i) generation of ozone odor, (ii) adverse effect on human body, and (iii) deterioration of parts due to strong oxidation. Further, the nitroxide thus generated is adhered to the photoconductor in the form of ammonium salt (ammonium nitrate). This will be a cause of formation of an unnatural image. Especially, such ozone and $NO_x$ easily causes a defective image in an organic photoconductor (OPC) normally used in such a charging device. Examples of the defective image include: formation of a white spot in an image and image deletion.

Further, the nitroxide is adhered to the grid electrode of the corona discharge type charging device, with the result that the surface of the grid electrode is oxidized and is corroded. This causes secondary generation of insulative metal oxide on the grid electrode, with the result that the uniformity in the charging is spoiled. Such non-uniformity in the discharging causes image deterioration. This is problematic.

Thus, in an intermediating transfer type color image forming apparatus having a plurality of transfer portions, such a problem in the respective quantities of the produced ozone and $NO_x$ makes it difficult to provide the pretransfer charging device in the upstream with respect to all the transfer portions (primary and secondary transfer portions), even though it is preferable to provide the pretransfer charging device therein.

Further, the photoconductor requires a charging device for use in latent image formation. Therefore, in consideration of an adverse effect on the photoconductor, it is difficult to provide the pretransfer charging device in addition to the charging device so as to carry out pretransfer charging with respect to a toner image formed on the photoconductor. An only way to avoid this problem is to use an amorphous silicon photoconductor, which can be charged positively and therefore allows generation of a relatively small quantity of ozone, which is excellent in its plate life, and from which a discharge product is forcefully removable.

Meanwhile, a contact charging method using a conductive roller or a conductive brush as a charging device for directly charging a photoconductor has been adopted in recent years for the purpose of reducing generation of ozone. However, in the contact charging method, it is difficult to charge the photoconductor without distorting the toner image. Accordingly, the conventional non-contact corona discharge type charging device is used for the pretransfer charging device. However, by providing the conventional corona charging type pretransfer charging device in the image forming apparatus including the charging device adopting the contact charging method, such a feature of the contact charging method that allows for reduction of ozone is eliminated.

A technique for reducing a quantity of produced ozone is disclosed in, e.g., Citation 4. Specifically, Citation 4 discloses a charging device, including (i) a large number of discharging electrodes arranged with a substantially constant pitch therebetween in a predetermined axis direction; (ii) a high-voltage power supply for applying a voltage, to each of the discharging electrodes, a voltage equal to or higher than a discharge threshold voltage; (iii) a resist member provided between an output electrode of the high-voltage power supply and the discharging electrode; (iv) a grid electrode provided between the discharging electrode and a charging subject so as to be adjacent to the discharging electrode; and (v) a grid power source for applying a grid voltage to the grid electrode. A gap between the discharging electrode and the grid electrode is set at 4 mm or less such that a discharging current is reduced and the quantity of produced ozone is accordingly reduced.

The technique of Citation 4 allows reduction of the quantity of produced ozone, by reducing the discharging current. However, the quantity of the reduction of ozone is still insufficient, i.e., ozone is generated at approximately 1.0 ppm. Further, Citation 4 suffers from another problem: discharging is unstable due to (i) adhesion of a discharge product, toner, bits of paper, and the like to the discharging electrode, and/or (ii) abrasion and deterioration of the tip of the discharging electrode. The abrasion and the deterioration are caused due to discharging energy.

Further, the gap is narrow between the discharging electrode and the charging subject, so that charge non-uniformity is caused with ease in the longitudinal direction (pitch direction of the plurality of discharging electrodes) due to the pitch between the discharging electrodes. A conceivable way to eliminate the charge non-uniformity is to reduce the pitch between the discharging electrodes. However, this causes increase of the number of discharging electrodes, thereby increasing manufacturing cost.

A second problem of the conventional charging device is corona wind (also referred to as "ozone wind"). As indicated by an arrow 105 in FIG. 18, the corona wind blows from each of the discharging electrodes to the charging subject due to the flow of the electrons, which flow is caused by the corona discharge. Accordingly, the corona wind distorts the toner image 104 formed on the image carrier 102, in cases where the conventional corona discharge type charging device is used for the pretransfer charging device.

Citation 1: Japanese Unexamined Patent Publication Tokukaihei 06-11946/1994 (published on Jan. 21, 1994)

Citation 2: Japanese Unexamined Patent Publication Tokukaihei 10-274892/1998 (published on Oct. 13, 1998)

Citation 3: Japanese Unexamined Patent Publication Tokukai 2004-69860 (published on Mar. 4, 2004)

Citation 4: Japanese Unexamined Patent Publication Tokukaihei 08-160711/1996 (published on Jun. 21, 1996)

Citation 5: Japanese Unexamined Patent Publication Tokukai 2005-316395 (published on Nov. 10, 2005)

SUMMARY OF THE INVENTION

The present invention is made in view of the foregoing conventional problems, and its object is to provide (1) a pretransfer charging device and a pretransfer charging method, each of which allows (i) reduction of generation of discharge products such as ozone and nitroxide, (ii) excellent uniform charging, (iii) continuous stable charging for a long period of time, and (iv) restraint of distortion of a toner image; and (2) an image forming apparatus including the pretransfer charging device.

To achieve the object, a pretransfer charging device, according to the present invention, for charging a toner image formed on an image carrier of an image forming apparatus, prior to transfer of the toner image to a transfer target object includes: a charging electrode, provided face to face with the image carrier; and a first voltage application means for applying, to the charging electrode, a voltage that is not less than an ion production threshold voltage but is less than a corona discharge threshold voltage.

To achieve the object, a pretransfer charging method, according to the present invention, for charging a toner image formed on an image carrier of an image forming apparatus, prior to transfer of the toner image to a transfer target object includes the step of applying, to a charging electrode provided face to face with the image carrier, a voltage that is not less than an ion production threshold voltage but is less than a corona discharge threshold voltage.

The pretransfer charging device and the pretransfer charging method each according to the present invention makes it possible that the toner image formed on the image carrier (e.g., a photoconductor, or an intermediating retransfer member such as an intermediating transfer belt or an intermediating transfer roller) is charged before the toner image is transferred to the transfer target object such as the intermediating retransfer member or recording paper.

According to the above structure and method, the voltage equal to or larger than the ion production threshold voltage is applied to the charging electrode, with the result that ions are produced. The ions thus produced charge the toner image formed on the image carrier. Further, the voltage applied to the charging electrode is less than the corona discharge threshold voltage, so that no corona discharge occurs. Therefore, the toner image can be charged while substantially no ozone and $NO_x$ are produced. Because no corona discharge occurs as such, a discharge product is never attached to the electrode, and the tip of the electrode is never worn out and deteriorated due to discharge energy unlike the conventional corona discharge type charging device. This makes it possible to carry out stable charging over time. Further, no corona wind is generated because no corona discharge occurs. This makes it possible to restrain distortion of the toner image caused by the corona wind. Further, a formed electric field is weaker as compared with that in the conventional discharge type charging device, so that the quantity of ions has a wide distribution to some extent in the vicinity of the toner image, which is a charging subject. This makes it possible to improve charge uniformity as compared with the conventional corona discharge type charging device.

To achieve the object, a pretransfer charging device, according to the present invention, for charging a toner image formed on an image carrier of an image forming apparatus, prior to transfer of the toner image to a transfer target object includes: a charging electrode, provided face to face with the image carrier; and first voltage application means for applying, to the charging electrode, a voltage not less than an ion production threshold voltage, an interval between the image carrier and the charging electrode being longer than a corona discharge threshold distance.

Further, to achieve the object, a pretransfer charging method, according to the present invention, for charging a toner image formed on an image carrier of an image forming apparatus, prior to transfer of the toner image to a transfer target object includes the step of applying a voltage not less than an ion production threshold voltage, to a charging electrode provided face to face with the image carrier such that an interval between the charging electrode and the image carrier is longer than a corona discharge threshold distance.

The pretransfer charging device and the pretransfer charging method each according to the present invention makes it possible that the toner image formed on the image carrier (e.g., a photoconductor, or an intermediating retransfer member such as an intermediating transfer belt or an intermediating transfer roller) is charged before the toner image is transferred to the transfer target object such as the intermediating retransfer member or recording paper.

According to the above structure and method, the voltage equal to or larger than the ion production threshold voltage is applied to the charging electrode, with the result that ions are produced. The ions thus produced charge the toner image formed on the image carrier. Further, the interval between the charging electrode and the image carrier is longer than the corona discharge threshold distance, so that no corona discharge occurs. Therefore, the toner image can be charged while substantially no ozone and $NO_x$ are generated. Because no corona discharge occurs as such, a discharge product is never attached to the electrode, and the tip of the electrode is never worn out and deteriorated due to discharge energy unlike the conventional corona discharge type charging device. This makes it possible to carry out stable charging over time. Further, no corona wind is generated because no corona discharge occurs. This makes it possible to restrain distortion of the toner image caused by the corona wind. Further, a formed electric field is weaker as compared with that in the conventional discharge type charging device, so that the quantity of ions has a wide distribution to some extent in the vicinity of the toner image, which is a charging subject. This makes it possible to improve charge uniformity as compared with the conventional corona discharge type charging device.

Further, to achieve the object, a pretransfer charging device, according to the present invention, for charging a toner image formed on an image carrier of an image forming apparatus, prior to transfer of the toner image to a transfer target object includes: a charging electrode, provided face to face with the image carrier; and first voltage application means for applying, to the charging electrode, a voltage that is not less than an ion production threshold voltage but is less than an ozone production surge threshold voltage, which causes start of rapid increase of a quantity of produced ozone.

Further, to achieve the object, a pretransfer charging device, according to the present invention, for charging a toner image formed on an image carrier of an image forming apparatus, prior to transfer of the toner image to a transfer target object includes: a charging electrode, provided face to face with the image carrier, the transfer target object being charged by ions generated by applying, to the charging electrode, a voltage that is not less than an ion production threshold voltage but is less than an ozone production surge threshold voltage, which causes start of rapid increase of a quantity of produced ozone.

Further, to achieve the object, a pretransfer charging method, according to the present invention, for charging a toner image formed on an image carrier of an image forming apparatus, prior to transfer of the toner image to a transfer target object includes the step of applying, to a charging electrode provided face to face with the image carrier, a voltage that is not less than an ion production threshold voltage but is less than an ozone production surge threshold voltage, which causes start of rapid increase of a quantity of produced ozone.

To achieve the object, a pretransfer charging method, according to the present invention, for charging a toner image formed on an image carrier of an image forming apparatus, prior to transfer of the toner image to a transfer target object, includes the step of charging the transfer target object by using ions generated by applying, to a charging electrode provided face to face with the image carrier, a voltage that is not less than an ion production threshold voltage but is less than an ozone surge threshold voltage, which causes rapid increase of a quantity of produced ozone.

According to the above structure and method, the voltage equal to or larger than the ion production threshold voltage is applied to the charging electrode, with the result that ions are produced. The ions thus produced charge the toner image formed on the image carrier. Further, the voltage applied to the charging electrode is less than the ozone surge threshold voltage. Therefore, the toner image can be charged while substantially no ozone and $NO_x$ are produced. Ozone production is restrained as such, so that a discharge product is never attached to the electrode, and the tip of the electrode is never worn out and deteriorated due to discharge energy unlike the conventional corona discharge type charging device. This makes it possible to carry out stable charging over time. Further, corona wind is restrained because ozone production is reduced. This makes it possible to restrain distortion of the toner image caused by the corona wind. Further, a formed electric field is weaker as compared with that in the conventional discharge type charging device, so that the quantity of ions has a wide distribution to some extent in the vicinity of the toner image, which is a charging subject. This makes it possible to improve charge uniformity as compared with the conventional corona discharge type charging device.

Further, to achieve the object, a pretransfer charging device, according to the present invention, for charging a toner image formed on an image carrier of an image forming apparatus, prior to transfer of the toner image to a transfer target object includes: a charging electrode, provided face to face with the image carrier; and first voltage application means for applying, to the charging electrode, a voltage not less than an ion production threshold voltage, an interval between the image carrier and the charging electrode being longer than an ozone production surge threshold distance, which causes start of rapid increase of a quantity of produced ozone.

Further, to achieve the object, a pretransfer charging method, according to the present invention, for charging a toner image formed on an image carrier of an image forming apparatus, prior to transfer of the toner image to a transfer target object includes the step of applying a voltage not less than an ion production threshold voltage, to a charging electrode provided face to face with the image carrier such that an interval between the charging electrode and the image carrier is longer than an ozone production surge threshold distance, which causes start of rapid increase of a quantity of produced ozone.

According to the above structure and method, the voltage equal to or larger than the ion production threshold voltage is applied to the charging electrode, with the result that ions are produced. The ions thus produced charge the toner image formed on the image carrier. Further, the interval between the charging electrode and the image carrier is longer than the ozone production surge distance. Therefore, the toner image can be charged while substantially no ozone and $NO_x$ are produced. Ozone production is restrained as such, so that a discharge product is never attached to the electrode, and the tip of the electrode is never worn out and deteriorated due to discharge energy unlike the conventional corona discharge type charging device. This makes it possible to carry out stable charging over time. Further, corona wind is restrained because ozone production is reduced. This makes it possible to restrain distortion of the toner image caused by the corona wind. Further, a formed electric field is weaker as compared with that in the conventional discharge type charging device, so that the quantity of ions has a wide distribution to some extent in the vicinity of the toner image, which is a charging subject. This makes it possible to improve charge uniformity as compared with the conventional corona discharge type charging device.

Further, to achieve the object, a pretransfer charging device, according to the present invention, for charging a toner image formed on an image carrier of an image forming apparatus, prior to transfer of the toner image to a transfer target object includes: a charging electrode, provided face to face with the image carrier; and first voltage application means for applying, to the charging electrode, a voltage that is not less than an ion production threshold voltage but is less than a current surge threshold voltage, which causes start of rapid increase of current flowing in the charging electrode.

To achieve the object, a pretransfer charging method, according to the present invention, for charging a toner image formed on an image carrier of an image forming apparatus, prior to transfer of the toner image to a transfer target object includes the step of applying, to a charging electrode provided face to face with the image carrier, a voltage that is not less than an ion production threshold voltage but is less than a current surge threshold voltage, which causes start of rapid increase of current flowing in the charging electrode (i.e., current to be supplied from the first voltage application means to the charging electrode; the same holds true for descriptions below).

According to the above structure and method, the voltage equal to or larger than the ion production threshold voltage is applied to the charging electrode, with the result that ions are produced. The ions thus produced charge the toner image formed on the image carrier. Further, the voltage applied to the charging electrode is less than the current surge threshold voltage, so that a large current never flows in the charging electrode. Therefore, the toner image can be charged while substantially no ozone and $NO_x$ are produced. Ozone production is restrained as such, so that a discharge product is never attached to the electrode, and the tip of the electrode is never worn out and deteriorated due to discharge energy unlike the conventional corona discharge type charging device. This makes it possible to carry out stable charging over time. Further, corona wind is restrained because ozone production is reduced. This makes it possible to restrain distortion of the toner image caused by the corona wind. Further, a formed electric field is weaker as compared with that in the conventional discharge type charging device, so that the quantity of ions has a wide distribution to some extent in the vicinity of the toner image, which is a charging subject. This makes it possible to improve charge uniformity as compared with the conventional corona discharge type charging device.

Further, to achieve the object, a pretransfer charging device, according to the present invention, for charging a toner image formed on an image carrier of an image forming apparatus, prior to transfer of the toner image to a transfer target object includes: a charging electrode, provided face to face with the image carrier; and first voltage application means for applying, to the charging electrode, a voltage not less than an ion production threshold voltage, an interval between the image carrier and the charging electrode being longer than a current surge threshold distance, which causes start of rapid increase of current flowing in the charging electrode.

Further, to achieve the object, a pretransfer charging method, according to the present invention, for charging a toner image formed on an image carrier of an image forming apparatus, prior to transfer of the toner image to a transfer target object includes the step of applying a voltage not less than an ion production threshold voltage, to a charging electrode provided face to face with the image carrier such that an interval between the charging electrode and the image carrier is longer than a current surge threshold distance, which causes start of rapid increase of current flowing in the charging electrode.

According to the above structure and method, the voltage equal to or larger than the ion production threshold voltage is applied to the charging electrode, with the result that ions are produced. The ions thus produced charge the toner image formed on the image carrier. Further, the interval between the charging electrode and the image carrier is longer than the ozone production surge distance, so that a large current never flows in the charging electrode. Therefore, the toner image can be charged while substantially no ozone and $NO_x$ are produced. Ozone production is restrained as such, so that a discharge product is never attached to the electrode, and the tip of the electrode is never worn out and deteriorated due to discharge energy unlike the conventional corona discharge type charging device. This makes it possible to carry out stable charging over time. Further, corona wind is restrained because ozone production is reduced. This makes it possible to restrain distortion of the toner image caused by the corona wind. Further, a formed electric field is weaker as compared with that in the conventional discharge type charging device, so that the quantity of ions has a wide distribution to some extent in the vicinity of the toner image, which is a charging subject. This makes it possible to improve charge uniformity as compared with the conventional corona discharge type charging device.

Further, an image forming apparatus according to the present invention for carrying out image forming in accordance with an electrophotographic method includes: (i) any of the aforementioned pretransfer charging devices and (ii) the image carrier.

Due to the aforementioned problems, it is difficult to additionally provide, in the conventional image forming apparatus, a charging device for charging a toner image formed on an image carrier. However, the image forming apparatus of the present invention uses the aforementioned pretransfer charging device, so that it is possible to improve transfer efficiency while restraining generation of discharge products such as ozone and nitroxide.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 6(*b*) is a graph showing results of Experiment 1 in the case of a fixed resistor being inserted.

FIG. 19(*b*) is a graph representing the relationship between the applied voltage and the total current (see FIG. 11(*a*)), as well as the rate γ of change in the rate θ of increase of a total current to increase of the applied voltage.

FIG. 20(*b*) is a graph representing the relationship between the applied voltage and the total current (see FIG. 11(*a*)), as well as the rate γ of change in the rate θ of increase of a total current to increase of the applied voltage.

Each of FIGS. 21(*a*) and 21(*b*) is a graph representing respective conditions of the applied voltage and of a gap between a charging subject and a charging electrode in a charging device according to another embodiment of the present invention, under which conditions the charging subject is charged while the quantity of produced ozone and the total current are never rapidly increased. FIG. 21(*b*) is a case where a fixed resistor is inserted.

DESCRIPTION OF THE EMBODIMENTS

Embodiment 1

Figure 2:
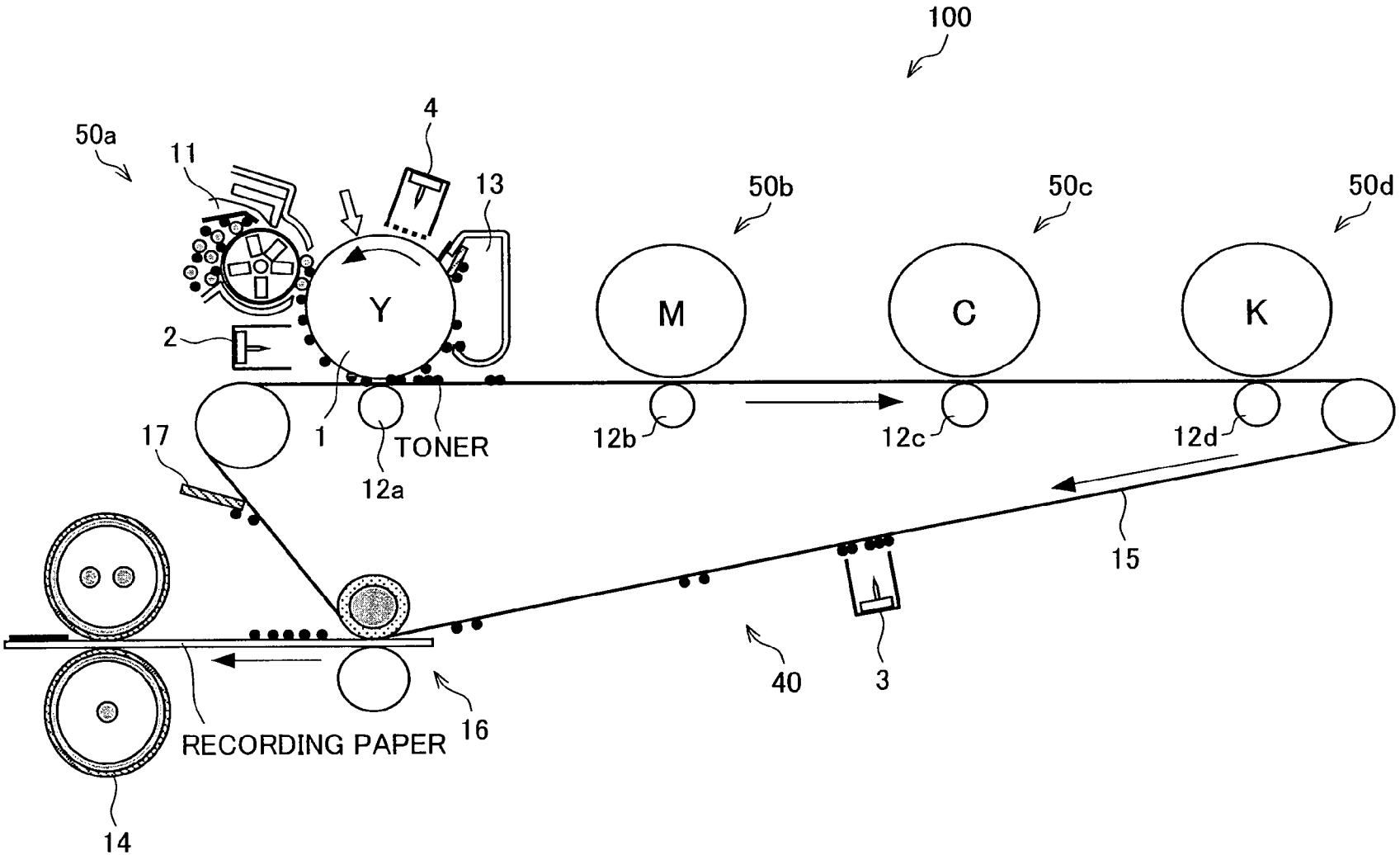
FIG. 2 is a cross-sectional view illustrating the structure of an image forming apparatus incorporating pretransfer charging devices in accordance with the embodiment of the present invention.

One embodiment of the present invention will be described below. FIG. 2 is a cross sectional view schematically illustrating a structure of an image forming apparatus 100 including pretransfer charging devices 2 and 3 of the present embodiment. The image forming apparatus 100 is a tandem type and intermediating transfer type printer, and is capable of printing a full color image.

As shown in FIG. 2, the image forming apparatus 100 includes visible image forming units 50*a* through 50*d* respectively corresponding to four colors (C, M, Y, and K), a transfer unit 40, and a fusing device 14.

The transfer unit 40 includes an intermediating transfer belt 15 (image carrier), four primary transfer devices 12*a* through 12*d*, a secondary pretransfer charging device 3, a secondary transfer device 16, and a transfer use cleaning device 17.

The intermediating transfer belt 15 receives visualized toner images transferred from the visible image forming units 50*a* through 50*d*, respectively. The toner images thus transferred thereonto are put on top of one another, and then are transferred from the intermediating transfer belt 15 onto recording paper. The intermediating transfer belt 15 is a belt having no end, and is set around (i) a pair of rollers and (ii) an idling roller. The intermediating transfer belt 15 is so controlled as to be driven at a predetermined peripheral speed (124 mm/s in the present embodiment), thus carrying out transportation of the toner images.

The primary transfer devices 12*a* and 12*d* are so provided as to correspond to the visible image forming units 50*a* through 50*d*, respectively. Specifically, the primary transfer device 12*a* through 12*d* are respectively provided face to face with their corresponding visible image forming units 50*a* through 50*d*, with the intermediating transfer belt 15 sandwiched therebetween. The secondary pretransfer charging device 3 recharges the toner images having been transferred onto the intermediating transfer belt 15 and put on top of one another. In the present embodiment, the secondary pretransfer charging device 3 charges the toner images by emitting ions. Details of the secondary pretransfer charging device 3 will be described later.

The secondary transfer device 16 is provided in contact with the intermediating belt 15 so as to transfer, onto the recording paper, the toner images having been transferred onto the intermediating transfer belt 15. The transfer use cleaning device 17 cleans up the surface of the intermediating transfer belt 15 after the transfer of the toner images from the secondary transfer devices to the recording paper.

Note that the primary transfer devices 12*a* through 12*d*, the secondary pretransfer charging device 3, the secondary transfer device 16, and the transfer use cleaning device 17 are disposed in the vicinity of the intermediating transfer belt 15 of the transfer unit 40 in this order from the upstream of the transporting direction of the intermediating transfer belt 15.

The fusing device 14 is provided in the downstream side, with respect to the secondary transfer device 16, in the direction in which the recording paper is transported. The fusing device 14 fixes, to the recording paper, the toner images having been transferred thereonto by the secondary transfer device 16.

Further, the four visible image forming units 50*a* through 50*d* are provided in contact with the intermediating transfer belt 15, and are arranged in the transporting direction of the intermediating transfer belt 15. The four visible image forming units 50*a* through 50*d* are identical to one another, except that they use toners different from one another in colors. Specifically, the visible image forming units 50*a* through 50*d* use a yellow (Y) toner, a magenta (M) toner, a cyan (C) toner, and a black (K) toner, respectively. The following only explains the visible image forming unit 50*a*, and no explanation will be made for the other visible image forming units 50*b* through 50*d*.

The visible image forming unit 50*a* includes a photoconductor drum (image carrier) 1, a latent image charging device 4, a laser writing unit (not shown), a developing device 11, the primary pretransfer charging device 2, a cleaning device 13, and the like. The latent image charging device 4, the laser writing unit, the develop device 11, the primary pretransfer charging device 2, the cleaning device 13 are so provided as to surround the photoconductor drum 1.

The latent image charging device 4 charges a surface of the photoconductor drum 1 with a predetermined potential. In the present embodiment, the latent image charging device 4 generates and uses ions so as to charge the photoconductor drum 1. Details of the latent image charging device 4 will be described later.

The laser writing unit irradiates (exposes) laser light to the photoconductor drum 1 in accordance with image data received from an external device, so as to write an electrostatic latent image on the photoconductor drum 1 with a beam scanning the photoconductor drum 1 that is uniformly charged.

The developing device 11 supplies toner to the electrostatic latent image thus formed on the photoconductor drum 1, so as to visualize the electrostatic latent image. Accordingly, a toner image is formed. The primary pretransfer charging device 2 recharges the toner image thus formed on the surface of the photoconductor drum 1, before transferring the toner image to the intermediating transfer belt 15. In the present embodiment, the primary pretransfer charging device 2 emits ions so as to charge the toner image. Details thereof will be described later.

After the transfer of the toner image to the intermediating transfer belt 15, the cleaning device 13 removes and collects remaining toner from the photoconductor drum 1. This makes it possible to record a new electrostatic latent image and a new toner image on the photoconductor drum 1.

Note that the latent image charging device 4, the laser writing unit, the developing device 11, the primary pretransfer charging device 2, the primary transfer device 12*a*, and the cleaning device 13 are disposed so as to surround the photoconductor drum 1 of the visible image forming unit 50*a* in this order from the downstream of the rotation direction of the photoconductor drum 1.

Explained next is an image forming operation of the image forming apparatus 100.

Firstly, the image forming apparatus 100 acquires image data from an external device. Then, a driving unit (not shown) of the image forming apparatus 100 causes the photoconductor drum 1 to rotate at a predetermined speed (124 mm/s, here) in the direction indicated by an arrow shown in FIG. 2, and the latent image charging device 4 charges the photoconductor drum 1 with the predetermined potential.

Next, the laser writing unit exposes the surface of the photoconductor drum 1 in accordance with the acquired image data so as to write an electrostatic latent image on the surface of the photoconductor drum 1 in accordance with the image data. Then, the developing device 11 supplies toner to the electrostatic latent image thus formed on the surface of the photoconductor drum 1. The toner is adhered to the electrostatic latent image, with the result that a toner image is formed.

By applying, to the surface of the photoconductor drum 1, a bias voltage whose polarity is reverse to that of the toner image, the primary transfer device 12*a* transfers the toner image to the intermediating belt 15.

The visible image forming units 50*a* through 50*d* sequentially carry out such an operation, with the result that toner images respectively having the colors Y, M, C, and K are sequentially put on top of one another on the intermediating transferring belt 15.

The toner images thus put on top of one another are transported by the intermediating transfer belt 15 to the secondary pretransfer charging device 3. The secondary pretransfer charging device 3 recharges the toner images thus transported. Then, the intermediating transfer belt 15 carrying the toner images thus recharged is pressed against recording paper supplied from a paper feeding unit (not shown), with the result that the toner images are transferred onto the recording paper.

Thereafter, the fusing device 14 fixes the toner images to the recording paper, and the recording paper onto which the images have been recorded in this way is ejected to a sheet ejection unit (not shown). Note that toner remaining on the photoconductor drum 1 is removed and collected by the cleaning device 13, and toner remaining on the intermediating transfer belt 15 is removed and collected by the transfer use cleaning device 17.

With the above operations, printing can be carried out suitably with respect to the recording paper.

The following fully explains respective structures of the aforementioned charging devices. The primary pretransfer charging device 2, the secondary pretransfer charging device 3, and the latent image charging device 4 are identical to one another, except that they are provided in different locations. Therefore, the following only explains the details of the primary pretransfer charging device 2, and no explanation of the secondary pretransfer charging device 3, and the latent image charging device 4 will be made.

Figure 3:
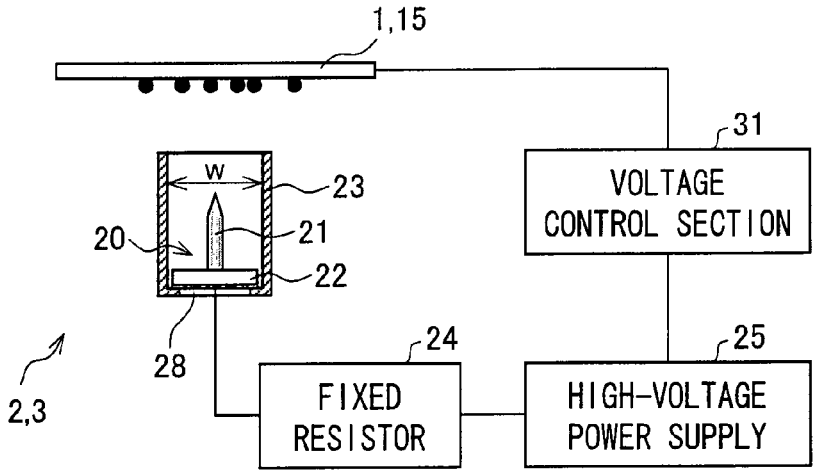
FIG. 3 is a side view of the pretransfer charging device in accordance with the embodiment of the present invention.
Figure 4:
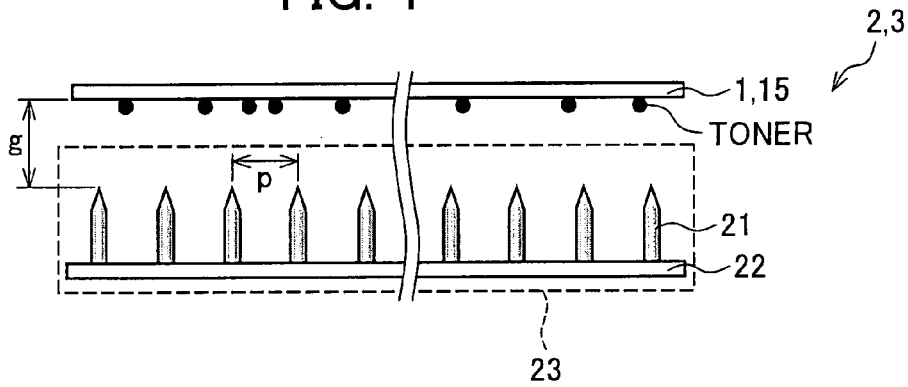
FIG. 4 is a front view of the pretransfer charging device in accordance with the embodiment of the present invention.

FIG. 3 is a lateral side view illustrating the primary pretransfer charging device 2. FIG. 4 is a front view illustrating the primary pretransfer charging device 2 (seen in the longitudinal direction).

As described in FIG. 3, the primary pretransfer charging device 2 includes a negative ion production element 20, a shield (ion spread prevention member) 23, a fixed resistor (electric resistor) 24, a high-voltage power supply (voltage application means) 25, and a voltage control section (voltage control means) 31.

The negative ion production element 20 is arranged such that a plurality of (here, 32) needle-shaped ion generation needles (charging electrodes) 21 are provided, with a predetermined pitch p therebetween, on a base frame 22 made of a metal (here, made of stainless steel). Each of the ion generation needles 21 is a needle that is made of tungsten (purity of 99.999%), that has a diameter of 1 mm, and that has a tip whose curvature radius is 15 μm. The tip of the ion generation needle 21 is directed toward the photoconductor drum 1. There is a pitch p of 10 mm between the ion generation needles 21.

The negative ion production element 20 is disposed such that the ion generation needle 21 is adjacent to the photoconductor drum 1 having a diameter of 30 mm. A gap g between the ion generation needle 21 and the photoconductor drum 1 is 10 mm.

The high-voltage power supply 25 has a negative terminal connected to the base frame 22 via the fixed resistor 24 having a resistance of 200 MΩ. This allows a predetermined direct-current voltage to be applied to the ion generation needle 21 provided on the base frame 22. Such application of the predetermined direct-current voltage from the high-voltage power supply 25 to the negative ion production element 20 causes generation of negative ions, with the result that the toner image formed on the photoconductor drum 1 is so charged as to have a predetermined charge amount (here, approximately −20 μC/g). Note that: upon the image forming, the high-voltage power supply 25 applies an initial applied voltage $Va_0$ of −6.5 kV to the base frame 22.

Further, the high-voltage power supply 25 is connected to the voltage control section 31. The voltage control section 31 controls a voltage Va (hereinafter, also referred to as "applied voltage Va") to be applied from the high-voltage power supply 25. Specifically, while gradually changing the applied voltage Va to be applied from the high-voltage power supply 25, the voltage control section 31 measures a value of a current flowing on the photoconductor drum 1, so as to find an applied voltage Va allowing the value of current to be a target value. Moreover, the voltage control section 31 carries out feedback control such that the applied voltage Va becomes the found voltage.

The value of the current flowing on the surface of the photoconductor drum 1 is correlated with the charge amount of the toner image. Therefore, by keeping at a constant target value the current flowing on the surface of the photoconductor drum 1, the charge amount of the toner image becomes stable.

By carrying out such feedback control, in accordance with the value of the current flowing on the photoconductor drum 1, over a value of the applied voltage Va to be applied from the high-voltage power supply 25, an optimum quantity of negative ions can be always supplied to the toner image even in cases where a quantity of generated negative ions and a proportion of generated ions that reach the toner image are fluctuated due to (i) adhesion of a foreign substance to the tip of the ion generation needle 21, (ii) change of environmental conditions, (iii) a flow of wind blowing in the image forming apparatus 100.

Further, the shield 23 is provided so as to surround the negative ion production element 20. The shield 23 has an aperture portion (having a width w of 26 mm in the present embodiment), which is formed on the photoconductor drum 1 side of the shield 23. Thus, the shield 23 has a cross sectional surface that looks like a square with an open side, and has an air inlet 28 on its surface opposite to the aperture portion. The shield 23 is a made of either (i) an insulative material such as a resin or (ii) a high resistance material (material having such a resistance that no corona discharge is caused in the charging electrodes. In other words, the shield 23 is a made of either (i) an insulative material such as a resin or (ii) a high resistance material (material having such a resistance that a quantity of produced ozone is not drastically increased due to electric charge movement caused by the charging electrodes 21.) Specifically, the shield 23 can be made of, e.g., insulating ABS resin as described in Experiments below.

The shield 23 thus provided restrains spread of the negative ions generated by the negative ion production element 20, and leads the negative ions in the direction toward the photoconductor drum 1, thereby improving ion utilization efficiency. As a result, even in cases where, e.g., the gap g is set at 25 mm or more, it is possible to secure a quantity (density) of negative ions not less than 50% of that of negative ions obtained in cases where the gap g is set at 5 mm. Further, the shield 23 makes it possible that the members provided in the vicinity of the primary pretransfer charging device 2 are restrained from being charged unnecessarily.

Further, as described above, the shield 23 is electrically insulative or has a high resistance. Therefore, even in cases where there is a short interval between the negative ion production element 20 and the shield 23, it is possible to prevent corona discharge from occurring with respect to the shield 23. In other words, it is possible to prevent the quantity of produced ozone from drastically increasing due to movement of electric charges to the shield 23. The shield 23 is electrically floating; however, in cases where ion production efficiency is decreased due to accumulation of electric charges in the shield 23, the shield 23 may be connected to an earth such that the accumulated electric charges are got out.

Note that: in the primary pretransfer charging device 2, a grid electrode (control electrode) may be provided between the ion generation needles 21 and the photoconductor drum 1. By applying a voltage from a high-voltage power supply (second voltage application means) to the grid electrode thus provided, the grid electrode collects excess ions. This uniformizes a quantity of ions heading for the charging subject, with the result that charge non-uniformity occurring in the longitudinal direction due to the pitch between the ion generation needles 21 can be reduced and the surface potential of the charging subject can be therefore more appropriately controlled.

Figure 1:
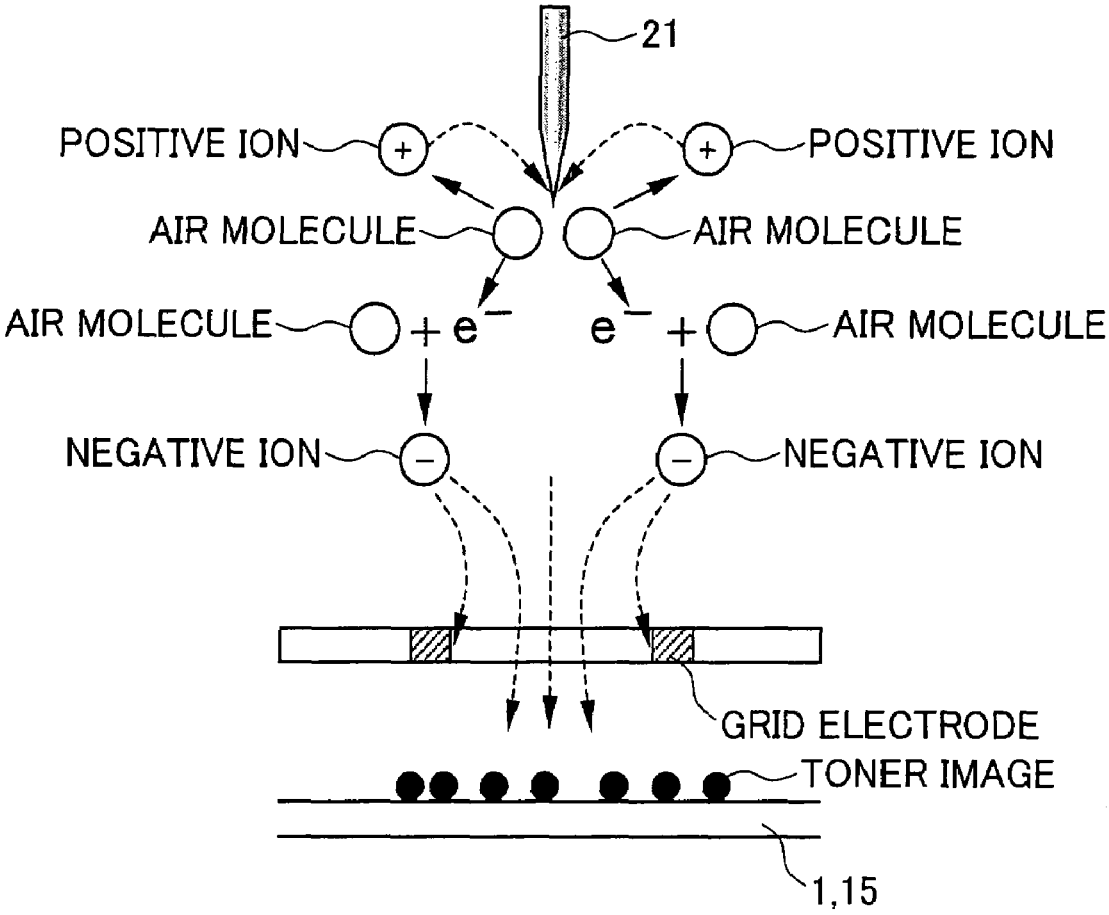
FIG. 1 is an explanatory diagram of the electric charging mechanism of a pretransfer charging device in accordance with an embodiment of the present invention.

The following explains mechanism of the charging carried out by the pretransfer charging devices 2 and 3 and the latent image charging device 4 with the use of the negative ions. FIG. 1 is a diagram illustrating the mechanism of the discharging carried out by the pretransfer charging devices 2 and 3 and the latent image charging device 4.

The curvature radius of the tip of each of the ion generation needles 21 is very small, so that the ion generation needle 21 forms a very strong electric field in the vicinity of the tip of the ion generation needle 21 when a high voltage is applied. However, the gap g between the ion generation needle 21 and the charging subject (charging target), i.e., the image carrier such as the photoconductor drum 1 or the intermediating transfer belt 15 is larger than that in the conventional corona discharge type charging device, so that electric field intensity between the ion generation needle 21 and the image carrier is so small that no electrons are emitted toward the image carrier. However, the strong electric field formed in the vicinity of the ion generation needle 21 works to ionize molecules in the air (oxide molecules, nitride molecules, carbon dioxide molecules, and the like) to form positive ions and electrons. The electrons thus formed are combined with molecules in the air (electron attachment), with the result that negative ions are generated. Some of the positive ions supply electric charges to the ion generation needle 21 and become molecules. The other of the positive ions goes to the ground.

The negative ions thus generated head for the image carrier, along an electric flux line formed between the tip of the ion generation needle 21 and the image carrier. However, the electric field formed therebetween is weaker than that in the conventional corona discharge type charging device, so that not all the generated ions head in the direction toward the photoconductor drum 1 and there are some ions spreading in a direction different from the direction toward the photoconductor drum 1. The photoconductor drum 1 is charged by negative ions having reached the surface of the photoconductor drum 1, with the result that the photoconductor drum 1 has a predetermined potential.

In cases where the grid electrode is provided, there is also formed an electric flux line between the tip of the ion generation needle 21 and the grid electrode, so that the generated negative ions head for the grid electrode. The grid electrode catches excess negative ions and is therefore fed with electric charges (electrons), so that no extra electric charges reach a portion, whose surface potential is increased (charged) due to the negative ions, of the image carrier. The surface potential of the image carrier therefore is controlled at a substantially constant value.

Since ion generation involves a far smaller amount of energy than conventional corona discharge, much fewer nitrogen molecules and oxygen molecules are ionized in ion generation than in conventional corona discharge. Generation of $NO_x$ and ozone is greatly reduced. Further, substantially no corona wind is generated, so that the toner image is never distorted.

Now, results of experiments will be described which were conducted to verify that negative ion emission, instead of corona discharge, is capable of charging the photoconductor drum 1 negatively.

[Experiment 1]

Figure 5:
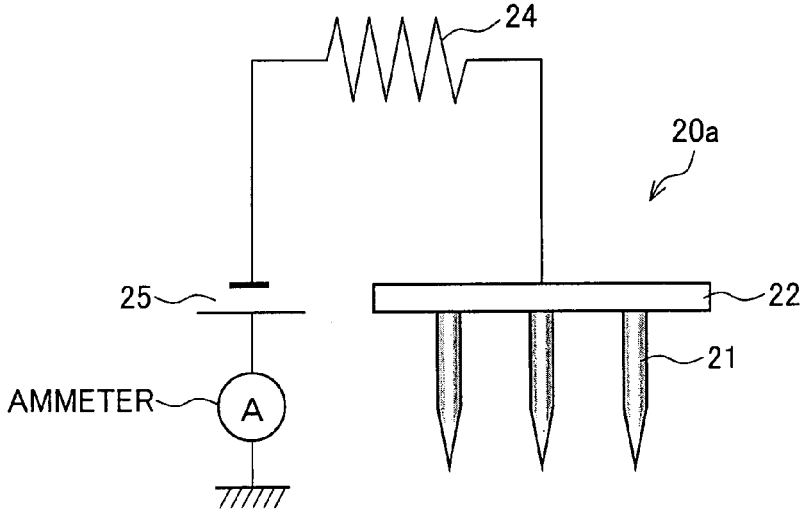
FIG. 5 is an explanatory diagram of the structure of a negative ion production element used in Experiment 1.

First, a negative ion production element 20*a* shown in FIG. 5 was prepared.

The negative ion production element 20*a* had multiple (here, 3) needle-shaped ion generation needles 21 fixed on a metal (here, stainless steel) base frame 22. Each ion generation needle 21 was made of tungsten (purity of 99.999%), had a diameter of 1 mm, and had a tip curvature radius of 15 μm. Adjacent ion generation needles 21 were separated by a pitch of 10 mm.

The negative ion production element 20*a* was placed in a free space 1 m in radius in which there was nothing but an air inlet (detailed later). The quantity of generated negative ions, the quantity of produced ozone, and electric current were measured upon voltage application in two cases: (1) the negative ion production element 20*a* was connected to the negative terminal of the high-voltage power supply 25; and (2) the negative ion production element 20*a* was connected to the negative terminal of the high-voltage power supply 25 via the fixed resistor 24 (resistance=200 MΩ). In other words, in one case, there was the fixed resistor 24 (resistance=200 MΩ) between the negative ion production element 20*a* and the high-voltage power supply 25. In the other, there was none. As additional information, the high-voltage power supply 25 was MODEL 610C available from Trek Inc. Also, a negative ion meter AIC-2000 available from Sato Shoji Corporation and an ozone monitor EG2002F available from Ebara Jitsugyo Co., Ltd. were used. The quantity of generated negative ions was measured with the air inlet positioned 150 mm away from the ion generation needles 21. The quantity of ozone was measured with the air inlet positioned 10 mm away from the ion generation needles 21.

Figure 6:
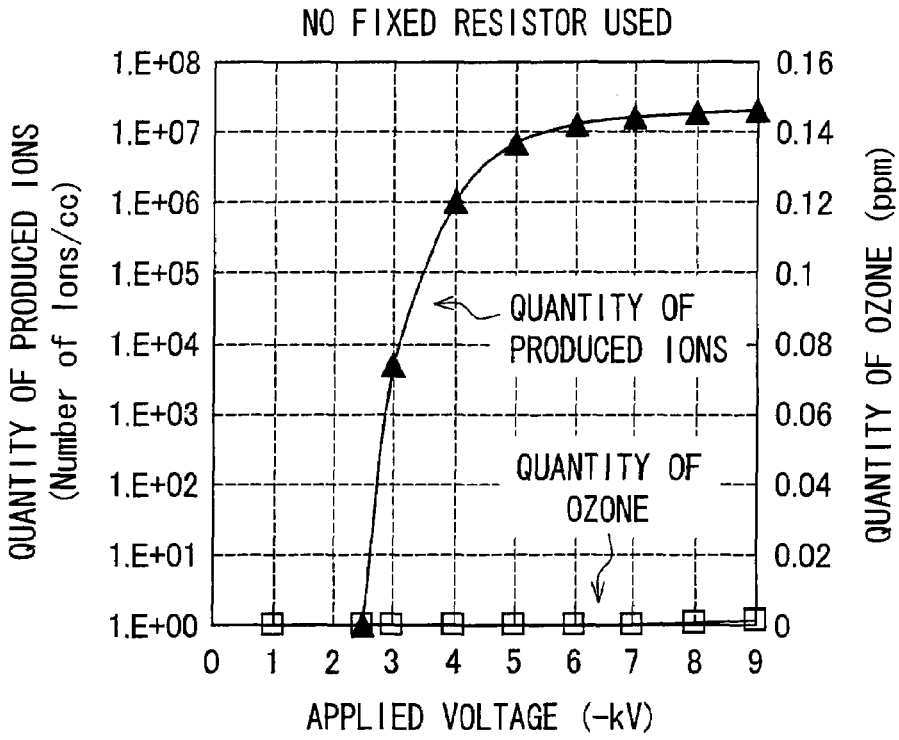
FIG. 6(*a*) is a graph showing results of Experiment 1 in the case of no fixed resistor being inserted.
Figure 6:
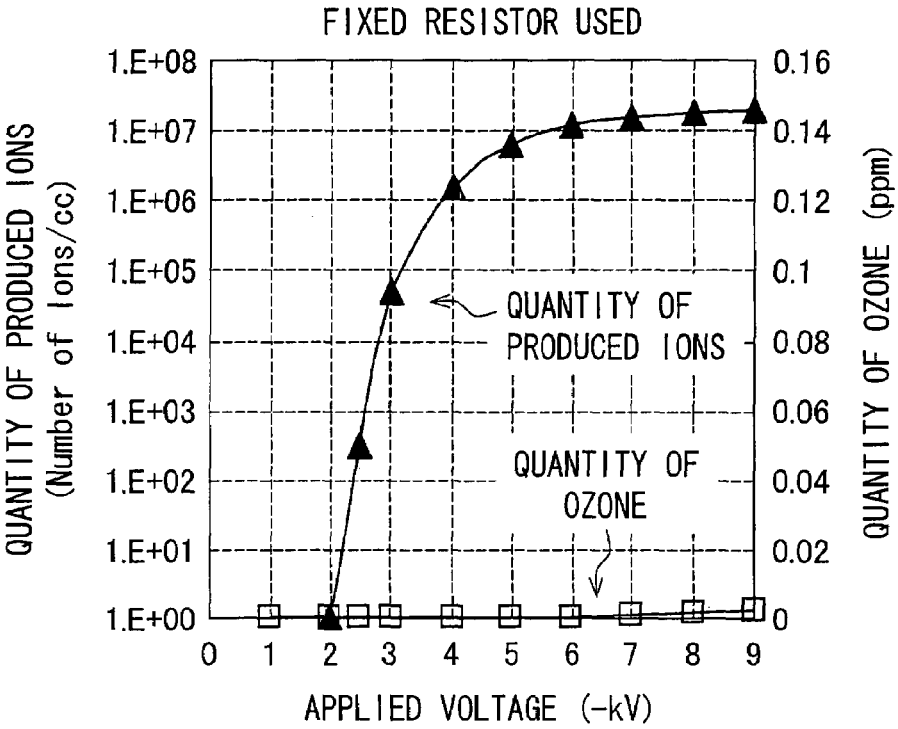

FIG. 6(*a*) is a graph showing experimental results in the case of no fixed resistor 24 being inserted. FIG. 6(*b*) is a graph showing experimental results in the case of the fixed resistor 24 being inserted.

FIG. 6(*a*), showing the case of no fixed resistor 24 being inserted, indicates that negative ion generation started when the applied voltage exceeded −2.5 kV. FIG. 6(*b*), showing the case of the fixed resistor 24 being inserted, indicates that negative ion generation started when the applied voltage exceeded −2 kV. In both cases, the quantity of negative ions (quantity of generated ions) rapidly increased with increase in the applied voltage (increase in the absolute value of the applied voltage), and reached saturation at about $1\times10^7$ ions/cc. Also in both cases, almost no ozone was produced.

These results demonstrate that high voltage application to the needle-shaped negative ion production element 20*a* shown in FIG. 5 with no discharging target in the surroundings generates a large quantity of negative ions with almost no ozone being generated.

The negative ion production threshold voltage was somewhat lower when the fixed resistor 24 was inserted than when it was not, presumably for the following reasons. The ions are generated by difference in potential between air and the ion generation needles 21 with the air acting as a virtual positive electrode. Since the impedance of the air is very unstable, ion generation becomes unstable in a region where the ion generation starts at low applied voltage if no fixed resistor 24 is provided. The insertion of the fixed resistor 24 stabilizes the overall impedance including that of the air, which in turn stabilizes the ion generation.

Figure 7:
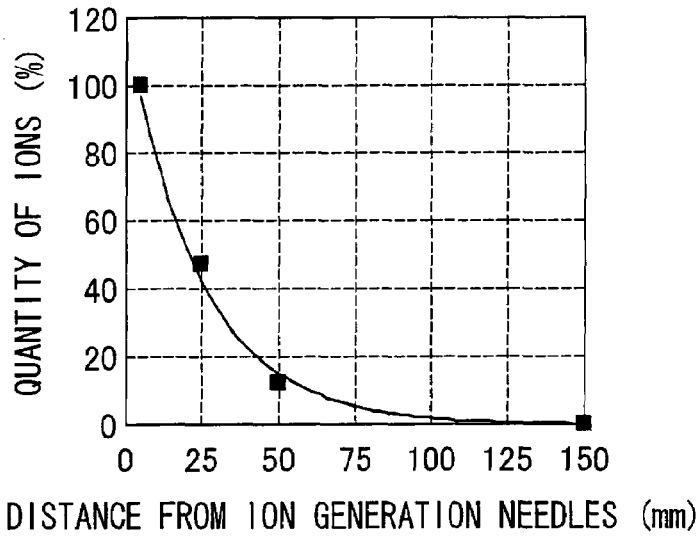
FIG. 7 is a graph showing measurements showing relationship between distance from a charging electrode and the quantity (density) of negative ions in the negative ion production element shown in FIG. 5.

Next, under such conditions that the fixed resistor 24 was inserted and the applied voltage was set to −3 kV, the quantity (density) of negative ions was measured in relation with a distance L from the ion generation needles 21. FIG. 7 is a graphical representation of results. The quantity of negative ions is shown in relative values for L>5 mm, taking the quantity of negative ions when L=5 mm as 100%.

As can be seen from the figure, the density of negative ions decreases with increasing L. Also from FIG. 7, at least 50% the quantity (density) of negative ions when L=5 mm is secured so long as L≦25 mm.

[Experiment 2]

Next, a charging characteristic for the photoconductor drum 1 was measured by experiment using the negative ion production element 20*a*. First, the experimental device will be described in reference to FIG. 8.

The photoconductor drum 1 includes an organic photoconductor (OPC) 30 mm in diameter and 30 μm in film thickness. The photoconductor drum 1 was so supported that it could rotate at a given peripheral speed. The negative ion production element 20*a* was placed with a predetermined gap g away from the photoconductor drum 1. The negative ion production element 20*a* was mounted on a stage (not shown) which could be moved in the direction toward the photoconductor drum 1 so that the gap g could be set at any value from 0 mm to 30 mm. The current flow through the negative ion production element 20*a* (total current) was measured with an ammeter A1.

Between the photoconductor drum 1 and the ion generation needles 21 of the negative ion production element 20*a* was provided a 0.1-mm thick, stainless steel grid electrode 26. The distance between the grid electrode 26 and the photoconductor drum 1 was fixed at 1.5 mm. The grid electrode 26 was connected to the negative terminal of the high-voltage power supply 27, so that a given voltage could be applied thereto. The current flow through the grid electrode 26 (grid current) was measured with an ammeter A2.

Furthermore, a surface potential measuring probe 30 was provided in a position 90° downstream from a portion, facing the negative ion production element 20*a*, of the photoconductor 1 with respect to the rotational direction of the photoconductor drum 1 so as to measure the surface potential of the photoconductor drum 1. The surface potential measuring probe 30 was mounted on a stage (not shown) which allowed the surface potential measuring probe 30 to scan the photoconductor drum 1 in the longitudinal direction of the photoconductor drum 1 so as to draw a surface potential profile not only in the peripheral direction of the photoconductor drum 1, but also in the longitudinal direction. The surface potential meter used was TereK's model 344. The photoconductor drum 1 was rotated at a peripheral speed of 124 mm/s. In addition, the quantity of generated ions, the quantity of produced ozone, etc. were measured similarly to Experiment 1. The current flow through the photoconductor drum 1 was measured with an ammeter A3.

Experimental conditions included the following: gap g=20 mm; the applied voltage to the negative ion production element 20*a* was −7.7 kV; and the applied voltage to the grid electrode 26 was −900 V. Experiment was conducted with and without the grid electrode 26 being inserted.

Figure 9:
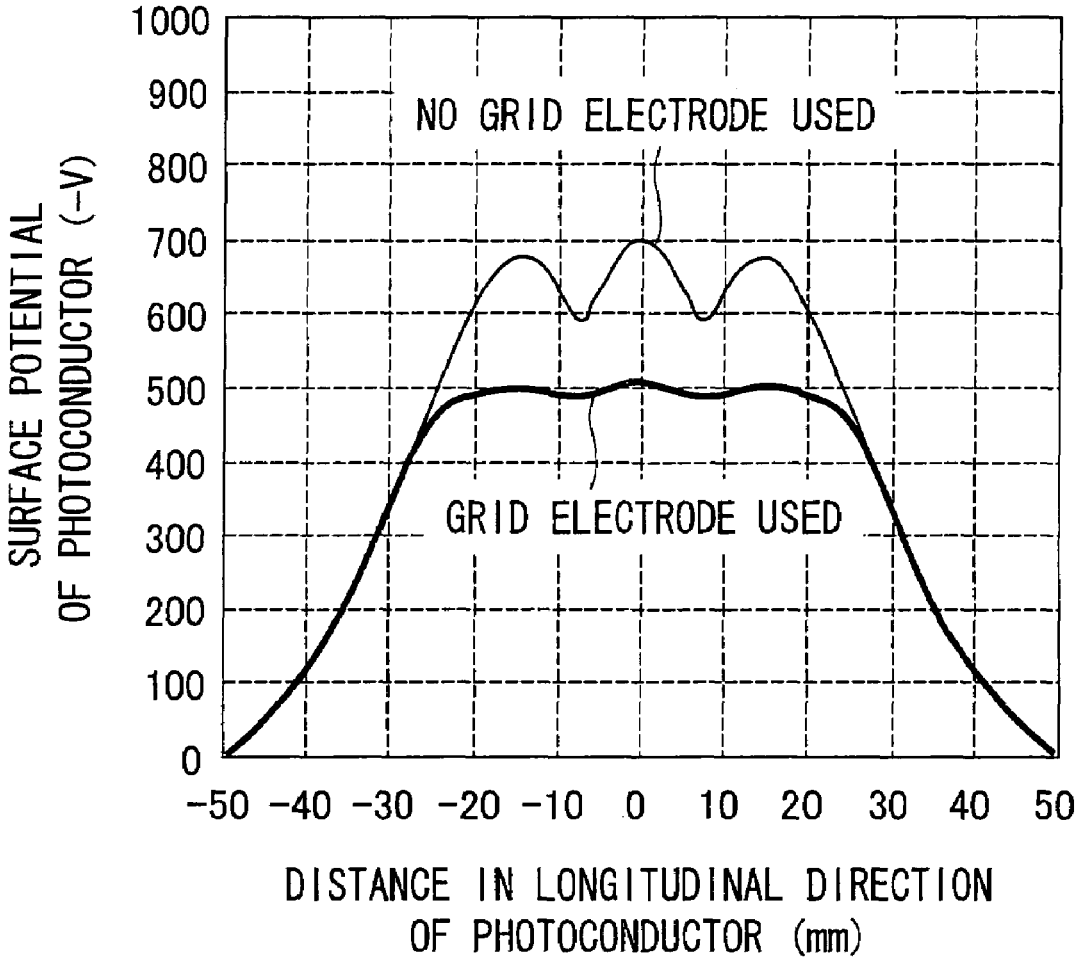
FIG. 9 is a graph representing the surface potential profile of a photoconductor with a grid electrode and that of a photoconductor with no grid electrode, both taken along the length of the photoconductors, for comparison.

FIG. 9 is a graph showing results of the experiment. The graph represents the surface potential profile of the photoconductor drum 1 with the grid electrode 26 and that without the grid electrode 26, both taken along the longitudinal direction of the photoconductor drum 1, for comparison. Table 1 shows measurements of the quantity of generated negative ions and the quantity of produced ozone. In FIG. 9, distances in the longitudinal direction of the photoconductor drum 1 were plotted on the horizontal axis, and the surface potentials of the photoconductor drum 1 were plotted on the vertical axis. The value "0" indicated in the horizontal axis representing the distances in the longitudinal direction of the photoconductor drum 1 corresponds to such a portion of the photoconductor drum 1 that faces the middle one of the three ion generation needles 21 provided in the longitudinal direction of the photoconductor drum 1.

TABLE 1

| | Quantity of generated negative ion (ions/cc) | Quantity of produced ozone (ppm) |
|---|---|---|
| Without grid | 18,000,000 | 0.002 |
| With grid | 18,000,000 | 0.003 |

As shown in FIG. 9, the surface of the photoconductor drum 1 was charged with and without the grid electrode 26. Also, as shown in Table 1, a sufficient quantity of negative ions was produced (18,000,000 ions/cc), and almost no ozone was produced (0.002 ppm to 0.003 ppm). If corona discharge had occurred, ozone would have been produced in a large quantity. The fact that the experiment produced substantially no ozone confirmed that it was not corona discharge, but negative ions that contributed to the charging of the photoconductor drum 1 in the experiment. The negative ions were able to sufficiently charge the photoconductor drum 1.

In addition, as shown in FIG. 9, when there was no grid electrode 26, the surface potential showed fluctuations (three peaks) corresponding to the positions of the three ion generation needles 21. When the grid electrode 26 was there, the potential showed smaller fluctuations. These results confirmed that the provision of the grid electrode 26 restrained the fluctuations of the surface potential and improved the controllability of the surface potential.

[Experiment 3]

Next, a toner image charging characteristic of the negative ion production element 20*a* was measured by experiment. First, the experimental device will be described in reference to FIG. 10.

Figure 10:
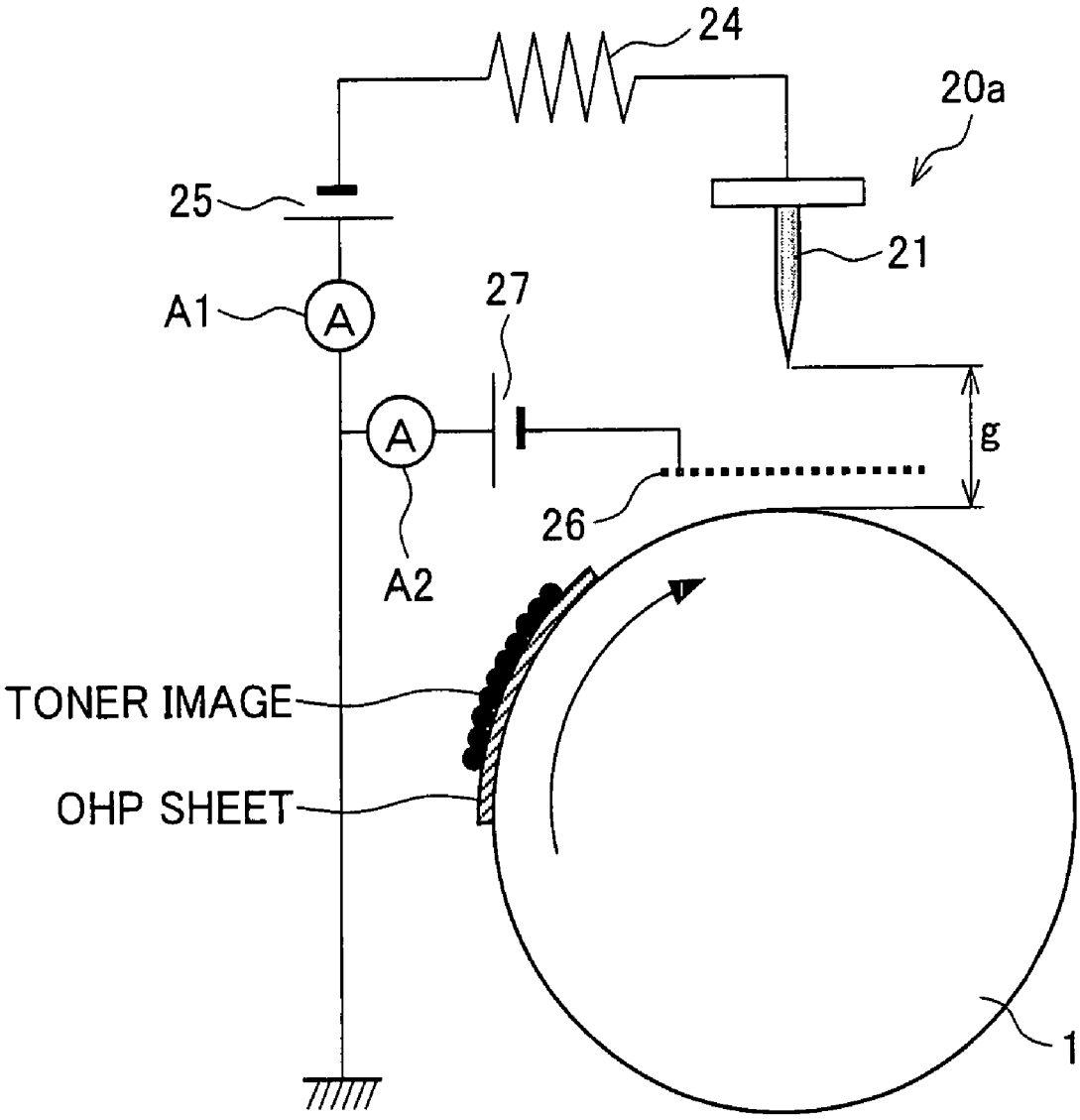
FIG. 10 is an explanatory diagram showing the structure of an experimental device used in Experiment 3.

As illustrated in FIG. 10, the experimental device was identical to that used in Experiment 2. However, the potential measuring probe 30 and the ammeter A3 were not used in Experiment 3.

The experiment was conducted as follows. First, a non-fixed toner image is formed on an OHP sheet, using a digital color multifunction printer (AR-C280 produced by Sharp Kabushiki Kaisha). For the image formation, polyester toner having a grain diameter of 8.5 μmm is used. The non-fixed toner image is a solid image of 0.6 mg/cm$^2$ in adhesion amount. The charge amount of the non-fixed toner image thus formed is measured by using a small charge amount measuring device of suction type (Model 210HS-2A provided by Trek Inc.).

Next, the OHP sheet having the non-fixed toner image was attached onto the surface of the photoconductor drum 1. The photoconductor drum 1 was rotated at a predetermined peripheral speed, while applying a predetermined voltage to the negative ion production element 20*a* and the grid electrode 26, so that the non-fixed toner image was charged as it passed through the area facing the ion generation needle 21. After the charging, the charge amount of the toner image was measured again, and the amounts of charge on the toner image before and after the charging process were compared. Moreover, as in the Experiment 1, the quantities of generated ions and produced ozone were also measured.

Experimental conditions included the following. Gap g=20 mm. The applied voltage to the negative ion production element 20*a* was −7.7 kV. The applied voltage to the grid electrode 26 was −900 V. Experiment was conducted with and without the grid electrode 26 being inserted.

Table 2 is a table showing the results of the experiment. For both cases of using or not using the grid electrode 26, Table 2 shows the measurement of the charge amount of the toner image, the quantity of generated negative ion, and the quantity of produced ozone.

TABLE 2

| | Charge Amount of toner (μC/g) | | | Quantity of generated negative | Quantity of produced |
|---|---|---|---|---|---|
| | Before charging | After charging | Increment | ion (ions/cc) | ozone (ppm) |
| Without grid | −12.8 | −20.5 | 7.7 | 18,000,000 | 0.002 |
| With grid | −12.8 | −18.3 | 5.5 | 18,000,000 | 0.003 |

As shown in Table 2, the charge amount of the toner image increased irrespective of the presence of the grid electrode 26. Also, a sufficient quantity of negative ions was produced (18,000,000 ions/cc), and almost no ozone was produced (0.002 ppm to 0.003 ppm). If corona discharge had occurred, ozone would have been produced in a large quantity. The fact that the experiment produced substantially no ozone (produced little ozone) confirmed that it was not corona discharge, but negative ions that contributed to the charging of the toner image in the experiment. The negative ions were able to sufficiently charge the toner image.

Furthermore, it is apparent that the charge on the toner increased by large amount without the grid electrode, as compared with the case of with the grid electrode.

[Experiment 4]

The following experiment was conducted to study conditions for more stable generation of negative ions. Since it is found from the results of Experiments 2 and 3 that charging by the use of negative ions exhibited similar tendency in both cases of the photoconductor drum 1 and toner image, the photoconductor drum 1 is used as the charging subject in this experiment 4.

In the present experiment, the above experimental device was used to study the relationship amongst an applied voltage Va to the negative ion production element 20*a*, the surface potential $V_0$ of the photoconductive drum 1, total current It, and the quantity of produced ozone. The experimental conditions included the following. Gap g=10 mm. The applied voltage to the grid electrode 26 was −700V. The experiment was conducted with or without the fixed resistor 24 being inserted.

Figure 11:
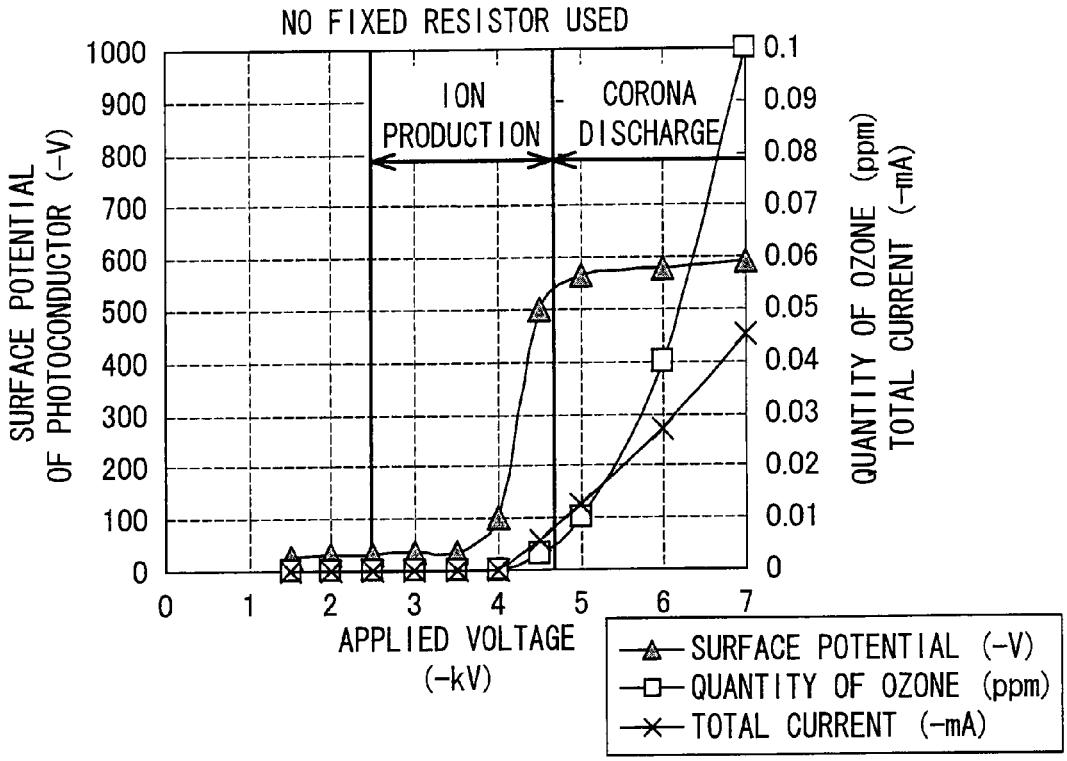
FIGS. 11(*a*) and 11(*b*) are graphs showing results of studies of relationship between an applied voltage and the surface potential of a photoconductor, a total current, and ozone production, in the cases of no fixed resistor being inserted and of a fixed resistor being inserted respectively.
Figure 11:
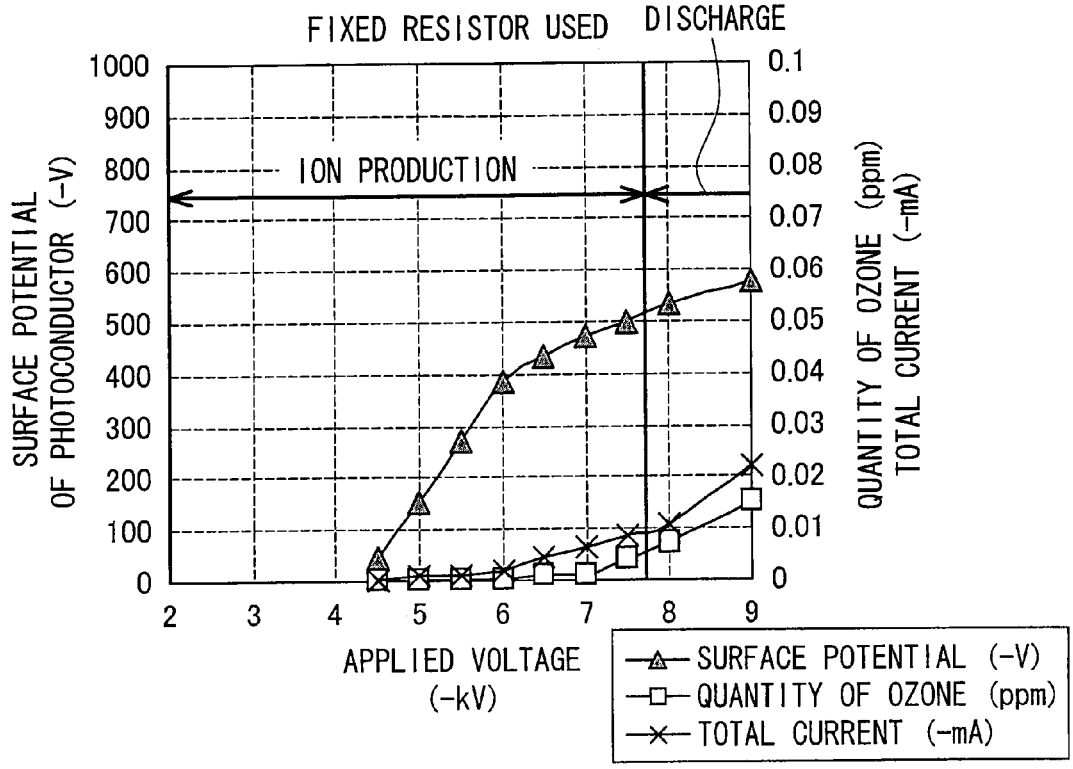

FIG. 11(*a*) is a graph showing the measurement result of the case where the fixed resistor 24 was not inserted, and FIG. 11(*b*) is a graph showing the measurement result of the case where the fixed resistor 24 was inserted.

As shown in FIG. 11(*a*), when the applied voltage Va to the negative ion generating element 20*a* was raised to around −3.75 kV (charge threshold voltage) by gradually raising the value (absolute value) of the applied voltage Va, the surface of the photoconductive drum 1 started to be charged. Further increasing of the applied voltage Va caused increase in the absolute value of the surface potential $V_0$. Almost no ozone was generated until the absolute value of the applied voltage Va reached 5 kV. However, the quantity of produced ozone rapidly increased when the applied voltage became equal to or greater than 5 kV.

The result confirmed the following. That is, when the value (absolute value) of the applied voltage Va was 3.75 kV or greater but was less than 5 kV, the applied voltage was equal to or greater than the ion production threshold voltage (2.5 kV) obtained in cases where the no fixed resistor 24 was provided, so that the charging was done by the negative ions. When the applied voltage Va was 5 kV or greater, ozone was generated. Therefore, when the applied voltage Va was 5 kV or greater, not only the production of ions but also corona discharge occur.

Meanwhile, see FIG. 11(*b*) illustrating the case where the fixed resistor 24 is inserted. In this case, the charge threshold voltage is −4.5 kV and the corona discharge threshold voltage is −7.5 kV. As such, both the charge threshold voltage and the corona discharge threshold voltage were higher as compared with the case where no fixed resistor 24 was inserted. This is because the fixed resistor 24 caused voltage drop, with the result that the respective values of the charging threshold voltage and the corona discharge threshold voltage became larger by the voltage thus dropped. Note that almost no current flew in Experiment 2; however, a current slightly flew through each of the grid electrode 26 and the photoconductor drum 1 in the present experiment. This was an exhibition of an effect of the voltage drop caused by the fixed resistor 24.

As shown in FIG. 11(*a*) and FIG. 11(*b*), an amount of shift of the corona discharge threshold voltage was larger than an amount of shift of the charge threshold voltage. The amount of shift of the corona discharge threshold voltage refers to a difference between (i) the corona discharge threshold voltage obtained in the case where the fixed resistor 24 was inserted and (ii) the corona discharge threshold voltage obtained in the case where no fixed resistor 24 was inserted. Likewise, the amount of shift of the charge threshold voltage refers to a difference between (i) the charge threshold voltage obtained in the case where the fixed resistor 24 was inserted and (ii) the charge threshold voltage obtained in the case where no fixed resistor 24 was inserted. This confirmed that: the charging using only ions is attained by an applied voltage falling within a 1.0 kV range (3.75 kV≦|Va|<4.75 kV), in the case where no fixed resistor 24 was inserted; whereas the charging is attained by a voltage falling within a 3.25 kV range (4.5 kV≦|Va|<7.75 kV), in the case where the fixed resistor 24 was inserted. Thus, the range obtained in the case where the fixed resistor 24 was inserted was wider than that in the case where no fixed resistor 24 was inserted.

A conceivable reason for this is as follows. See FIG. 11(*a*) and FIG. 11(*b*). While only ions were generated, the total current It was small (several μA), so that the voltage drop caused by the fixed resistor 24 was small (several hundred V). However, while ions were generated together with the occurrence of corona discharge, the total current It was increased rapidly (several ten μA), so that the voltage drop caused by the fixed resistor 24 became large (several kV).

[Experiment 5]

Figure 8:
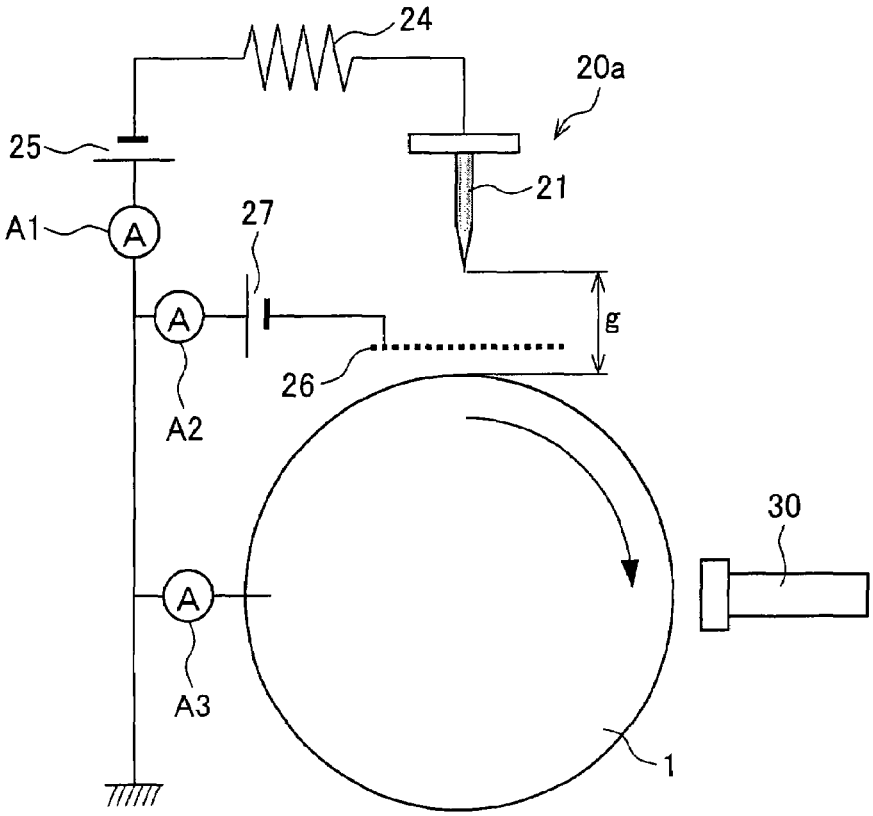
FIG. 8 is an explanatory diagram of the structure of an experimental device used in Experiment 2.

Next, experiment was carried out with the use of the aforementioned experimental device shown in FIG. 8, so as to find (i) a condition under which only ions are generated and (ii) a condition under which ions were generated together with occurrence of corona discharge. In the experiment, the applied voltage to the negative ion production element 20*a*, and the gap g between each of the ion generation needles 21 and the photoconductor drum 1 were parameters. The experiment was carried out under such conditions that the applied voltage to the grid electrode 26 was set at −700V. Moreover, the experiment was carried out with and without the fixed resistor 24.

Figure 12:
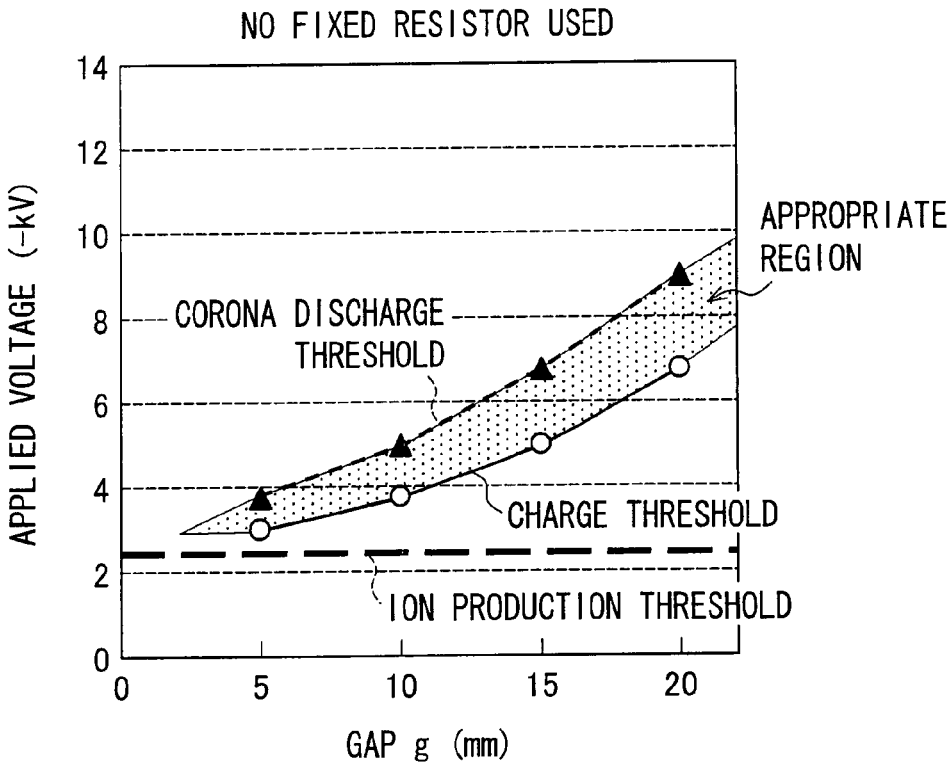
FIGS. 12(*a*) and 12(*b*) are graphs showing results of studies of the conditions under which only ions are generated and the conditions under which corona discharge occurs, using an applied voltage and the gap between a charging subject and a charging electrode as parameters, in the cases of no fixed resistor being inserted and of a fixed resistor being inserted respectively.
Figure 12:
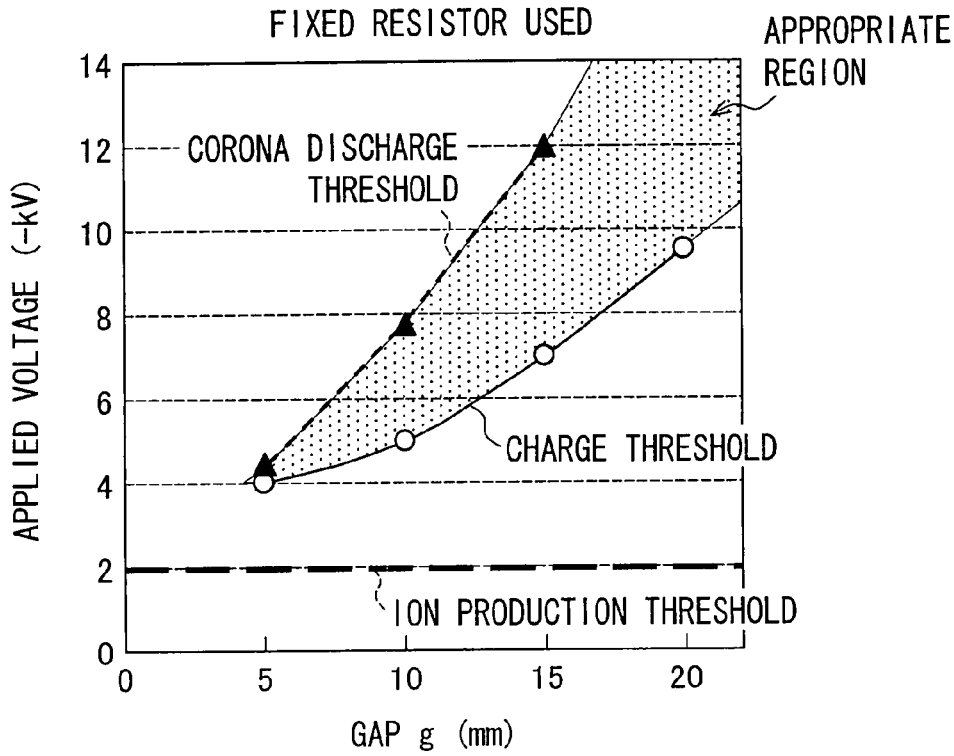

FIG. 12(*a*) is a graph illustrating a result of the measurement carried out in the case where no fixed resistor 24 was inserted. FIG. 12(*b*) is a graph illustrating a result of the measurement carried out in the case where the fixed resistor 24 is inserted.

A corona discharge threshold curve in each of FIG. 12(*a*) and FIG. 12(*b*) represents a relation between an applied voltage Va and the gap g when the corona discharge is started. In other words, the corona discharge threshold curve therein represents corona discharge threshold voltages respectively corresponding to lengths of the gap g. Also, it is possible to say that the corona discharge threshold curve represents corona discharge threshold distances respectively corresponding to applied voltages Va.

Likewise, a charge threshold curve in each of FIG. 12(*a*) and FIG. 12(*b*) represents a relation between an applied voltage Va and the gap g when the photoconductor drum 1 is started to be charged. In other words, the charge threshold curve therein represents charge threshold voltages respectively corresponding to sizes of the gap g, and also represents charge threshold distances respectively corresponding to applied voltages Va.

A region between the corona discharge threshold curve and the charge threshold curve represents respective conditions of the applied voltage Va and the gap g, under which conditions no corona discharge occurred but the photoconductor drum 1 was actually charged by ions. This region is hereinafter referred to as "appropriate region".

Further, an ion production threshold straight line shown in each of FIG. 12(*a*) and FIG. 12(*b*) represents a relation between an applied voltage Va and the gap g when ions are started to be generated. From FIG. 12(*a*) and FIG. 12(*b*), it is apparent that the ion production threshold voltage did not depend on the gap g but was constant.

As shown in FIG. 12(*a*) and FIG. 12(*b*), when the gap g was smaller than 4 mm, there was not existed any applied voltage region in which the charging was attained by only ions (there was substantially no difference between the charge threshold voltage and the corona discharge threshold voltage). As soon as the applied voltage was increased, the corona discharge occurred. However, the applied voltage region in which the charging was attained only by ions came into existence when the gap g was 4 mm or longer. As the gap g was larger, the applied voltage region (appropriate region) in which the charging was attained only by ions became wider. Further, the appropriate region obtained in the case where the fixed resistor 24 was inserted was wider than that in the case where no fixed resistor 24 was inserted.

According to the result of the experiment, it was found that the gap g needed to be 4 mm or greater such that no corona discharge occurred and the charging was attained only by ions. Further, according to the result of Experiment 1 described above (see FIG. 7), the quantity (density) of negative ions reaching the photoconductor drum 1 was reduced as the gap g was larger. When the gap g was smaller than 25 mm, the quantity was equal to or smaller than the half of the quantity obtained when the gap g was 5 mm. For this reason, in order to appropriately charge a charging subject such as the photoconductor drum 1, it is preferable that the gap g be not less than 5 mm but be not more than 25 mm.

Note that: in the conventional corona discharge type charging device disclosed in Citation 4 and using the needle-shaped electrode, the discharge current is reduced by setting the gap g at 4 mm or smaller, so that the occurrence of corona discharge is inevitable. Therefore, the ozone quantity reduction effect allowed by the technique of Citation 4 is much smaller than the ozone quantity reduction effect allowed by the present invention.

[Experiment 6]

Next, by using the primary pretransfer charging device 2 (latent image charging device 4) shown in FIG. 3 and FIG. 4, experiment was conducted to measure a surface potential of the photoconductor drum 1 and a quantity of ozone, each obtained when changing the length of the gap g from 3 mm to 30 mm. The experiment was carried out with and without the shield 23. Table 3 shows results of the measurement. The same devices and the same methods are used to measure the surface potential and the quantity of ozone as those used in each of the foregoing experiments.

TABLE 3

| | Gap g | Applied voltage | Grid voltage | Shield | Surface Potential | Quantity of ozone |
|---|---|---|---|---|---|---|
| Comparative Example 1-1 | 3 mm | −4 kV | −900 V | Not provided | −600 V | 0.09 ppm |
| Example 1-1 | 4 mm | −4 kV | −900 V | Not provided | −605 V | 0.002 ppm |
| Example 1-2 | 10 mm | −6.5 kV | −900 V | Not provided | −602 V | 0.001 ppm |
| Example 1-3 | 25 mm | −12 kV | −900 V | Not provided | −600 V | ≈0 ppm |
| Example 1-4 | 30 mm | −15 kV | −900 V | Provided | −595 V | ≈0 ppm |
| Comparative Example 1-2 | 30 mm | −15 kV | −900 V | Not Provided | −425 V | ≈0 ppm |

As shown in Table 3, when the gap was 3 mm (Comparative Example 1-1), the quantity of produced ozone was so large as to be 0.09 ppm. In contrast, when the gap g was 4 mm or longer (Example 1-1 to Example 1-4), the quantity of produced ozone was so small as to be 0.002 ppm or less. A reason of this lies in that: when the gap g was 3 mm or smaller, there was no condition under which the photoconductor was charged only by ions, so that the photoconductor was charged by corona discharge. In contrast, when the gap g was 4 mm or smaller, there was a condition under which the photoconductor drum 1 could be charged by only ions.

Further, in cases where no shield was provided and the gap was in the range 4 mm≦g≦25 mm (Example 1-1 to Example 1-3), the photoconductor drum 1 could be charged to have a target surface potential of −600 V. In this case, the applied voltage Va fell within the following range: 4 kV≦Va≦12 kV. However, when the applied voltage was increased up to 15 kV under conditions that the gap g was 30 mm (Comparative Example 1-2), the surface potential of the photoconductor drum 1 reached only −425 V, which was less than the target surface potential −600 V. A reason for this lies in that: the negative ions were spread wider as the gap g becomes larger, with the result that the density of negative ions reaching the photoconductor drum 1 was decreased.

In contrast, in cases where the shield 23 was provided (Example 1-4) and the gap g was 30 mm, the photoconductor drum 1 was so charged with an applied voltage of 15 kV as to have substantially the target surface potential. A reason for this lies in that the shield 23 restrains negative ions from being spread, with the result that the density of negative ions was increased in the vicinity of the photoconductor drum 1 and utilization efficiency of the negative ions was accordingly increased.

[Experiment 7]

Next, a toner image charging characteristic of the secondary pretransfer charging device 3 was measured.

The experiment was carried out in the following manner. A voltage to be applied to the ion generation needle 21 of the secondary pretransfer charging device 3 was gradually increased within such a range that the voltage never caused corona discharge, so as to charge a toner image formed on the intermediating transfer belt 15. A current Ib flowing through the intermediating transfer belt 15 upon the charging, and a charge amount that the toner had after the charging were measured. Note that the toner image was a solid image having a toner adhesion amount of 0.55 mg/cm$^2$. Results of the experiment are shown in FIG. 13.

Figure 13:
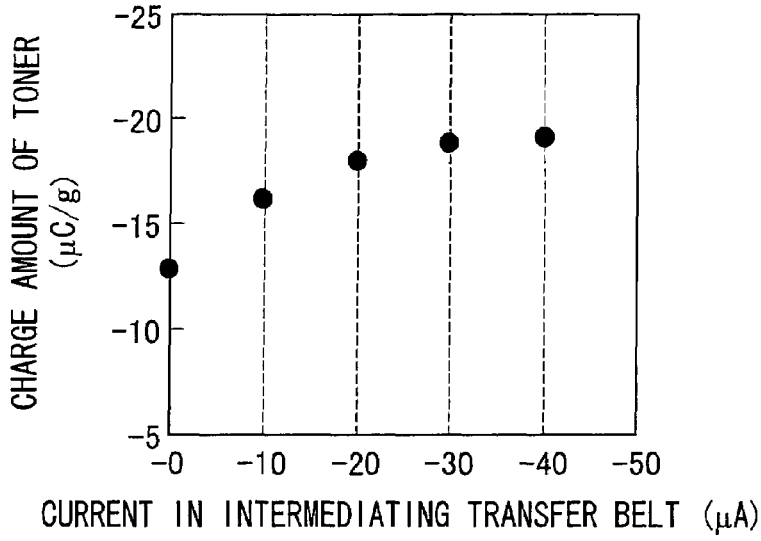
FIG. 13 is a graph showing results of studies of relationship between current flowing in an intermediating transfer belt, and a charge amount of toner.

As shown in FIG. 13, in an initial state in which no voltage was applied to the secondary pretransfer charging device 3, the current Ib was 0 and the toner image had a charge amount of 12.8 μC/g. Then, as the absolute value of the applied voltage Va was increased, the amount of generated negative ions was increased, with the result that the current Ib and the absolute value of the charge amount of the toner image were increased. However, when the absolute value of the current Ib was 30 μA or greater, the charge amount of the toner image was saturated substantially at −19 μC/g.

The results confirmed that the charge amount of the toner image became stable to be −19 μC/g by controlling the voltage Va, which was to be applied to the ion generation needle 21 of the high-voltage power supply 25, such that the voltage Va allowed $|Ib| \geqq 30$. Thus, even when no grid electrode 26 or the like was provided, it was understood that the charge amount of the toner image could be uniformized.

Therefore, by carrying out monitoring and feedback control with respect to the applied voltage Va from the high voltage power source 25 such that the current Ib becomes −30 μA, it is possible to always give an optimum amount of ions to the toner image even when the quantity of generated negative ions and the rate of generated ions reaching the toner image are fluctuated due to (i) adhesion of a foreign substance to the tip of the ion generation needle 21, (ii) a change of an environmental condition, (iii) a change of a flow of wind in the image forming apparatus 100, and/or the like.

[Experiment 8]

Next, six toner images were prepared which were different in terms of image patterns and environmental conditions. Secondary pretransfer charging was carried out with respect to each of the toner images with the use of the secondary pretransfer charging device 3, in which the applied voltage Va was so controlled by the feedback control of the voltage control section 31 as to allow the current Ib to be −30 μA. The charge amount that each of the toner images had before the charging, and the charge amount that each of the toner images had after the charging were measured. Results thereof are shown in FIG. 14.

Figure 14:
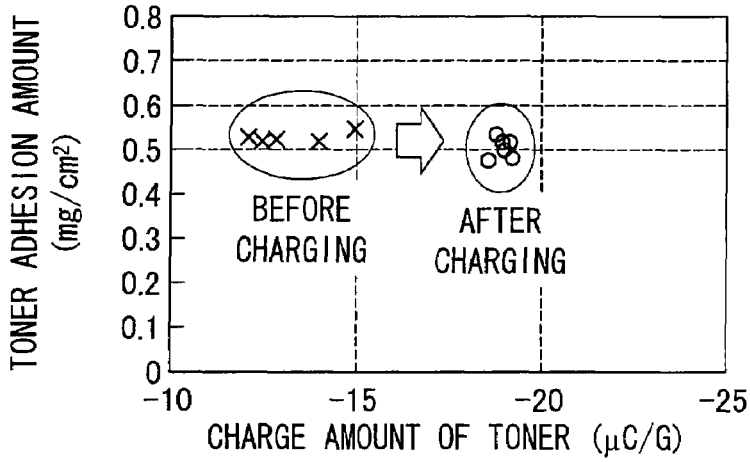
FIG. 14 is a graph showing results of studies of a charge amount of a toner image yet to be charged and a charge amount of the toner image having been charged, where the process of charging is performed while carrying out feedback control over the applied voltage based on the current flowing in the intermediating transfer belt.

As shown in FIG. 14, before the charging, the respective charge amounts of the toner images were fluctuated within an approximately 3 μC/g range, i.e., were fluctuated within a range from −12 μC/g to −15 μC/g. After the charging, the charging amounts were converged in an approximately 1 μC/g range, i.e., were converged in a range from −18 μC/g to −19 μC/g.

This proved the effectiveness of the secondary pretransfer charging device 3 including the voltage control section 31 that carries out the aforementioned feedback control.

[Experiment 9]

Carried out next was comparison between (i) secondary transfer efficiency obtained in cases where the secondary pretransfer charging was carried out with the use of the secondary pretransfer charging device 3 and (ii) secondary transfer efficiency obtained in cases where no secondary pretransfer charging was carried out. Results thereof are shown in FIG. 15.

Figure 15:
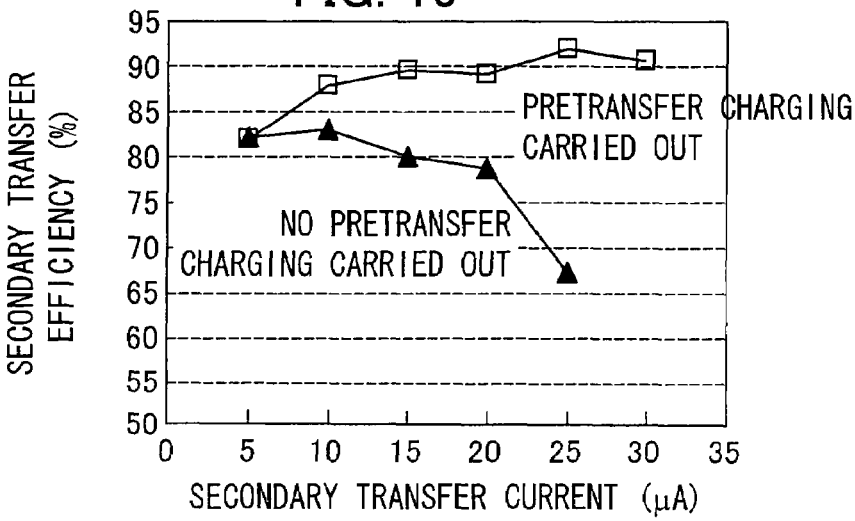
FIG. 15 shows results of study on difference in secondary transfer efficiency, between the cases of pretransfer charging being performed and of no pretransfer charging being performed.

As shown in FIG. 15, the secondary pretransfer charging thus carried out increased (i) the transfer efficiency by 5% to 10%, and (ii) a latitude (degree of margin in transfer). This proved the effectiveness of the secondary pretransfer charging carried out by the secondary pretransfer charging device 3.

As described above, each of the primary pretransfer charging device 2, the secondary pretransfer charging device 3, and the latent image charging device 4 of the present embodiment does not cause corona discharge but allows generation of negative ions, so that these charging devices make it possible to prevent the various problems from occurring due to the corona discharge. Moreover, these charging devices are capable of charging the photoconductor drum 1, or of carrying out pretransfer charging with respect to a toner image formed on the photoconductor drum 1 or the intermediating transfer belt 15.

Note that the specific values described in the present embodiment are mere examples, so that the present invention is not limited to these values.

For example, the applied voltage from the high-voltage power supply (first voltage application means) 25 to the ion generation needle (charging electrode) 21 may be equal to or larger than the ion production threshold voltage, and be smaller than the corona discharge threshold voltage. With this, the ion generation needle 21 allows generation of ions, thereby charging a charging subject. Further, no corona discharge is caused, so that it is possible to solve the various problems occurring due to the corona discharge.

Note that the wording "ion production threshold voltage" refers to an applied voltage at which ions begin to be detected (the number of ions begins to be changed) by the ion meter AIC-2000 that is positioned 150 mm away from the tip of the ion generation needle (charging electrode) 21 and that is available from Sato Shoji Corporation. Specifically, the wording "ion production threshold voltage" refers to a voltage, which is found by increasing the applied voltage and by which the quantity of ions measured by the ion meter is raised as shown in the graph of FIG. 6. Further, the wording "corona discharge threshold voltage" in the present specification refers to a minimum applied voltage causing corona discharge from the tip of the ion generation needle 21 to the charging subject, under conditions that there is provided a certain gap g (interval) between the tip of the ion generation needle 21 and the charging subject.

Further, it is preferable that the aforementioned applied voltage be equal to or larger than the charge threshold voltage shown in FIG. 12(*a*) and FIG. 12(*b*). This makes it possible to actually charge the charging subject such as the photoconductor drum 1 and the toner image.

Further, the wording "charge threshold voltage" refers to a minimum applied voltage at which ions generated by the ion generation needle 21 causes actual change of the charge amount of the charging subject such as the photoconductor drum 1 and the toner image, under conditions that there is provided a certain gap g therebetween.

Further, as described in Experiment 7, it is preferable that the aforementioned applied voltage be such a voltage that saturates the charge amount of the toner image, which is the charging subject. With this, even when ions are generated unevenly, the charge amount that the toner image has after the charging is uniformized, with the result that transfer of the toner image can be carried out suitably. Further, it is allowed that no grid electrode is provided, so that ions are never caught by the grid electrode. This allows (i) improvement of ion utilization efficiency, and (ii) restraint of manufacturing cost.

Meanwhile, focusing attentions on the gap g, the gap g may be longer than the corona discharge threshold distance. With this, no corona discharge occurs, so that the various problems occurring due to the corona discharge can be solved.

Note that the wording "corona discharge threshold distance" refers to the longest distance (gap), which is between the tip of the ion needle 21 and the charging subject, and which causes corona discharge under a certain applied voltage.

Further, it is preferable that the gap g be equal to or shorter than the charge threshold distance shown in FIG. 12(*a*) and FIG. 12(*b*). This makes it possible to actually charge the charging subject such as the photoconductor drum 1 and the intermediating transfer belt 15.

Note that the wording "charge threshold distance" refers to the longest distance (gap), which is between the tip of the ion generation needle 21 and the charging subject such as the photoconductor drum 1 and the toner image and which causes actual change of the charge amount of the charging subject.

Note that it is preferable that the gap g be not less than 4 mm but not more than 25 mm. When the gap g is 4 mm or longer, the applied voltage region, in which no corona discharge occurs but ions can be generated, comes into existence as described in Experiment 5. Further, when the gap g is 25 mm or shorter, not less than the half of the negative ions generated by the ion generation needle 21 can reach the charging subject as described in Experiment 1. This makes it possible to carry out charging efficiently.

Further, in the present embodiment, the fixed resistor (electric resistor) 24 is inserted between the charging electrode and the high-voltage power supply (voltage application means) 25 for applying a voltage to the charging electrode. The fixed resistor 24 thus inserted makes it possible to widen an applied voltage range and a gap range (appropriate region), each of which does not cause discharge but allows only the ions to charge the charging subject, as described in Experiment 5. However, the fixed resistor 24 does not need to be inserted necessarily, and therefore may not be provided. Further, the resistance of the fixed resistor 24 is not particularly limited and may be arbitrarily set such that the applied voltage range and the gap range, each of which does not cause the discharge but allows only the ions to charge the charging subject, are widen so as to allow for stable emission of ions.

Further, in the present embodiment, the shield (ion spread prevention member) 23 is provided so as to surround the ion generation needle (charging electrode) 21. Ions generated in response to voltage application to the ion generation needle 21 are moved toward the charging subject along the electric flux line; however not all the ions go toward the charging subject and some ions spread in a direction different from the direction toward the charging subject because the generated electric field is weaker than that in the conventional corona discharge type charging device. Therefore, by providing the shield 23 such that the ion generated needle 21 is surrounded by the shield 23, it is possible to prevent the ions from spreading, thereby improving the ion utilization efficiency and restraining the members around the charging device from being charged unnecessarily.

Further, the needle-shaped electrode (ion generation needle 21) is used as the charging electrode in the present embodiment. This makes it possible to form a high electric field with the use of a low voltage, as compared with the case where a wire-shaped or a saw-tooth electrode is used as the discharging electrode as with the conventional and general corona discharge type charging device. As a result, a large quantity of ions can be generated by using an applied voltage smaller than the corona discharge threshold voltage.

Note that, in the present embodiment, the needle-shaped ion generation needle 21 having an acute tip is used as the charging electrode as shown in FIG. 3 and FIG. 4; however, the present invention is not limited to this.

For example, as the charging electrode, it is possible to use an electrode having an acute tip, such as (i) a circular-conic-shaped (cone) electrode, (ii) a pyramid-shaped electrode, (iii) a circular-truncated-cone-shaped electrode, and (iv) a truncated-pyramid-shaped electrode. A large bending moment is exerted to a root portion of each of the electrodes each having such an acute shape; however, the root portion has a diameter (or cross section) larger than that of its tip, so that mechanical strength of the electrode is improved. Further, the tip is acute (the curvature radius of the tip is small), so that electric field intensity in the vicinity of the tip can be large even with a low voltage. This makes it possible to generate ions effectively. Further, a distance from the electrode supporting member (or the root portion of the electrode) to the tip is long, so that it is possible to prevent the charging characteristic from being deteriorated due to an electric interference from the electrode supporting member (or the root portion of the electrode).

Alternatively, a saw-tooth electrode, which has a saw-tooth shape (acute tip shape), may be used. Also in this case, the tip of the saw-tooth electrode is acute, so that it is possible to form a high electric field as is the case with the needle-shaped electrode, the circular-conic-shaped electrode, the pyramid-shaped electrode, the circular-truncated-cone-shaped electrode, and the truncated-pyramid-shaped electrode. It is easier that each of the needle-shaped electrode, the circular-conic-shaped electrode, the pyramid-shaped electrode, the circular-truncated-cone-shaped electrode, and the truncated-pyramid-shaped electrode is caused to have a small curvature radius, as compared with the saw-tooth electrode. Accordingly, it is easy for the electrodes to form a high electric field even with a low voltage. However, the shape of the saw-tooth electrode can be processed through photo etching processing or electrotyping processing. Therefore, in cases where the saw-tooth electrode is used, it is possible to process the charging electrode more precisely. Further, the use of the saw-tooth electrode allows realization of an electrode excellent in mechanical strength.

Figure 16:
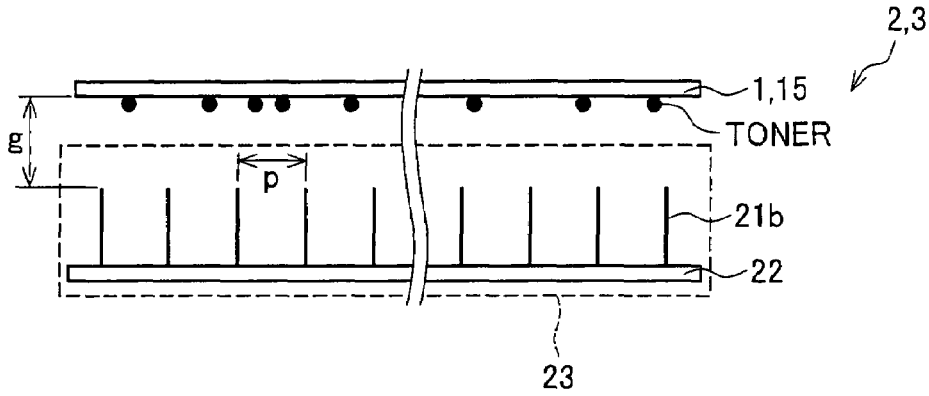
FIG. 16 is a side view illustrating a modified example of the charging electrode in the pretransfer charging device in accordance with the embodiment of the present invention.

Alternatively, a line-shaped electrode 21*b*, which is a charging electrode having a line-like shape (extra-fine-line-like shape), may be used as shown in FIG. 16. The structure shown in FIG. 16 is substantially identical to each of the structures shown in FIG. 3 and FIG. 4 except the charging electrode, so that no explanation for the identical components will be made.

In the structure shown in FIG. 16, a plurality of (32, here) of line-shaped electrodes 21*b* are provided with a pitch p therebetween on the base frame 22 made of a metal (stainless steel, here). Each of the line-shaped electrodes 21*b* is made of either (i) a tungsten wire having a diameter of 70 μm or (ii) a stainless steel wire having a diameter of 70 μm. The line-shaped electrode 21*b* has a tip directing toward the photoconductor drum 1. The pitch p between the line-shaped electrodes 21*b* is 10 mm. Further, the applied voltage Va from the high-voltage power supply 25 is −6.5 kV.

As such, even in cases where each of the line-shaped electrodes 21*b* is used, negative ions can be generated although ion production efficiency is slightly inferior to the ion production efficiency allowed by the ion generation needle 21 shown in each of FIG. 3 and FIG. 4. Further, in cases where such a charging electrode having the line-like shape is used, the distance from the electrode supporting member (or root portion of the electrode) to the tip thereof is long as is the case with the needle-shaped electrode, the circular-conic-shaped electrode, the pyramid-shaped electrode, the circular-truncated-cone-shaped electrode, and the truncated-pyramid-shaped electrode. This makes it possible to prevent the charging characteristic from being deteriorated due to an electric interference from the electrode supporting member (or root portion). Note that: each of the needle-shaped electrode, the circular-conic-shaped electrode, the pyramid-shaped electrode, the circular-truncated-cone-shaped electrode, and the truncated-pyramid-shaped electrode has a tip acuter than that of the line-shaped electrode, i.e., has a smaller curvature radius of the tip, and therefore can form a high electric field with a lower voltage, with the result that ions can be generated efficiently. Further, the shape of the charging electrode having the line-like shape such as the line-shaped electrode 21*b* can be processed upon manufacturing more easily as compared with the needle-shaped electrode, the circular-conic-shaped electrode, the pyramid-shaped electrode, the circular-truncated-cone-shaped electrode, and the truncated-pyramid-shaped electrode. Therefore, the charging electrode having the line-like shape can be manufactured with moderate cost. This is advantageous.

However, it is difficult for the line-shaped electrode to secure mechanical strength, as compared with the circular-conic-shaped charging electrode, the pyramid-shaped charging electrode, the circular-truncated-cone-shaped charging electrode, the truncated-pyramid-shaped charging electrode, and the cone-shaped electrode. If the line-shaped electrode is caused to have a large diameter or a large cross sectional area in order to secure the mechanical strength, the diameter or cross sectional area of the tip of the line-shaped electrode is accordingly increased, with the result that an applied voltage required for production of ions is likely to be larger as compared with that in each of the circular-conic-shaped charging electrode, the pyramid-shaped charging electrode, the circular-truncated-cone-shaped charging electrode, the truncated-pyramid-shaped charging electrode, and the cone-shaped electrode.

Note that a cylindrical electrode, a rod-like electrode, a stair-like cylindrical electrode may be used. The stair-like cylindrical electrode refers to an electrode having such a shape that cylindrical portions having different cross sectional areas are formed in a row from the root portion to the tip thereof. These electrodes allow substantially the same effect as the effect allowed by the line-shaped electrode.

Figure 17:
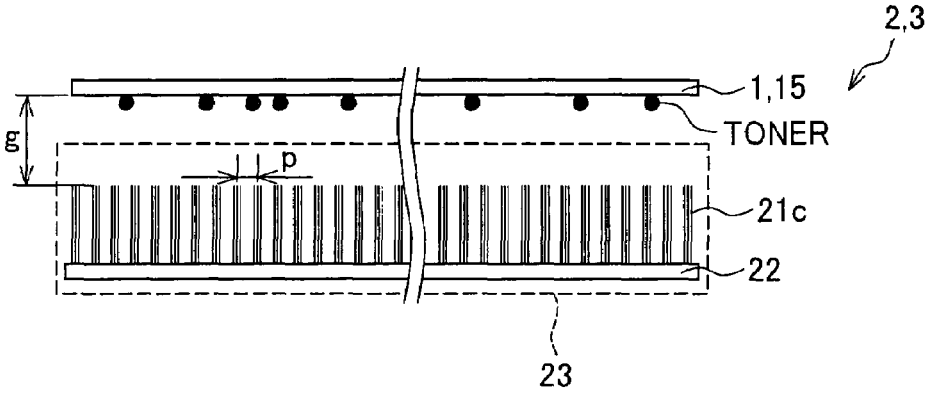
FIG. 17 is a side view illustrating a modified example of the charging electrode in the pretransfer charging device in accordance with the embodiment of the present invention.
Figure 18:
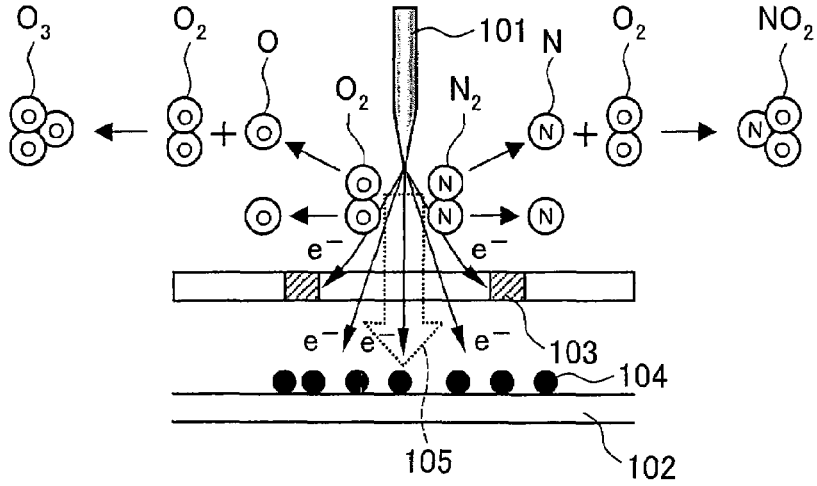
FIG. 18 is an explanatory diagram schematically illustrating electric charging mechanism of a conventional corona discharge type charging device.

Further, a brush-shaped charging electrode may be used. The brush-shaped charging electrode refers to such an electrode that is formed by binding a plurality of fiber (e.g., needle-shaped or line-shaped) members. FIG. 17 is a side view illustrating each of the charging devices 2, 3, and 4 using such a brush-shaped charging electrode. The structure shown in FIG. 17 is substantially identical to each of the structures shown in FIG. 3 and FIG. 4, apart from the charging electrode. Therefore, no explanation for the identical components will be made.

In the structure shown in FIG. 17, brush-shaped electrodes 21*c* are provided on the base frame 22 made of a metal (aluminum, here). Each of the brush-shaped electrodes 21*c* is formed by binding approximately 15 stainless fibers each having a diameter of 12 μm. In the structure shown in FIG. 17, the brush-shaped electrodes 21*c* are disposed with a predetermined pitch p therebetween. In the structure shown in FIG. 17, the pitch p therebetween is 1.6 mm. The tip of each of the brush-shaped electrodes 21*c* (the fiber members constituting each of the brush-shaped electrode 21*c*) is directed toward the photoconductor drum 1.

Further, the applied voltage Va from the high-voltage power supply 25 is −9 kV.

As such, even in cases where each of the brush-shaped electrodes 21*c* is used, negative ions can be generated although ion production efficiency is slightly inferior to the ion production efficiency allowed by the ion generation needle 21 shown in each of FIG. 3 and FIG. 4. Further, a charging electrode made up of the line-shaped electrodes, such as the brush-shaped electrode 21*c*, can be manufactured with more moderate cost than the cost required for the needle-shaped charging electrode. This is advantageous.

Further, the number of the fibers (ion generation needles or extra fine lines) constituting each of the brush-shaped electrodes 21*c* is very large, as compared with the case of using the aforementioned needle-shaped charging electrode (ion generation needle 21) and the line-shaped charging electrode (line-shaped electrode 21*b*). This makes it possible to reduce an influence over the charge uniformity even in cases where a foreign substance such as dust is adhered to the tip of the brush-shaped electrode 21*c*.

Further, the ion generation needle 21 made of tungsten is used as the charging electrode; however, the material of which the charging electrode is made is not limited to this. For example, other metal material such as stainless steel may be used as the material.

Note that a well-known material allowing generation of a large quantity of ions with a low voltage is a carbon nano material such as a carbon nano tube; however, for the following reasons, it is preferable that the metal material such as tungsten or stainless steel be used instead of the carbon nano material.

A first problem is that the carbon nano material is very weak in terms of durability and is therefore unsuitable for practical use. Specifically, the charging electrode made of the carbon nano material is wasted much faster than the charging electrode made of the metal material such as tungsten or stainless steel. Accordingly, the charging electrode made of the carbon nano material needs to be exchanged frequently. This is not suitable for practical use.

A second problem is as follows. The carbon nano material is so microscopic as to have a fiber diameter falling within a range from 1 nm to several ten nm. Therefore, when even a slight amount of dust, oil film, water film, or the like is adhered thereto, the charging electrode made of the carbon nano material is buried in such a adhered object, with the result that stable charging operation cannot be maintained. Especially, consider a case where a charging subject is charged in an electrophotographic apparatus in which there are existed dusts such as (i) silicone oil from a fusing section, (ii) a hydrophobic surface treatment agent of hydrophobic silica that coats toner, (iii) wax component, and (iv) flying toner. The dusts are electrostatically adhered to the charging electrode with ease. Further, water vapor generated from recording paper upon toner fusing becomes dewdrops, with the result that a water film is likely to be adhered on the surface of the carbon nano material. Also, oil film etc., from various operation parts is likely to be adhered on the surface of the carbon nano material. In contrast, consider a case where stainless steel or tungsten is used as the material for the electrode. In this case, even though adhesion of dusts, oil film, and water film causes deterioration of the charging characteristic to some extent, the charging electrode made of stainless steel or tungsten has a much greater tolerance for these adhered objects, than the charging electrode made of the carbon nano material.

A third problem is that it is very difficult to process the carbon nano material, as compared with the metal material such as tungsten or stainless steel. Therefore, it is difficult to process the carbon nano material such that the carbon nano material has a shape such as the circular conic shape, the pyramid shape, the circular truncated cone shape, the saw-tooth shape, the line shape, the cylindrical shape, the rod-like shape, the stair-like cylindrical shape, and the brush-like shape, unlike the case where the metal material such as tungsten or stainless steel is used. Accordingly, the aforementioned effects cannot be obtained. Further, in cases where the carbon nano material is used, it is difficult for the carbon nano material to maintain an adhesive strength to the supporting member. This makes it difficult to uniformly charge the entire charging target region.

For these reasons, it is preferable that the metal material such as tungsten or stainless steel be used instead of the carbon nano material.

Embodiment 2

Another embodiment of the present invention will be described. Here, for convenience, members of the present embodiment that have the same functions as members of Embodiment 1 are indicated by the same reference numerals and description thereof is omitted.

The present embodiment views the present invention from a different perspective than Embodiment 1. The charging device of the present embodiment has the same configuration as each of the charging devices 2, 3, 4 of Embodiment 1. In addition, the shape, material, etc of the component members (e.g., ion generation needles 21) of the charging device may be modified as is the case with Embodiment 1.

Embodiment 2 differs from Embodiment 1 in the settings of the range of voltage applied to the ion generation needles 21. Specifically, in Embodiment 1, the voltage applied to the ion generation needles 21 is set to be not less than the ion production threshold voltage but lower than the corona discharge threshold voltage. In contrast, in the present embodiment, the voltage applied to the ion generation needles 21 is set to either one of two values: one is not less than the ion production threshold voltage but lower than an ozone production surge threshold voltage (voltage at which the quantity of produced ozone starts sudden increases), and the other is higher than or equal to the ion production threshold voltage and lower than a total-current surge threshold voltage (voltage at which the total current (summed currents through the ion generation needles 21) starts sudden increases).

Explained here is the definition of the wording "ozone production surge threshold voltage" used in cases where no fixed resistor 24 is inserted between the ion generation needles 21 and the high-voltage power supply 25. The phrase "no fixed resistor 24 is inserted between the ion generation needles 21 and the high-voltage power supply 25" means either complete absence of the fixed resistor 24 or, if present, its resistance being so low that the effect of the resistance on the ozone production surge threshold voltage is ignorable. As an example, if a single resistor 24 is inserted and the N-number of ion generation needles 21 are provided, the resistance R of the resistor 24 should be less than 50/N MΩ. Now, assume that the applied voltage to each of the ion generation needles 21 is increased by a predetermined value (e.g., 500V) at a time. In this case, the wording "ozone production surge threshold voltage" refers to an applied voltage, at which a rate of change (change rate) in a rate of (i) increase of produced (detected) ozone from the quantity measured in the previous measurement point to (ii) increase of the applied voltage from the value measured in a previous measurement point is maximum in an applied voltage range from an ozone production threshold voltage to a voltage twice as large as the ozone production threshold voltage. The ozone production threshold voltage is a voltage at which ozone production is detected for the first time since the start of increasing the applied voltage. However, in cases where the rate of change at the ozone production threshold voltage is equal to or greater than twice the average of the rate of change in an applied voltage range from a voltage more than the ozone production threshold voltage to a voltage twice as large as the ozone production threshold voltage, this ozone production threshold voltage does not serves as the ozone production surge threshold voltage. In this case, the ozone production surge threshold value refers to a voltage obtained by adding the aforementioned predetermined value to the ozone production threshold voltage. Note that: the ozone production surge threshold voltage is equal to the ozone production threshold voltage in cases where the rate of change at the ozone production threshold voltage is smaller than twice the average of the rate of change in the applied voltage range from a voltage more than the ozone production threshold voltage to a voltage twice as large as the ozone production threshold voltage.

Explained next is the definition of the wording "total current surge threshold voltage" used in cases where no fixed resistor 24 is inserted between the ion generation needles 21 and the high-voltage power supply 25. The phrase "no fixed resistor 24 is inserted between the ion generation needles 21 and the high-voltage power supply 25" means either complete absence of the fixed resistor 24 or, if present, its resistance being so low that the effect of the resistance on the ozone production surge threshold voltage is ignorable. As an example, if a single resistor 24 is inserted and the N-number of ion generation needles 21 are provided, the resistance R of the resistor 24 should be less than 50/N MΩ. Now, assume that the applied voltage to each of the ion generation needles 21 is increased by a predetermined value (e.g., 500V) at a time. In this case, the wording "total-current surge threshold voltage" refers to an applied voltage, at which a rate of change (change rate) in a rate of (i) increase of the total current from the value measured in the previous measurement point to (ii) increase of the applied voltage from the value measured in a previous measurement point is maximum in an applied voltage range from a current occurrence threshold voltage to a voltage twice as large as the current occurrence threshold voltage. The current occurrence threshold voltage is a voltage at which the total current is detected for the first time since the start of increasing the applied voltage. However, in cases where the rate of change at the current occurrence threshold voltage is equal to or greater than twice the average of the rate of change in an applied voltage range from a voltage more than the current occurrence threshold voltage to a voltage twice as large as the current occurrence threshold voltage, this current occurrence threshold voltage does not serves as the total-current surge threshold voltage. In this case, the total-current surge threshold value refers to a voltage obtained by adding the aforementioned predetermined value to the current occurrence threshold voltage. Note that: the total-current surge threshold voltage is equal to the current occurrence threshold voltage in cases where the rate of change at the current occurrence threshold voltage is smaller than twice the average of the rate of change in the applied voltage range from a voltage more than the ozone production threshold voltage to a voltage twice as large as the current occurrence threshold voltage.

Meanwhile, explained next is the definition of the wording "ozone production surge threshold voltage" used in cases where the fixed resistor 24 is inserted between the ion generation needles 21 and the high-voltage power supply 25. The phrase "the fixed resistor 24 is inserted between the ion generation needles 21 and the high-voltage power supply 25" means its resistance being so high that the effect of the resistance on the ozone production surge threshold voltage is not ignorable. As an example, a single resistor 24 having a resistance R of $50/N(M\Omega) \leqq R \leqq 2000/N(M\Omega)$ is provided for the N-number of ion generation needles 21. Now, assume that the applied voltage to each of the ion generation needles 21 is increased by a predetermined value (e.g., 500V) at a time. In this case, the wording "ozone production surge threshold voltage" refers to an applied voltage, at which a rate of change (change rate) in a rate of (i) increase of produced (detected) ozone from the quantity measured in the previous measurement point to (ii) increase of the applied voltage from the value measured in a previous measurement point is the largest local maximal value in an applied voltage range from a voltage larger than the ozone production threshold voltage to a voltage twice as large as the ozone production threshold voltage. The ozone production threshold voltage is a voltage at which ozone production is detected for the first time since the start of increasing the applied voltage.

Further, explained next is the definition of the wording "total-current surge threshold voltage" used in cases where the fixed resistor 24 is inserted between the ion generation needles 21 and the high-voltage power supply 25. The phrase "the fixed resistor 24 is inserted between the ion generation needles 21 and the high-voltage power supply 25" means its resistance being so high that the effect of the resistance on the total-current surge threshold voltage is not ignorable. As an example, a single resistor 24 having a resistance R of 50/N (MΩ)≦R≦2000/N(MΩ) is provided for the N-number of ion generation needles 21. Now, assume that the applied voltage to each of the ion generation needles 21 is increased by a predetermined value (e.g., 500V) at a time. In this case, the wording "total-current surge threshold voltage" refers to an applied voltage, at which a rate of change (change rate) in a rate of (i) increase of generated (detected) ozone from the quantity measured in the previous measurement point to (ii) increase of the applied voltage from the value measured in a previous measurement point is the largest local maximal value in an applied voltage range from a voltage larger than the current occurrence threshold voltage to a voltage twice as large as the current occurrence threshold voltage. The current occurrence threshold voltage is a voltage at which the total current is detected for the first time since the start of increasing the applied voltage.

If each of the quantity of produced ozone and the value of the total current varies under application of the same voltage, measurement is repeated for a plurality of times (desirably, 16 times or more) for an average value.

Now, the effect of setting the voltage applied to the ion generation needles 21 as above will be described in reference to experimental results. The results of Experiments 1 to 9 presented below are identical to those of Experiments 1 to 9 in Embodiment 1, but are viewed from a different perspective.

[Experiment 1]

First, a negative ion production element 20*a* shown in FIG. 5 was prepared.

The negative ion production element 20*a* had multiple (here, 3) needle-shaped ion generation needles 21 fixed on a metal (here, stainless steel) base frame 22. Each ion generation needle 21 was made of tungsten (purity of 99.999%), had a diameter of 1 mm, had a circular conic portion whose taper angle was 34°, and had a tip curvature radius of 15 μm. Adjacent ion generation needles 21 were separated by a pitch of 10 mm.

The negative ion production element 20*a* was placed (exposed) in a free space 1 m in radius in which there was nothing but an air inlet (detailed later). The quantity of generated negative ions, the quantity of produced ozone, and electric current were measured upon voltage application in two cases: (1) the negative ion production element 20*a* was connected to the negative terminal of the high-voltage power supply 25; and (2) the negative ion production element 20*a* was connected to the negative terminal of the high-voltage power supply 25 via the fixed resistor 24 (resistance=200 MΩ). In other words, in one case, there was the fixed resistor 24 (resistance=200 MΩ) between the negative ion production element 20*a* and the high-voltage power supply 25. In the other, there was none. As additional information, the high-voltage power supply 25 was MODEL 610C available from Trek Inc. Also, a negative ion meter AIC-2000 available from Sato Shoji Corporation and an ozone monitor EG2002F available from Ebara Jitsugyo Co., Ltd. were used. The quantity of generated negative ion was measured 150 mm away from the ion generation needles 21 five seconds after the voltage application to the ion generation needles 21 was started. The quantity of produced ozone was measured with the air inlet positioned 10 mm away from the ion generation needles 21. The measurement of the quantity of produced ozone was obtained as an average over 12 measurement cycles (12 cycles×15 seconds/cycle=180 seconds or 3 minutes) after the voltage application to the ion generation needles 21 was started.

FIG. 6(*a*) is a graph showing experimental results in the case of no fixed resistor 24 being inserted. FIG. 6(*b*) is a graph showing experimental results in the case of the fixed resistor 24 being inserted.

FIG. 6(*a*), showing the case of no fixed resistor 24 being inserted, indicates that negative ion generation started when the applied voltage exceeded −2.5 kV. FIG. 6(*b*), showing the case of the fixed resistor 24 being inserted, indicates that negative ion generation started when the applied voltage exceeded −2 kV. In both cases, the quantity of negative ions (quantity of generated ions) rapidly increased with increase in the applied voltage (increase in the absolute value of the applied voltage), and reached saturation at about $1\times10^7$ ions/cc. Also in both cases, almost no ozone was produced. This indicated that the quantity of produced ozone was drastically reduced.

These results demonstrate that high voltage application to the needle-shaped negative ion production element 20*a* shown in FIG. 5 with no discharging target in the surroundings generates a large quantity of negative ions with almost no ozone being generated (i.e., while drastically reducing the quantity of produced ozone).

The negative ion production threshold voltage was somewhat lower when the fixed resistor 24 was inserted then when it was not, presumably for the following reasons. The ions are generated by difference in potential between air and the ion generation needles 21 with the air acting as a virtual positive electrode. Since the impedance of the air is very unstable, ion generation becomes unstable in a region where the ion generation starts at low applied voltage if no fixed resistor 24 is provided. The insertion of the fixed resistor 24 stabilizes the overall impedance including that of the air, which in turn stabilizes the ion generation.

Next, under such conditions that the fixed resistor 24 was inserted and the applied voltage was set to −3 kV, the quantity (density) of negative ions was measured in relation with a distance L from the ion generation needles 21. FIG. 7 is a graphical representation of results. The quantity of negative ions is shown in relative values for L>5 mm, taking the quantity of negative ions when L=5 mm as 100%.

As can be seen from the figure, the density of negative ions decreases with increasing L. Also from FIG. 7, at least 50% the quantity (density) of negative ions when L=5 mm is secured so long as L≦25 mm.

[Experiment 2]

Next, a charging characteristic for the photoconductor drum 1 was measured by experiment using the negative ion production element 20*a*. First, the experimental device will be described in reference to FIG. 8.

The photoconductor drum 1 (the photoconductor drum used in a color copying machine manufactured by Sharp Kabushiki Kaisha (product name "MX-2300") includes an organic photoconductor (OPC) 30 mm in diameter and 30 μm in film thickness. The photoconductor drum 1 was so supported that it could rotate at a given peripheral speed. The negative ion production element 20*a* was placed with a predetermined gap g away from the photoconductor drum 1. The photoconductor drum 1 and the negative ion production element 20*a* were so placed in a sealed acrylic enclosure measuring 80 cm long by 40 cm wide by 25 cm high that the negative ion production element 20*a* could be positioned at the center of the enclosure. The negative ion production element 20*a* was mounted on a stage (not shown) which could be moved in the direction toward the photoconductor drum 1 so that the gap g could be set at any value from 0 mm to 30 mm. The current flow through the negative ion production element 20*a* (total current) was measured with an ammeter A1.

Between the photoconductor drum 1 and the ion generation needles 21 of the negative ion production element 20*a* was provided a 0.1-mm thick, stainless steel grid electrode 26. The grid electrode 26 is used in AR-625S manufactured by Sharp Kabushiki Kaisha, and has an aperture section having a width w of 26 mm. The distance between the grid electrode 26 and the photoconductor drum 1 was fixed at 1.5 mm. The grid electrode 26 was connected to the negative terminal of the high-voltage power supply 27, so that a given voltage could be applied thereto. The current flow through the grid electrode 26 (grid current) was measured with an ammeter A2.

Furthermore, a surface potential measuring probe 30 was provided in a position 90° downstream from a portion, facing the negative ion production element 20*a*, of the photoconductor 1 with respect to the rotational direction of the photoconductor drum 1 so as to measure the surface potential of the photoconductor drum 1. The surface potential measuring probe 30 was mounted on a stage (not shown) which allowed the surface potential measuring probe 30 to scan the photoconductor drum 1 in the longitudinal direction of the photoconductor drum 1 so as to draw a surface potential profile not only in the peripheral direction of the photoconductor drum 1, but also in the longitudinal direction. The surface potential meter used was TereK's model 344. The photoconductor drum 1 was rotated at a peripheral speed of 124 mm/s. In addition, the quantity of generated ions, the quantity of produced ozone, etc. were measured similarly to Experiment 1. The current flow through the photoconductor drum 1 was measured with an ammeter A3.

Experimental conditions included the following: gap g=20 mm; the applied voltage to the negative ion production element 20*a* was −7.7 kV; and the applied voltage to the grid electrode 26 was −900 V. Experiment was conducted with and without the grid electrode 26 being inserted.

FIG. 9 is a graph showing results of the experiment. The graph represents the surface potential profile of the photoconductor drum 1 with the grid electrode 26 and that without the grid electrode 26, both taken along the longitudinal direction of the photoconductor drum 1, for comparison. Table 4 shows measurements of the quantity of generated negative ions and the quantity of produced ozone. In FIG. 9, distances in the longitudinal direction of the photoconductor drum 1 were plotted on the horizontal axis, and the surface potentials of the photoconductor drum 1 were plotted on the vertical axis. The value "0" indicated in the horizontal axis representing the distances in the longitudinal direction of the photoconductor drum 1 corresponds to such a portion of the photoconductor drum 1 that faces the middle one of the three ion generation needles 21 provided in the longitudinal direction of the photoconductor drum 1.

TABLE 4

| | Quantity of generated negative ion (ions/cc) | Quantity of produced ozone (ppm) |
|---|---|---|
| Without grid | 18,000,000 | 0.002 |
| With grid | 18,000,000 | 0.003 |

As shown in FIG. 9, the surface of the photoconductor drum 1 was charged, irrespective of presence or absence of the grid electrode 26. Also, as shown in Table 1, a sufficient quantity of negative ions was produced (18,000,000 ions/cc), and almost no ozone was produced (i.e., ozone was slightly produced at 0.002 ppm to 0.003 ppm). If corona discharge had occurred, ozone would have been produced in a large quantity. The fact that the experiment produced substantially no ozone (i.e., the experiment produced little ozone) confirmed that it was not corona discharge, but negative ions that contributed to the charging of the photoconductor drum 1 in the experiment. The negative ions were able to sufficiently charge the photoconductor drum 1.

In addition, as shown in FIG. 9, when there was no grid electrode 26, the surface potential showed fluctuations (three peaks) corresponding to the positions of the three ion generation needles 21. When the grid electrode 26 was there, the potential showed smaller fluctuations. These results confirmed that the provision of the grid electrode 26 restrained the fluctuations of the surface potential and improved the controllability of the surface potential.

[Experiment 3]

Next, a toner image charging characteristic of the negative ion production element 20*a* was measured by experiment. First, the experimental device will be described in reference to FIG. 10.

As illustrated in FIG. 10, the experimental device was identical to that used in Experiment 2. However, the potential measuring probe 30 and the ammeter A3 were not used in Experiment 3.

The experiment was conducted as follows. First, a non-fixed toner image is formed on an OHP sheet (S4BG746 produced by Sharp Kabushiki Kaisha), using a digital color multifunction printer (AR-C280 produced by Sharp Kabushiki Kaisha). For the image formation, polyester toner (AR-C280 genuine toner) having a grain diameter of 8.5 μmm is used. The non-fixed toner image is a solid image of 0.6 mg/cm$^2$ in adhesion amount. The charge amount of the non-fixed toner image thus formed is measured by using a small charge amount measuring device of suction type (Model 210HS-2A provided by Trek Inc.).

Next, the OHP sheet having the non-fixed toner image was attached onto the surface of the photoconductor drum 1. The photoconductor drum 1 was rotated at a predetermined peripheral speed, while a predetermined voltage is applied to the negative ion production element 20*a* and the grid electrode 26, so that the non-fixed toner image was charged as it passed through the area facing the ion generation needle 21. After the charging, the charge amount of the toner image was measured again, and the amounts of charge on the toner image before and after the charging process were compared. Moreover, as in the Experiment 1, the quantities of generated ions and produced ozone were also measured.

Experimental conditions included the following. Gap g=20 mm. The applied voltage to the negative ion production element 20*a* was −7.7 kV. The applied voltage to the grid electrode 26 was −900 V. Experiment was conducted with and without the grid electrode 26 being inserted.

Table 5 is a table showing the results of the experiment. For both cases of using or not using the grid electrode 26, Table 5 shows the measurement of the charge amount of the toner image, the quantity of generated negative ion, and the quantity of produced ozone.

TABLE 5

| | Charge Amount of toner (μC/g) | | | Quantity of generated negative | Quantity of produced |
|---|---|---|---|---|---|
| | Before charging | After charging | Increment | ion (ions/cc) | ozone (ppm) |
| Without grid | −12.8 | −20.5 | 7.7 | 18,000,000 | 0.002 |
| With grid | −12.8 | −18.3 | 5.5 | 18,000,000 | 0.003 |

As shown in Table 5, the charge amount of the toner image increased irrespective of the presence or absence of the grid electrode 26. Also, a sufficient quantity of negative ions were produced (18,000,000 ions/cc), and almost no ozone was produced (i.e., the quantity of produced ozone was so slight as to be 0.002 ppm to 0.003 ppm). If corona discharge had occurred, ozone would have been produced in a large quantity. The fact that the experiment produced substantially no ozone (produced little ozone) confirmed that it was not the conventional corona discharge, but negative ions that mainly contributed to the charging of the toner image in the experiment. The negative ions were able to sufficiently charge the toner image.

Furthermore, it is apparent that the charge on the toner increased by large amount without the grid electrode, as compared with the case of using the grid electrode.

[Experiment 4]

The following experiment was conducted to study conditions for more stable generation of negative ions. Since it is found from the results of Experiments 2 and 3 that charging by the use of negative ions exhibited similar tendency in both cases of the photoconductor drum 1 and toner image, the photoconductor drum 1 is used as the charging subject in Experiment 4.

In the present experiment, the above experimental device was used to study the relationship amongst an applied voltage Va to the negative ion production element 20*a*, the surface potential $V_0$ of the photoconductive drum 1, total current It, and the quantity of produced ozone. The experimental conditions included the following. Gap g=10 mm. The grid electrode 26 and the photoconductor drum 1 were fixed at 1.5 mm away from each other. The applied voltage to the grid electrode 26 was −700V. The experiment was conducted for two cases: (i) a case where the fixed resistor 24 is inserted and (ii) a case where no fixed resistor 24 is inserted. In this experiment, the applied voltage was increased from 0V by 500 V at a time. For each applied voltage, the relationship amongst the surface potential $V_0$, the total current It, and the quantity of produced ozone was studied.

FIG. 11(*a*) is a graph showing the measurement result of the case where the fixed resistor 24 was not inserted, and FIG. 11(*b*) is a graph showing the measurement result of the case where the fixed resistor 24 was inserted.

As shown in FIG. 11(*a*), when the applied voltage Va to the negative ion generating element 20*a* was raised to around −3.75 kV (charge threshold voltage) by gradually raising the value (absolute value) of the applied voltage Va, the surface of the photoconductive drum 1 started to be charged. Further increasing of the applied voltage Va caused increase in the absolute value of the surface potential $V_0$.

Figure 19:
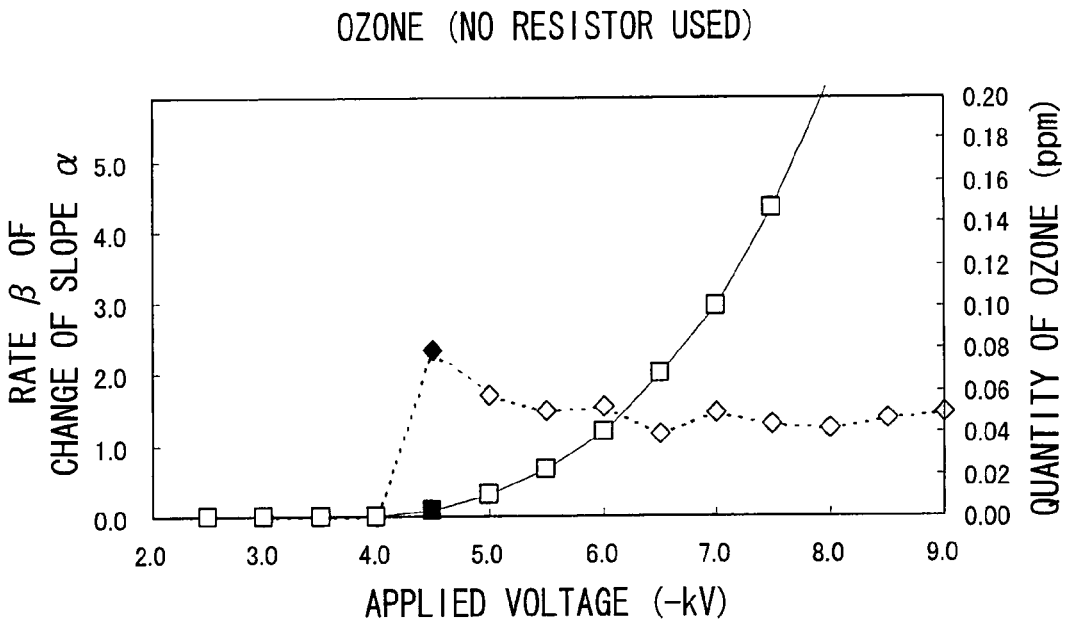
FIG. 19(*a*) is a graph representing the relationship between the applied voltage and the quantity of produced ozone (see FIG. 11(*a*)), as well as the rate β of change in the rate a of increase of the quantity of produced ozone to increase of the applied voltage.
Figure 19:
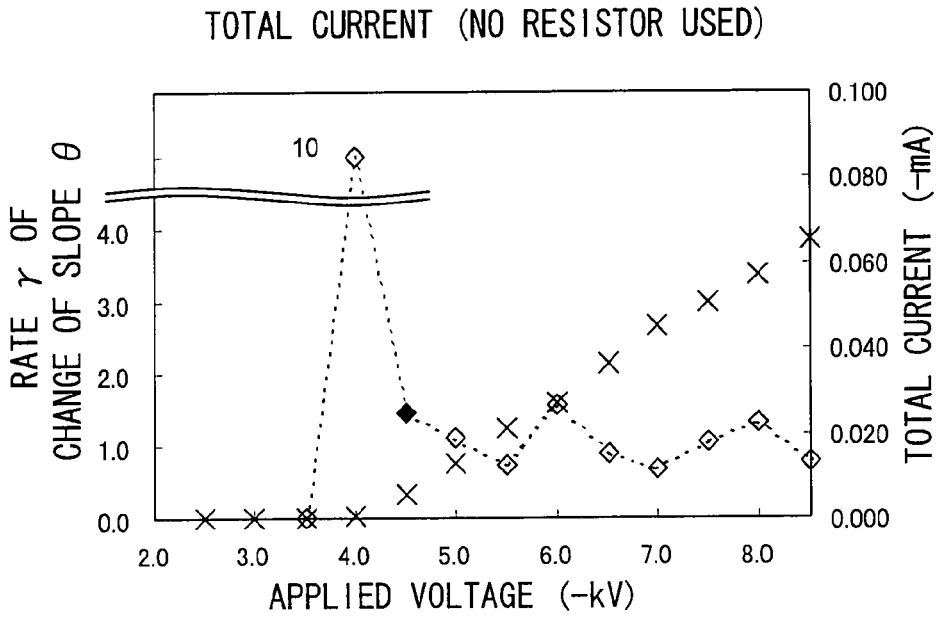

FIG. 19(*a*) is a graph showing the relationship (see FIG. 11(*a*)) between the applied voltage and the quantity of produced ozone, as well as the rate β of change in the rate α of increase of the quantity of produced ozone to increase of the applied voltage.

The rate α of increase of the quantity of produced ozone O to the applied voltage V at a measurement point n is given by $\alpha_n=(O_n-O_{n-1})/(|V_n|-|V_{n-1}|)$. The rate β of change in the rate a of increase of the quantity of produced ozone to the applied voltage at the measurement point is as follows: $\beta_n=\alpha_{n+1}/\alpha_n$. If the calculation for the rate β of change involved division by zero, the rate β of change=0. The value of the measurement point n is 0 when the applied voltage is 0, and is increased by 1 every time the applied voltage is increased by 500 V. The measurement was carried out in an applied voltage range from (i) an applied voltage (ozone production threshold voltage; −4.5 kV in the case of FIG. 19(*a*)) at a measurement point at which ozone is detected for the first time since the start of increasing the applied voltage, to (ii) an applied voltage twice as large as the ozone production threshold voltage (reached −9.0 kV in the case of FIG. 19(*a*)).

In the present specification, in cases where no fixed resistor 24 is inserted, the ozone production surge threshold voltage is defined as a voltage at which the rate β of change is maximum in the above applied voltage range. However, when the rate β of change at the ozone production threshold voltage is equal to or greater than twice as large as the average of the rate β of change in an applied voltage range from an applied voltage larger than the ozone production threshold voltage to a voltage equal to or smaller than twice as large as the ozone production threshold voltage, the ozone production threshold voltage is defined as a voltage obtained by adding the aforementioned predetermined value to the ozone production threshold voltage. Therefore, the experimental results give an ozone production surge threshold voltage of −4.5 kV, as shown in FIG. 19(*a*), which equals the ozone production threshold voltage.

As shown in FIG. 19(*a*), the charging subject is charged by ions while ozone production is restrained, as long as the applied voltage Va to the negative ion production element 20*a* is higher than or equal to the charge threshold voltage (here, 3.75 kV) and lower than the ozone production threshold voltage (here, 4.5 kV).

FIG. 19(*b*) is a graph showing relationship between the applied voltage and the total current shown in FIG. 11(*a*), as well as the rate γ of change in the rate $\theta_m$ of increase of the total current to increase of the applied voltage.

The rate θ of increase of the total current It to the applied voltage V at a measurement point m is given by $\theta_m=(It_m-It_{m-1})/(|V_m|-|V_{m-1}|)$. The rate γ of change in the rate θ of increase of the total current It to the applied voltage V is found as follows: $\gamma_m=\theta_{m+1}/\theta_m$. If the calculation for the rate γ of change involved division by zero, the rate γ of change=0. The value of the measurement point m is 0 when the applied voltage is 0, and is increased by 1 every time the applied voltage is increased by 500 V. The measurement was carried out in an applied voltage range from (i) an applied voltage (current occurrence threshold voltage; −4.0 kV in the case of FIG. 19(*b*)) at a measurement point at which the total current is detected for the first time since the start of increasing the applied voltage, to (ii) an applied voltage twice as large as the current occurrence threshold voltage (−8.0 kV in the case of FIG. 19(*b*)).

In the present specification, in cases where no fixed resistor 24 is inserted, the total-current surge threshold voltage is defined as a voltage at a measurement point at which the rate γ of change is maximum in the aforementioned applied voltage range. However, when the rate γ of change at the current occurrence threshold voltage is equal to or larger than twice the average value of the rate γ of change in an applied voltage range from (i) a voltage more than the current occurrence threshold voltage to (ii) a voltage twice as large as the current occurrence threshold voltage, the total-current surge threshold voltage is defined as a voltage obtained by adding the predetermined value to the current occurrence threshold voltage. Therefore, the total-current surge threshold voltage in the experiment results is −4.5 kV and is equal to the current occurrence threshold voltage as shown in FIG. 19(*b*).

As shown in FIG. 19(*a*), the charging subject is charged by ions while increase in the total current is restrained, as long as the applied voltage Va to the negative ion production element 20*a* is higher than or equal to the charge threshold voltage (here, 3.75 kV) and lower than the total-current surge threshold voltage (here, 4.5 kV).

In contrast, referring to FIG. 10(*b*), when the fixed resistor 24 is inserted, the charge threshold voltage was −4.5 kV. As the applied voltage was further increased, the absolute value of the surface potential $V_0$ increased according to the applied voltage.

Figure 20:
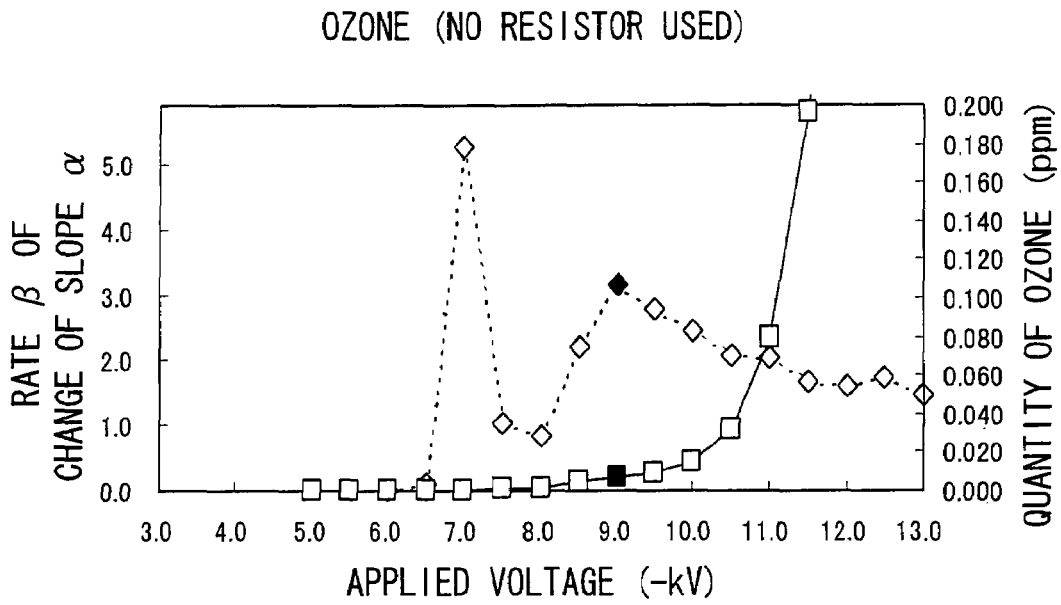
FIG. 20(*a*) is a graph representing the relationship between the applied voltage and the quantity of produced ozone (see FIG. 11(*a*)), as well as the rate β of change in the rate a of increase of the quantity of produced ozone to increase of the applied voltage.
Figure 20:
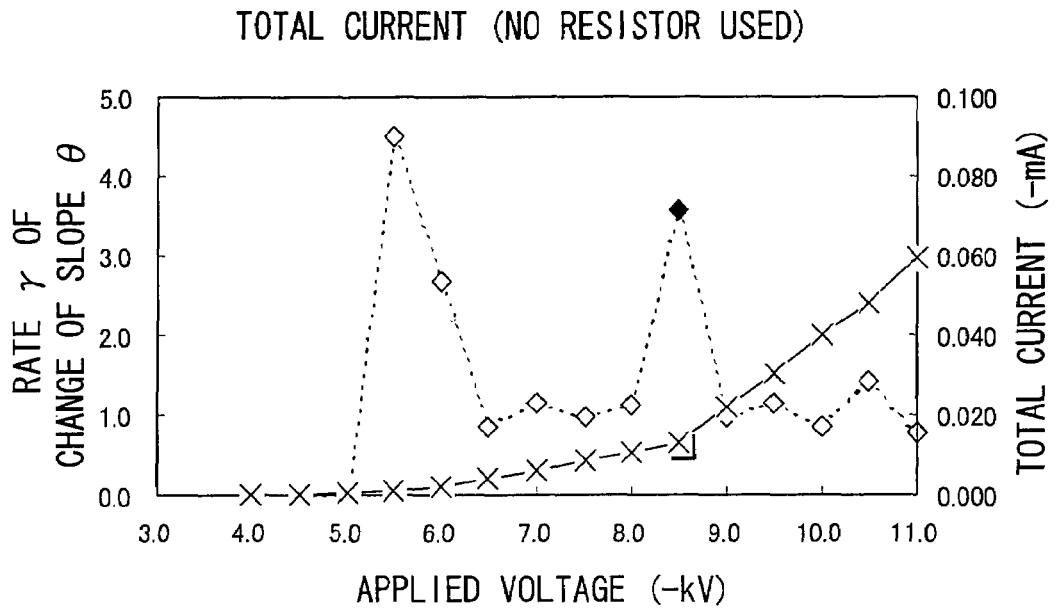

FIG. 20(*a*) is a graph showing the relationship (see FIG. 11(*b*)) between the applied voltage and the quantity of produced ozone, as well as the rate β of change in the rate a of increase of the quantity of produced ozone to increase of the applied voltage.

In the present specification, in cases where the fixed resistor 24 is inserted, the ozone production surge threshold voltage is defined as a voltage at a measurement point at which the rate β of change is the largest local maximal value in the applied voltage range from a voltage larger than the ozone production threshold voltage to a voltage twice as large as the ozone production threshold voltage. Therefore, the experimental results give an ozone production surge threshold voltage of 9.0 kV (Va=−9.0 kV), as shown in FIG. 20(*a*).

As shown in FIG. 20(*a*), even when the resistor is inserted, the charging subject is charged while ozone production is restrained, as long as the applied voltage Va to the negative ion production element 20*a* is higher than or equal to the charge threshold voltage (here, 4.5 kV) and lower than the ozone production surge threshold voltage (here, 9.0 kV).

FIG. 20(*b*) is a graph showing relationship (see FIG. 11(*b*)) between the applied voltage and the total current, as well as the rate γ of change in the rate θ of increase of the total current to increase of the applied voltage.

In the present specification, in cases where the fixed resistor 24 is inserted, the total-current surge threshold voltage is defined as a voltage at which the rate γ of change is the largest local maximal value in the applied voltage range from a voltage larger than the current occurrence threshold voltage to twice the current occurrence threshold voltage. Therefore, the experimental results give an ozone production surge threshold voltage of −8.5 kV as shown in FIG. 16(*b*).

As shown in FIG. 20(*b*), the charging subject is charged by ions while increase in the total current is restrained, as long as the applied voltage Va to the negative ion production element 20*a* is higher than or equal to the charge threshold voltage (here, 4.5 kV) and lower than the total-current surge threshold voltage (here, 8.5 kV).

In the case where the fixed resistor 24 was thus inserted, both the ozone production surge voltage and the total-current surge threshold voltage were shifted to become higher as compared with the case where no fixed resistor 24 was inserted. This is because the fixed resistor 24 caused voltage drop, with the result that the respective values of the charge threshold voltage, the ozone production surge voltage, and the total-current surge threshold voltage became higher by the voltage thus dropped. Note that almost no current flew in Experiment 2; however, a current slightly flew through each of the grid electrode 26 and the photoconductor drum 1 in the present experiment. This was an exhibition of an effect of the voltage drop caused by the fixed resistor 24.

As shown in FIG. 11(*a*) and FIG. 11(*b*), the respective amounts of shift of the ozone production surge threshold voltage and the total-current surge threshold voltage were larger than the amount of shift of the charge threshold voltage. The amount of shift of the charge threshold voltage refers to a difference between (i) the charge threshold voltage obtained in the case where the fixed resistor 24 was inserted and (ii) the charge threshold voltage obtained in the case where no fixed resistor 24 was inserted. As a result, charging without any surge of the quantity of produced ozone is attained by an applied voltage falling within the 4.5 kV range (4.5 kV≦|Va|≦9.0 kV), which is wider than the 0.75 kV range (3.75 kV≦|Va|<4.5 kV) obtained in cases where no fixed resistor 24 is inserted. Likewise, in cases where the fixed resistor 24 is inserted, charging without any surge of the total current is attained by an applied voltage falling within the 4.0 kV range (4.5 kV≦|Va|≦8.5 kV), which is wider than the 0.75 kV range (3.75 kV≦|Va|<4.5 kV) obtained in cases where no fixed resistor 24 is inserted.

A conceivable reason for this is as follows. See FIG. 11(*a*) and FIG. 11(*b*). While the applied voltage was small, the total current It was small (several μA), so that the voltage drop caused by the fixed resistor 24 was small (several hundred V). However, while the applied voltage was increased, the total current It was increased rapidly (several ten μA), so that the voltage drop caused by the fixed resistor 24 became large (several kV).

The ozone production surge threshold voltage and the total-current surge threshold voltage differed between the case where the fixed resistor 24 was inserted and the case where it was not, presumably for the following reasons.

The total current and the ozone production are greatly affected by the electric field intensity between the ion generation needles 21 and the photoconductor drum 1. That electric field intensity is in proportion to the voltage between the ion generation needles 21 and the photoconductor drum 1 and in inverse proportion to the interval (distance) between the ion generation needles 21 and the photoconductor drum 1.

With the fixed resistor 24 being inserted, the total current starts to flow when the applied voltage is 5.5 kV. The total current and the quantity of produced ozone increase in proportion to the applied voltage under restrictions, such as (i) the spatial impedance between the ion generation needles 21 and the photoconductor drum 1 and (ii) the inserted fixed resistor 24 (first proportional increase). When the applied voltage exceeds an inflection point at which the quantity of produced ozone increases abruptly, the spatial impedance is changed by the effect of the ozone, with the result that the total current and the quantity of produced ozone increase in proportion to the applied voltage with different proportionality factors from the first proportional increase (second proportional increase). Therefore, the rates β and γ of change at that inflection point are the local maximal values.

In contrast, with no fixed resistor 24 being inserted, the total current starts to flow when the applied voltage is 4.0 kV. Since there is no fixed resistor 24 causing a voltage drop, there is an inflection point near the applied voltage of 4.0 kV at which the total current and the quantity of produced ozone increase abruptly. Therefore, no first proportional increase was observed in experimental results; only the second proportional increase was observed.

Therefore, in the present embodiment, in cases where the rate β of change at the ozone production threshold voltage is greater than or equal to twice the average of the rate β of change in a range from a voltage larger than the ozone production threshold voltage to a voltage twice as large as the ozone production threshold voltage, the ozone production surge threshold voltage is defined as a voltage obtained by adding the predetermined value (the foregoing constant value by which the voltage applied to the ion generation needles 21 is gradually increased) to the ozone production threshold voltage. Also, if the rate γ of change at the current occurrence threshold voltage is greater than or equal to twice the average of the rate γ of change in a range from a voltage larger than the current occurrence threshold voltage to a voltage twice as large as the current occurrence threshold voltage, the current surge threshold voltage is defined as a voltage obtained by adding the predetermined value (the foregoing constant value by which the voltage applied to the ion generation needles 21 is gradually increased) to the current occurrence threshold voltage.

If the first proportional increase and the second proportional increase, and thus the inflection point, are appropriately identifiable with no fixed resistor 24 being inserted, the ozone production surge threshold voltage and the current surge threshold voltage may be defined the same way as they are defined when the fixed resistor 24 is inserted. The first proportional increase and the second proportional increase would be appropriately identifiable by, for example, setting the difference between the applied voltage values at the measurement points to a suitable value (for example, 250 V to 1000 V).

[Experiment 5]

Next, experiment was carried out with the use of the aforementioned experimental device shown in FIG. 8, so as to find a condition under which charging process can be carried out while avoiding rapid increases in the quantity of produced ozone and total current. In the experiment, the applied voltage to the negative ion production element 20*a*, and the gap g between each of the ion generation needles 21 and the photoconductor drum 1 were parameters. The experiment was carried out under such conditions that the applied voltage to the grid electrode 26 was set at −700V. Moreover, the experiment was carried out with and without the fixed resistor 24.

Figure 21:
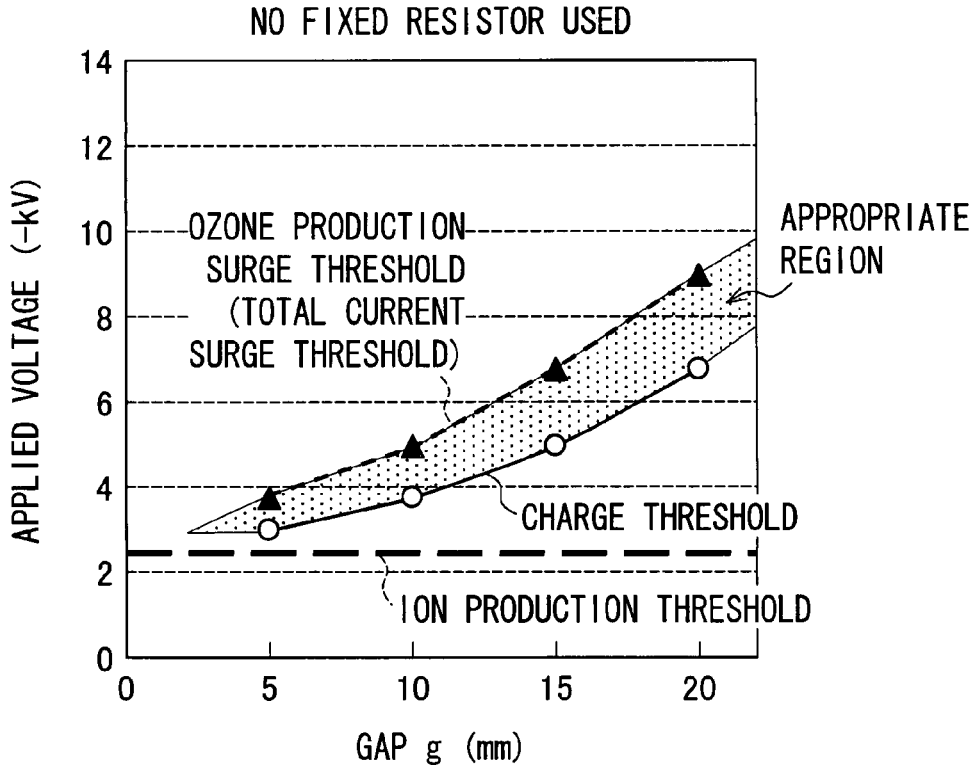
FIG. 21(*a*) illustrates a case where no fixed resistor is inserted.
Figure 21:
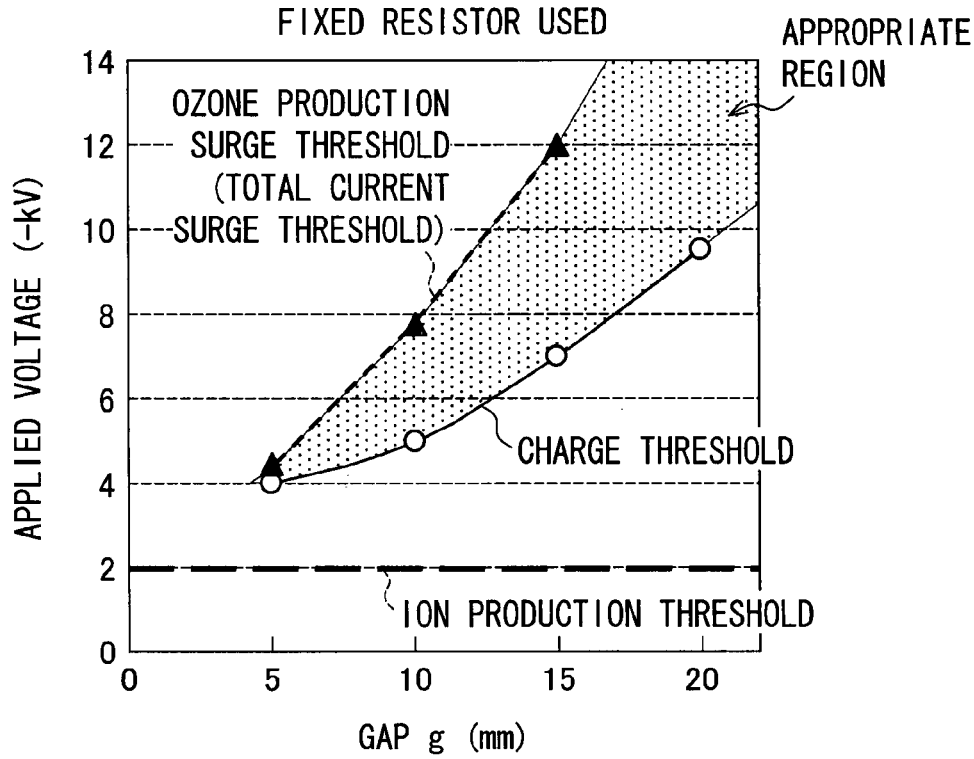

FIG. 21(*a*) is a graph illustrating a result of the measurement carried out in the case where no fixed resistor 24 was inserted. FIG. 21(*b*) is a graph illustrating a result of the measurement carried out in the case where the fixed resistor 24 is inserted.

An ozone production surge threshold curve (or total-current surge threshold curve) in each of FIG. 21(*a*) and FIG. 21(*b*) represents a relation between an applied voltage Va and the gap g when the quantity of produced ozone (or total-current) is started to be rapidly increased. In other words, the ozone production surge threshold curve (or total current surge threshold curve) therein represents ozone production surge threshold voltages (or total current surge threshold voltages) respectively corresponding to lengths of the gap g. Also, it is possible to say that the ozone production surge threshold curve (or total-current surge threshold curve) represents ozone production surge threshold distances (or total-current surge threshold distances) respectively corresponding to applied voltages Va.

Likewise, a charge threshold curve in each of FIG. 21(*a*) and FIG. 21(*b*) represents a relation between an applied voltage Va and the gap g when the photoconductor drum 1 is started to be charged. In other words, the charge threshold curve therein represents charge threshold voltages respectively corresponding to lengths of the gap g, and also represents charge threshold distances respectively corresponding to applied voltages Va.

A region between the ozone production surge threshold curve (or total current surge threshold curve) and the charge threshold curve represents respective conditions of the applied voltage Va and the gap g, under which conditions ions were produced without causing any rapid increase in the quantity of produced ozone (or the total current) and the photoconductor drum 1 was actually charged by the ions. This region is hereinafter referred to as "appropriate region".

Further, an ion production threshold straight line shown in each of FIG. 21(*a*) and FIG. 21(*b*) represents a relation between an applied voltage Va and the gap g when ions are started to be generated. From FIG. 21(*a*) and FIG. 21(*b*), it is apparent that the ion production threshold voltage did not depend on the gap g but was constant.

As shown in FIG. 21(*a*) and FIG. 21(*b*), when the gap g was smaller than 4 mm, there was not existed any applied voltage region in which the charging was attained without rapid increases in the quantity of produced ozone and total current (there was substantially no difference between the charge threshold voltage and the ozone production surge threshold voltage). As soon as the applied voltage was increased, the corona discharge occurred. However, the applied voltage region in which the charging was attained by ions without rapid increases in the quantity of produced ozone and total current came into existence when the gap g was 4 mm or longer. As the gap g was longer, the applied voltage region (appropriate region) in which the charging was attained by ions without rapid increases in the quantity of produced ozone and total current became wider. Further, the appropriate region obtained in the case where the fixed resistor 24 was inserted was wider than that in the case where no fixed resistor 24 was inserted.

According to the result of the experiment, it was found that the gap g needed to be 4 mm or greater such that neither the quantity of produced ozone nor the total current rapidly increased and the charging was attained only by ions. Further, according to the result of Experiment 1 described above (see FIG. 7), the quantity (density) of negative ions reaching the photoconductor drum 1 was reduced as the gap g was larger. When the gap g was smaller than 25 mm, the quantity was equal to or smaller than the half of the quantity obtained when the gap g was 5 mm. For this reason, in order to appropriately charge a charging subject such as the photoconductor drum 1, it is preferable that the gap g be not less than 5 mm but be not more than 25 mm.

Note that: in the conventional corona discharge type charging device disclosed in Citation 4 and using the needle-shaped electrode, the discharge current is reduced by setting the gap g at 4 mm or smaller, so that the rapid increase in the quantity of produced ozone is inevitable. Therefore, the ozone quantity reduction effect allowed by the technique of Citation 4 is much smaller than the ozone quantity reduction effect allowed by the present invention.

[Experiment 6]

Next, by using the primary pretransfer charging device 2 (latent image charging device 4) shown in FIG. 3 and FIG. 4, experiment was conducted to measure a surface potential of the photoconductor drum 1 and a quantity of ozone, each obtained when changing the length of the gap g from 3 mm to 30 mm. The experiment was carried out with and without the shield 23. Table 6 shows results of the measurement. The same devices and the same methods are used to measure the surface potential and the quantity of ozone as those used in each of the foregoing experiments. The shield was made of insulating ABS resin, and was floating.

TABLE 6

| | Gap g | Applied voltage | Grid voltage | Shield | Surface Potential | Quantity of ozone |
|---|---|---|---|---|---|---|
| Comparative Example 1-1 | 3 mm | −4 kV | −900 V | Not provided | −600 V | 0.09 ppm |
| Example 1-1 | 4 mm | −4 kV | −900 V | Not provided | −605 V | 0.002 ppm |
| Example 1-2 | 10 mm | −6.5 kV | −900 V | Not provided | −602 V | 0.001 ppm |
| Example 1-3 | 25 mm | −12 kV | −900 V | Not provided | −600 V | ≈0 ppm |
| Example 1-4 | 30 mm | −15 kV | −900 V | Provided | −595 V | ≈0 ppm |
| Comparative Example 1-2 | 30 mm | −15 kV | −900 V | Not Provided | −425 V | ≈0 ppm |

As shown in Table 6, when the gap was 3 mm (Comparative Example 1-1), the quantity of produced ozone was so large as to be 0.09 ppm. In contrast, when the gap g was 4 mm or longer (Example 1-1 to Example 1-4), the quantity of produced ozone was so small as to be 0.002 ppm or less. A reason of this lies in that: when the gap g was 3 mm or smaller, there was no condition under which the photoconductor was charged by ions without rapid increases in the quantity of produced ozone and total current, so that the photoconductor was charged by corona discharge. In contrast, when the gap g was 4 mm or smaller, there was a condition under which the photoconductor drum 1 could be charged by ions without rapid increases in the quantity of produced ozone and total current.

Further, in cases where no shield was provided and the gap was in the range 4 mm≦g≦25 mm (Example 1-1 to Example 1-3), the photoconductor drum 1 could be charged to have a target surface potential of −600 V. In this case, the applied voltage Va fell within the following range: 4 kV≦Va≦12 kV. However, when the applied voltage was increased up to 15 kV under conditions that the gap g was 30 mm (Comparative Example 1-2), the surface potential of the photoconductor drum 1 reached only −425 V, which was less than the target surface potential −600 V. A reason for this lies in that: the negative ions were spread wider as the gap g becomes larger, with the result that the density of negative ions reaching the photoconductor drum 1 was decreased.

In contrast, in cases where the shield 23 was provided (Example 1-4) and the gap g was 30 mm, the photoconductor drum 1 was so charged with an applied voltage of 15 kV as to have substantially the target surface potential. A reason for this lies in that the shield 23 restrains negative ions from being spread, with the result that the density of negative ions was increased in the vicinity of the photoconductor drum 1 and utilization efficiency of the negative ions was accordingly increased.

[Experiment 7]

Next, a toner image charging characteristic of the secondary pretransfer charging device 3 was measured.

The experiment was carried out in the following manner. A voltage to be applied to the ion generation needle 21 of the secondary pretransfer charging device 3 was gradually increased within such a range that the voltage never caused corona discharge, so as to charge a toner image formed on the intermediating transfer belt 15 (a transfer belt of a Sharp-made color copy machine ARC-280 was used). A current Ib flowing through the intermediating transfer belt 15 upon the charging, and a charge amount that the toner had after the charging were measured. Note that the toner image was a solid image having a toner adhesion amount of 0.55 mg/cm$^2$. Results of the experiment are shown in FIG. 13.

As shown in FIG. 13, in an initial state in which no voltage was applied to the secondary pretransfer charging device 3, the current Ib was 0 and the toner image had a charge amount of 12.8 mC/g. Then, as the absolute value of the applied voltage Va was increased, the amount of generated negative ions was increased, with the result that the current Ib and the absolute value of the charge amount of the toner image were increased. However, when the absolute value of the current Ib was 30 mA or greater, the charge amount of the toner image was saturated substantially at −19 mC/g.

The results confirmed that the charge amount of the toner image became stable to be −19 mC/g by controlling the voltage Va, which was to be applied to the ion generation needle 21 of the high-voltage power supply 25, such that the voltage Va allowed |Ib|≧30. Thus, even when no grid electrode 26 or the like was provided, it was understood that the charge amount of the toner image could be uniformized.

Therefore, the voltage control section 31 monitors the current IB while increasing the applied voltage Va from the high-voltage power supply 25 step by step, so as to find an applied voltage Va causing the current Ib to be −30 mA, and carries out feedback control of the applied voltage Va from the high-voltage power supply 25 such that the current Ib becomes a current of −30 mA. This makes it possible to always give an optimum amount of ions to the toner image even when the quantity of generated negative ions and the rate of generated ions reaching the toner image are fluctuated due to (a) adhesion of a foreign substance to the tip of the ion generation needle 21, (b) a change of an environmental condition, and (c) a change of a flow of wind in the image forming apparatus 100, and/or the like.

Note that the method of controlling the applied voltage may be: (1) a method of supplying a current of −30 μA from a constant current control high-voltage power supply 25 that is generally and widely used; or (ii) a method of supplying a current of −30 μA from a low voltage control high-voltage power supply 25.

[Experiment 8]

Next, six toner images were prepared which were different in terms of image patterns and environmental conditions. Secondary pretransfer charging was carried out with respect to each of the toner images with the use of the secondary pretransfer charging device 3, in which the applied voltage Va was so controlled by the feedback control of the voltage control section 31 as to allow the current Ib to be −30 mA. The charge amount of each of the toner images had before the charging, and the charge amount of each of the toner images had after the charging were measured. Results thereof are shown in FIG. 14.

As shown in FIG. 14, before the charging, the respective charge amounts of the toner images were fluctuated within an approximately 3 mC/g range, i.e., were fluctuated within a range from −12 mC/g to −15 mC/g. After the charging, the charging amounts were converged in an approximately 1 mC/g range, i.e., were converged in a range from −18 mC/g to −19 mC/g.

This proved the effectiveness of the secondary pretransfer charging device 3 including the voltage control section 31 that carries out the aforementioned feedback control.

[Experiment 9]

Carried out next was comparison between (i) secondary transfer efficiency obtained in cases where the secondary pretransfer charging was carried out with the use of the secondary pretransfer charging device 3 and (ii) secondary transfer efficiency obtained in cases where no secondary pretransfer charging was carried out. Results thereof are shown in FIG. 15.

As shown in FIG. 15, the secondary pretransfer charging thus carried out increased (i) the transfer efficiency by 5% to 10%, and (ii) a latitude (degree of margin in transfer). This proved the effectiveness of the secondary pretransfer charging carried out by the secondary pretransfer charging device 3.

As described above, each of the primary pretransfer charging device 2, the secondary pretransfer charging device 3, and the latent image charging device 4 of the present embodiment does not cause corona discharge but allows generation of negative ions, so that these charging devices make it possible to prevent the various problems from occurring due to the corona discharge. Moreover, these charging devices are capable of charging the photoconductor drum 1, or of carrying out pretransfer charging with respect to a toner image formed on the photoconductor drum 1 or the intermediating transfer belt 15.

Note that the specific values described in the present embodiment are mere examples, so that the present invention is not limited to these values.

For example, the applied voltage from the high-voltage power supply (first voltage application means) 25 to the ion generation needle (charging electrode) 21 may be equal to or larger than the ion production threshold voltage, and be smaller than the ozone production surge threshold voltage or the total-current surge threshold voltage. With this, the ion generation needle 21 allows generation of ions, thereby charging a charging subject. Further, no corona discharge is caused, so that it is possible to solve the various problems occurring due to the corona discharge.

Note that the wording "ion production threshold voltage" refers to an applied voltage at which ions begin to be detected (the number of ions begins to be changed) by the ion meter AIC-2000 that is positioned 150 mm away from the tip of the ion generation needle (charging electrode) 21 and that is available from Sato Shoji Corporation. Specifically, the wording "ion production threshold voltage" refers to a voltage, which is found by increasing the applied voltage and by which the quantity of ions measured by the ion meter is raised as shown in the graph of FIG. 6.

Further, it is preferable that the aforementioned applied voltage be equal to or larger than the charge threshold voltage shown in FIG. 12(*a*) and FIG. 12(*b*). This makes it possible to actually charge the charging subject such as the photoconductor drum 1 and the toner image.

Further, the wording "charge threshold voltage" refers to a minimum applied voltage at which ions generated by the ion generation needle 21 causes actual change of the charge amount of the charging subject such as the photoconductor drum 1 and the toner image, under conditions that there is provided a certain gap g therebetween.

Further, as described in Experiment 7, it is preferable that the aforementioned applied voltage be such a voltage that saturates the charge amount of the toner image, which is the charging subject. With this, even when ions are generated unevenly, the charge amount that the toner image has after the charging is uniformized, with the result that transfer of the toner image can be carried out suitably. Further, it is allowed that no grid electrode is provided, so that ions are never caught by the grid electrode. This allows (i) improvement of ion utilization efficiency, and (ii) restraint of manufacturing cost.

Meanwhile, focusing attentions on the gap g, the gap g may be longer than either the ozone production surge threshold distance or the total-current surge threshold distance. With this, the quantity of produced ozone is never increased rapidly, so that the various problems occurring due to the corona discharge can be solved.

Further, it is preferable that the gap g be equal to or shorter than the charge threshold distance shown in FIG. 12(*a*) and FIG. 12(*b*). This makes it possible to actually charge the charging subject such as the photoconductor drum 1 and the intermediating transfer belt 15.

Note that the wording "charge threshold distance" refers to the longest distance (gap), which is between the tip of the ion generation needle 21 and the charging subject such as the photoconductor drum 1 and the toner image and which causes actual change of the charge amount of the charging subject.

Note that it is preferable that the gap g be not less than 4 mm but not more than 25 mm. When the gap g is 4 mm or longer, the applied voltage region, in which no corona discharge occurs but ions can be generated, comes into existence as described in Experiment 5. Further, when the gap g is 25 mm or shorter, not less than the half of the negative ions generated by the ion generation needle 21 can reach the charging subject as described in Experiment 1. This makes it possible to carry out charging efficiently.

Further, in the present embodiment, the fixed resistor (electric resistor) 24 is inserted between the charging electrode and the high-voltage power supply (voltage application means) 25 for applying a voltage to the charging electrode. The fixed resistor 24 thus inserted makes it possible to widen an applied voltage range and a gap range (appropriate region), each of which does not cause discharge but allows only the ions to charge the charging subject, as described in Experiment 5. However, the fixed resistor 24 does not need to be inserted necessarily, and therefore may not be provided. Further, the resistance of the fixed resistor 24 is not particularly limited and may be arbitrarily set such that the applied voltage range and the gap range, each of which does not cause the discharge but allows only the ions to charge the charging subject, are widen so as to allow for stable emission of ions.

Further, in the present embodiment, the shield (ion spread prevention member) 23 is provided so as to surround the ion generation needle (charging electrode) 21. Ions generated in response to voltage application to the ion generation needle 21 are moved toward the charging subject along the electric flux line; however not all the ions go toward the charging subject and some ions spread in a direction different from the direction toward the charging subject because the generated electric field is weaker than that in the conventional corona discharge type charging device. Therefore, by providing the shield 23 such that the ion generated needle 21 is surrounded by the shield 23, it is possible to prevent the ions from spreading, thereby improving the ion utilization efficiency and restraining the members around the charging device from being charged unnecessarily.

Further, the needle-shaped electrode (ion generation needle 21) is used as the charging electrode in the present embodiment. This makes it possible to form a high electric field with the use of a low voltage, as compared with the case where a line-shaped or a saw-tooth electrode is used as the discharging electrode as with the conventional and general corona discharge type charging device. As a result, a large quantity of ions can be generated by using an applied voltage smaller than the corona discharge threshold voltage.

Note that, in the present embodiment, the needle-shaped electrode (the ion generation needle 21) having an acute tip is used as the charging electrode. This makes it possible to form a high electric field with a low voltage, as compared with the case where a wire-shaped or saw-tooth electrode is used as a discharging electrode as is the case with the conventional and general corona discharge type charging device.

As described above, a pretransfer charging device, according to the present invention, for charging a toner image formed on an image carrier of an image forming apparatus, prior to transfer of the toner image to a transfer target object includes: a charging electrode, provided face to face with the image carrier; and a first voltage application means for applying, to the charging electrode, a voltage that is not less than an ion production threshold voltage but is less than a corona discharge threshold voltage.

Further, a pretransfer charging method, according to the present invention, for charging a toner image formed on an image carrier of an image forming apparatus, prior to transfer of the toner image to a transfer target object includes the step of applying, to a charging electrode provided face to face with the image carrier, a voltage that is not less than an ion production threshold voltage but is less than a corona discharge threshold voltage.

Further, a pretransfer charging device, according to the present invention, for charging a toner image formed on an image carrier of an image forming apparatus, prior to transfer of the toner image to a transfer target object includes: a charging electrode, provided face to face with the image carrier; and first voltage application means for applying, to the charging electrode, a voltage not less than an ion production threshold voltage, an interval between the image carrier and the charging electrode being longer than a corona discharge threshold distance.

Further, a pretransfer charging method, according to the present invention, for charging a toner image formed on an image carrier of an image forming apparatus, prior to transfer of the toner image to a transfer target object includes the step of applying a voltage not less than an ion production threshold voltage, to a charging electrode provided face to face with the image carrier such that an interval between the charging electrode and the image carrier is longer than a corona discharge threshold distance.

Further, a pretransfer charging device, according to the present invention, for charging a toner image formed on an image carrier of an image forming apparatus, prior to transfer of the toner image to a transfer target object includes: a charging electrode, provided face to face with the image carrier; and first voltage application means for applying, to the charging electrode, a voltage that is not less than an ion production threshold voltage but is less than an ozone production surge threshold voltage, which causes start of rapid increase of a quantity of produced ozone.

Further, a pretransfer charging device, according to the present invention, for charging a toner image formed on an image carrier of an image forming apparatus, prior to transfer of the toner image to a transfer target object includes: a charging electrode, provided face to face with the image carrier, the transfer target object being charged by ions generated by applying, to the charging electrode, a voltage that is not less than an ion production threshold voltage but is less than an ozone production surge threshold voltage, which causes start of rapid increase of a quantity of produced ozone.

Further, a pretransfer charging method, according to the present invention, for charging a toner image formed on an image carrier of an image forming apparatus, prior to transfer of the toner image to a transfer target object includes the step of applying, to a charging electrode provided face to face with the image carrier, a voltage that is not less than an ion production threshold voltage but is less than an ozone production surge threshold voltage, which causes start of rapid increase of a quantity of produced ozone.

Further, a pretransfer charging method, according to the present invention, for charging a toner image formed on an image carrier of an image forming apparatus, prior to transfer of the toner image to a transfer target object, includes the step of charging the transfer target object by using ions generated by applying, to a charging electrode provided face to face with the image carrier, a voltage that is not less than an ion production threshold voltage but is less than an ozone surge threshold voltage, which causes rapid increase of a quantity of produced ozone.

Further, a pretransfer charging device, according to the present invention, for charging a toner image formed on an image carrier of an image forming apparatus, prior to transfer of the toner image to a transfer target object includes: a charging electrode, provided face to face with the image carrier; and first voltage application means for applying, to the charging electrode, a voltage not less than an ion production threshold voltage, an interval between the image carrier and the charging electrode being longer than an ozone production surge threshold distance, which causes start of rapid increase of a quantity of produced ozone.

Further, a pretransfer charging method, according to the present invention, for charging a toner image formed on an image carrier of an image forming apparatus, prior to transfer of the toner image to a transfer target object includes the step of applying a voltage not less than an ion production threshold voltage, to a charging electrode provided face to face with the image carrier such that an interval between the charging electrode and the image carrier is longer than an ozone production surge threshold distance, which causes start of rapid increase of a quantity of produced ozone.

It is preferable that the ozone production surge threshold distance be a distance, by which the voltage to be applied from the first voltage application means to the charging electrode becomes an ozone production surge threshold voltage that causes the start of rapid increase of the quantity of produced ozone.

Further, it is preferable that: in cases where no fixed resistor is inserted between the first voltage application means and the charging electrode and where the voltage to be applied to the charging electrode is increased by a predetermined value at a time, the ozone production surge threshold voltage be an applied voltage, at which a rate of change in a rate of (i) increase of the quantity of produced ozone to (ii) the applied voltage is maximum in an applied voltage range from (a) the ozone production threshold voltage to (b) a voltage not more than a voltage twice as large as the ozone production threshold voltage, the ozone production threshold voltage being an applied voltage at which ozone starts to be produced; in cases where the rate of change at the ozone production threshold voltage is not less than twice an average of the rate of change in an applied voltage range from (i) a voltage larger than the ozone production threshold voltage to (ii) a voltage not more than a voltage twice as large as the ozone production threshold voltage, the ozone production surge threshold voltage be a voltage larger than the ozone production threshold voltage by the predetermined value; and in cases where a fixed resistor is inserted between the first voltage application means and the charging electrode and where the voltage to be applied to the charging electrode is increased by the predetermined value at a time, the ozone production surge threshold voltage be an applied voltage, at which the rate of change in the rate of (i) increase of the quantity of produced ozone to (ii) the applied voltage is a largest local maximal value in an applied voltage range from (a) a voltage larger than the ozone production threshold voltage to (b) a voltage not more than a voltage twice as large as the ozone production threshold voltage, the ozone production threshold voltage being an applied voltage at which ozone starts to be produced.

Further, a pretransfer charging device, according to the present invention, for charging a toner image formed on an image carrier of an image forming apparatus, prior to transfer of the toner image to a transfer target object includes: a charging electrode, provided face to face with the image carrier; and first voltage application means for applying, to the charging electrode, a voltage that is not less than an ion production threshold voltage but is less than a current surge threshold voltage, which causes start of rapid increase of current flowing in the charging electrode.

Further, a pretransfer charging method, according to the present invention, for charging a toner image formed on an image carrier of an image forming apparatus, prior to transfer of the toner image to a transfer target object includes the step of applying, to a charging electrode provided face to face with the image carrier, a voltage that is not less than an ion production threshold voltage but is less than a current surge threshold voltage, which causes start of rapid increase of current flowing in the charging electrode (i.e., current to be supplied from the first voltage application means to the charging electrode; the same holds true for descriptions below).

Further, a pretransfer charging device, according to the present invention, for charging a toner image formed on an image carrier of an image forming apparatus, prior to transfer of the toner image to a transfer target object includes: a charging electrode, provided face to face with the image carrier; and first voltage application means for applying, to the charging electrode, a voltage not less than an ion production threshold voltage, an interval between the image carrier and the charging electrode being longer than a current surge threshold distance, which causes start of rapid increase of current flowing in the charging electrode.

Further, a pretransfer charging method, according to the present invention, for charging a toner image formed on an image carrier of an image forming apparatus, prior to transfer of the toner image to a transfer target object includes the step of applying a voltage not less than an ion production threshold voltage, to a charging electrode provided face to face with the image carrier such that an interval between the charging electrode and the image carrier is longer than a current surge threshold distance, which causes start of rapid increase of current flowing in the charging electrode.

It is preferable that the current surge threshold distance be a distance, by which the voltage to be applied from the first voltage application means to the charging electrode becomes a current surge threshold voltage that causes the start of rapid increase of the current flowing in the charging electrode.

It is preferable that: in cases where no fixed resistor is inserted between the first voltage application means and the charging electrode and where the voltage to be applied to the charging electrode is increased by a predetermined value at a time, the current surge threshold voltage be an applied voltage, at which a rate of change in a rate of (i) increase of the current to (ii) the applied voltage is maximum in an applied voltage range from (a) a current occurrence threshold voltage to (b) a voltage not more than a voltage twice as large as the current occurrence threshold voltage, the current occurrence threshold voltage being an applied voltage at which the current starts to flow in the charging electrode; in cases where the rate of change at the current occurrence threshold voltage is not less than twice an average of the rate of change in an applied voltage range from (i) a voltage larger than the current occurrence threshold voltage to (ii) a voltage not more than a voltage twice as large as the current occurrence threshold voltage, the current surge threshold voltage be an applied voltage larger than the current occurrence threshold voltage by the predetermined value; and in cases where a fixed resistor is inserted between the first voltage application means and the charging electrode and where the voltage to be applied to the charging electrode is increased by the predetermined value at a time, the current surge threshold voltage be an applied voltage, at which the rate of change in the rate of (i) increase of the current flowing in the charging electrode to (ii) the applied voltage is a largest local maximal value in an applied voltage range from (a) a voltage more than the current occurrence threshold voltage to (b) a voltage not more than a voltage twice as large as the current occurrence threshold voltage, the current occurrence threshold voltage being an applied voltage at which the current starts to flow in the charging electrode.

It is preferable to arrange the pretransfer charging device such that: the charging electrode is constituted by a plurality of needle-shaped or line-shaped electrodes.

According to the above structure, the charging electrode has either a needle-like shape or a line-like shape. This makes it possible to form a high electric field with a low voltage, as compared with the case where a wire-shaped or saw-tooth electrode, which is provided in the conventional and general corona discharge type charging device, is used. Therefore, a large quantity of ions can be produced with an applied voltage that is less than the corona discharge threshold voltage, with the result that the toner image formed on the image carrier can be charged efficiently.

Alternatively, the pretransfer charging device may be arranged such that: the charging electrode is constituted by a plurality of brush-shaped electrodes, in each of which a plurality of needle-shaped or line-shaped members are bound together.

According to the structure above, the use of such brush-shaped charging electrodes make it possible to reduce charge non-uniformity caused due to a pitch of the charging electrode, thereby improving the charge uniformity. Further, it is possible to reduce an influence over the charge uniformity, when a foreign substance such as dust is adhered to the tip of the electrode.

It is preferable that an interval between the image carrier and the charging electrode be not less than 4 mm but is not more than 25 mm.

By setting the interval between the charging electrode and the image carrier at 4 mm or longer, it is possible to produce (emit) ions with the use of an applied voltage that is lower than the corona discharge threshold voltage. Meanwhile, as the interval between the charging electrode and the image carrier is longer, the quantity (density) of ions reaching the toner image formed on the image carrier is reduced. Therefore, when the interval is too long, it is impossible to effectively charge the toner image efficiently. However, by setting the interval not more than 25 mm, it is possible to sufficiently supply, to the toner image, ions required for the charging.

Further, it is preferable that the pretransfer charging device further include: an electric resistor, inserted between the charging electrode and the voltage application means.

By inserting the electric resistor between the charging electrode and the voltage application means, a difference between the charge threshold voltage and the corona discharge threshold voltage becomes large. In other words, the insertion of the electric resistor widens a voltage range in which no corona discharge occurs but ions are produced so as to charge the toner image. This makes it possible to carry out charging stably.

Further, the pretransfer charging device may further include: a control electrode, provided between the image carrier and the charging electrode so as to control a passage quantity of ions; and second voltage application means for applying a predetermined voltage to the control electrode.

By applying the predetermined voltage to the control electrode provided between the charging electrode and the image carrier, the control electrode collects redundant ions, thereby uniformizing the quantity of ions going toward the toner image. This improves the charge uniformity.

The pretransfer charging device may be arranged such that the first voltage application means applies a voltage not less than a voltage, at which a charge amount of the toner image formed on the image carrier reaches a saturation amount.

Increase of the quantity of ions to be emitted so as to charge the toner image causes increase of the charge amount of the toner image, at the beginning. However, the charge amount is saturated at a certain point. According to the above structure, the charging electrode is fed with the voltage sufficient to cause the charge amount of the toner image to reach the saturation amount. This makes it possible to uniformize the charge amount that the toner image has after being charged, even when a distribution in the quantity of ions produced by the charging electrode is uneven to some extent. With this, no grid electrode, which has been used conventionally, needs to be provided. Because no grid electrode is provided, the ions are never collected by the grid electrode, so that ion utilization efficiency can be improved and manufacturing cost can be reduced.

Further, it is preferable that the pretransfer charging device further include: voltage control means for controlling, in accordance with an amount of current flowing in the image carrier, the voltage to be applied by the voltage application means.

The quantity of generated ions is fluctuated due to (i) adhesion of a foreign substance to the tip of the charging electrode, (ii) an environmental condition, and the like. Further, the proportion of generated ions reaching the toner image is also fluctuated due to a change of wind flow in the vicinity of the charging electrode and image carrier, and the like. Therefore, the charge amount of the toner image is not always the same due to influences of the fluctuations, even when the applied voltage to the charging electrode is kept to be constant. In consideration of this, the applied voltage to the charging electrode is controlled in accordance with the amount of current flowing in the image carrier. The amount of current is thus used as an index for the quantity of ions emitted toward the toner image because the quantity of ions emitted toward the toner image coincides with the amount of current flowing in the image carrier. With such control, the influences of the fluctuations can be eliminated, with the result that an optimum quantity of ions can be always supplied to the toner image.

As a more specific example of this, the voltage control means may carry out feedback control over the voltage, to be applied by the voltage application means, such that the amount of current flowing in the image carrier becomes not less than an amount of current flowing in the image carrier when a charge amount of the toner image formed on the image carrier reaches a saturation amount.

According to the above structure, the feedback control is carried out such that the amount of current flowing in the image carrier is equal to or larger than the amount of current flowing therein when the charge amount of the toner image reaches the saturation amount. This makes it possible to eliminate the influences of the fluctuations, with the result that the toner image can be uniformly charged stably.

Further, it is preferable that the pretransfer charging device further include: an ion spread prevention member, which is so provided as to surround the charging electrode and which has an aperture portion facing the image carrier.

The ions produced in response to the voltage application to the charging electrode moves toward the image carrier along the electric flux line; however, the formed electric field is weak, as compared with the electric field formed by the conventional corona discharge type charging device. Therefore, no all the ions head for the image carrier, but there are some ions spreading in a direction different from the direction toward the image carrier. In consideration of this, the ion spread prevention member having the aperture portion facing the image carrier is provided so as to surround the charging electrode, with the result that the ions are prevented from being spread. This makes it possible to improve the ion utilization efficiency and to prevent the members around the charging device from being charged unnecessarily.

It is preferable that the ion spread prevention member have a surface, which faces the charging electrode and which is made of either an insulating material or a high-resistance material having such a resistance that no corona discharge occurs between the ion spread prevention member and the charging electrode.

According to the above structure, the ion spread prevention member has the surface, which faces the charging electrode and which is made of the insulating material or the high-resistance material. This makes it possible to prevent a corona discharge from occurring with respect to the ion spread prevention member, even when the interval between the charging electrode and the ion spread prevention member is short.

Further, an image forming apparatus, according to the present invention, for carrying out image forming in accordance with an electrophotographic method includes any of the aforementioned pretransfer charging devices and the image carrier.

Further, the image forming apparatus may be arranged such that: the image carrier is constituted by a photoconductor, which is driven to rotate and transfers the toner image from a surface of the photoconductor to a transfer medium in a first transfer portion; and the pretransfer charging device is provided in an upstream of a rotation direction of the photoconductor, with respect to the first transfer portion.

According to the above structure, the toner image can be charged before the toner image is transferred from the photoconductor to the transfer medium. This improves efficiency of transferring the toner image from the photoconductor to the transfer medium.

Further, the image forming apparatus may be arranged such that: the image carrier is constituted by a photoconductor, which is driven to rotate, and an intermediating retransfer member, the photoconductor transfers the toner image from a surface of the photoconductor to the intermediating retransfer member, in a first transfer portion, the intermediating retransfer member retransfers, to a recording medium in a second transfer portion, the toner image having been transferred from the photoconductor in the first transfer portion, and the pretransfer charging device is disposed in a downstream of a rotation direction of the intermediating retransfer member with respect to the first transfer portion but is disposed in an upstream of the rotation direction of the intermediating retransfer member with respect to the second transfer portion so as to charge, before the toner image having been transferred from the photoconductor is retransferred to the recording medium in the second transfer portion, the toner image.

According to the above structure, the toner image can be charged before the toner image is transferred from the intermediating retransfer member to the recording medium. This improves efficiency of transferring the toner image from the intermediating retransfer member to the recording medium.

Further, the image forming apparatus may be arranged such that: first and second pretransfer charging devices each identical to said pretransfer charging device is provided, the image carrier is constituted by a photoconductor, which is driven to rotate, and an intermediating retransfer member, the photoconductor transfers the toner image from a surface of the photoconductor to the intermediating retransfer member, in a first transfer portion, the intermediating retransfer member retransfers, to a recording medium in a second transfer portion, the toner image having been transferred from the photoconductor in the first transfer portion, the first pretransfer charging device is disposed in an upstream of a rotation direction of the photoconductor with respect to the first transfer portion, and the second pretransfer charging device is disposed in a downstream of a rotation direction of the intermediating retransfer member with respect to the first transfer portion, but is disposed in an upstream of the rotation direction of the intermediating retransfer member with respect to the second transfer portion.

According to the above structure, the toner image can be charged before both the first transfer and the second transfer. This further improves the transfer efficiency. Each of the first and second pretransfer charging devices used herein is the aforementioned pretransfer charging device, so that the problem about generation of a discharge product such as ozone or nitroxide never arises.

Further, it is preferable that the image forming apparatus further include: a charging electrode, provided face to face with a part, in which the toner image has not been formed yet, of the surface of the photoconductor, voltage application means for applying, to the charging electrode, a voltage that is not less than the ion production threshold voltage but is less than the corona discharge threshold voltage.

According to the above structure, the same one as the aforementioned pretransfer charging device is used as a charging device for charging the photoconductor before an electrostatic latent image is formed. This further restrains generation of the discharge product such as ozone or nitroxide. Moreover, when the same one as the aforementioned pretransfer charging device is used for each of charging devices such as (i) the charging device for use in charging the photoconductor and (ii) a neutralization device for removing charges from the photoconductor, a high-voltage power supply can be shared by these charging devices. With this, the image forming device can be simplified and can be manufactured with low cost.

The present invention is usable for a pretransfer charging device, which is provided in an image forming apparatus adopting the electrophotographic method and which charges a toner image formed on an image carrier such as a photoconductor or an intermediating retransfer member, prior to transfer of the toner image.

The present invention is not limited to the description of the embodiments above, but may be altered by a skilled person within the scope of the claims. An embodiment based on a proper combination of technical means disclosed in different embodiments is encompassed in the technical scope of the present invention.

Further, the present invention encompasses a value range other than the value ranges described above, as long as the value range is a reasonable range that is not contradictory to the purpose of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A pretransfer charging device for charging a toner image formed on an image carrier of an image forming apparatus, prior to transfer of the toner image to a transfer target object, said pretransfer charging device, comprising:

a charging electrode, provided face to face with the image carrier; and a first voltage application means for applying, to the charging electrode, a voltage that is not less than an ion production threshold voltage but is less than a corona discharge threshold voltage.

2. A pretransfer charging device for charging a toner image formed on an image carrier of an image forming apparatus, prior to transfer of the toner image to a transfer target object, said pretransfer charging device, comprising:

a charging electrode, provided face to face with the image carrier; and first voltage application means for applying, to the charging electrode, a voltage not less than an ion production threshold voltage, an interval between the image carrier and the charging electrode being longer than a corona discharge threshold distance.

3. An image forming apparatus for carrying out image forming in accordance with an electrophotographic method, said image forming apparatus, comprising:

a pretransfer charging device for charging a toner image formed on an image carrier of the image forming apparatus, prior to transfer of the toner image to a transfer target object, said pretransfer charging device including (i) a charging electrode, provided face to face with the image carrier, and (ii) a first voltage application means for applying, to the charging electrode, a voltage that is not less than an ion production threshold voltage but is less than a corona discharge threshold voltage; and the image carrier.

4. The image forming apparatus as set forth in claim 3, wherein:

the image carrier is constituted by a photoconductor, which is driven to rotate and transfers the toner image from a surface of the photoconductor to a transfer medium in a first transfer portion; and the pretransfer charging device is provided in an upstream of a rotation direction of the photoconductor, with respect to the first transfer portion.

5. The image forming apparatus as set forth in claim 4, further comprising:

a charging electrode, provided face to face with a part, in which the toner image has not been formed yet, of the surface of the photoconductor, voltage application means for applying, to the charging electrode, a voltage that is not less than the ion production threshold voltage but is less than the corona discharge threshold voltage.

6. The image forming apparatus as set forth in claim 3, wherein:

the image carrier is constituted by a photoconductor, which is driven to rotate, and an intermediating retransfer member, the photoconductor transfers the toner image from a surface of the photoconductor to the intermediating retransfer member, in a first transfer portion, the intermediating retransfer member retransfers, to a recording medium in a second transfer portion, the toner image having been transferred from the photoconductor in the first transfer portion, and the pretransfer charging device is disposed in a downstream of a rotation direction of the intermediating retransfer member with respect to the first transfer portion but is disposed in an upstream of the rotation direction of the intermediating retransfer member with respect to the second transfer portion so as to charge, before the toner image having been transferred from the photoconductor is retransferred to the recording medium in the second transfer portion, the toner image.

7. The image forming apparatus as set forth in claim 3, wherein:

first and second pretransfer charging devices each identical to said pretransfer charging device is provided, the image carrier is constituted by a photoconductor, which is driven to rotate, and an intermediating retransfer member, the photoconductor transfers the toner image from a surface of the photoconductor to the intermediating retransfer member, in a first transfer portion, the intermediating retransfer member retransfers, to a recording medium in a second transfer portion, the toner image having been transferred from the photoconductor in the first transfer portion, the first pretransfer charging device is disposed in an upstream of a rotation direction of the photoconductor with respect to the first transfer portion, and the second pretransfer charging device is disposed in a downstream of a rotation direction of the intermediating retransfer member with respect to the first transfer portion, but is disposed in an upstream of the rotation direction of the intermediating retransfer member with respect to the second transfer portion.

8. An image forming apparatus for carrying out image forming in accordance with an electrophotographic method, said image forming apparatus, comprising:

a pretransfer charging device for charging a toner image formed on an image carrier of the image forming apparatus, prior to transfer of the toner image to a transfer target object, said pretransfer charging device including (i) a charging electrode, provided face to face with the image carrier, and (ii) first voltage application means for applying, to the charging electrode, a voltage not less than an ion production threshold voltage, an interval between the image carrier and the charging electrode being longer than a corona discharge threshold distance.

* * * * *